US010453398B2

(12) United States Patent
Kishi

(10) Patent No.: US 10,453,398 B2
(45) Date of Patent: Oct. 22, 2019

(54) DISPLAY APPARATUS AND DRIVING METHOD THEREOF

(71) Applicant: Sharp Kabushiki Kaisha, Osaka-shi, Osaka (JP)

(72) Inventor: Noritaka Kishi, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 202 days.

(21) Appl. No.: 14/899,830

(22) PCT Filed: Jun. 13, 2014

(86) PCT No.: PCT/JP2014/065697
§ 371 (c)(1),
(2) Date: Dec. 18, 2015

(87) PCT Pub. No.: WO2014/203810
PCT Pub. Date: Dec. 24, 2014

(65) Prior Publication Data

US 2016/0148578 A1 May 26, 2016

(30) Foreign Application Priority Data

Jun. 20, 2013 (JP) ..... 2013-129896

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/043* (2013.01);
(Continued)

(58) Field of Classification Search
CPC ..... G09G 2300/043; G09G 2300/0842; G09G 2300/0861; G09G 2300/0876;
(Continued)

(56) References Cited

U.S. PATENT DOCUMENTS 6,937,178 B1 * 8/2005 Rempfer ..... H03M 1/0678 341/144
7,619,597 B2 11/2009 Nathan et al.
(Continued)

FOREIGN PATENT DOCUMENTS

JP 2005-31630 A 2/2005
JP 2005-284172 A 10/2005
(Continued)

OTHER PUBLICATIONS

Official Communication issued in International Patent Application No. PCT/JP2014/065697, dated Sep. 16, 2014.
(Continued)

*Primary Examiner* — Nitin Patel
*Assistant Examiner* — Douglas M Wilson
(74) *Attorney, Agent, or Firm* — Keating & Bennett, LLP

(57) ABSTRACT

A detection/correction output circuit of a data-line driving circuit is provided with a transimpedance circuit including an operational amplifier and a current-detection transistor to detect a driving current that has passed through a driving transistor in a pixel circuit. The output voltage of the operational amplifier is amplified by using resistance elements connected in series. Thereby, it is possible to compensate the threshold voltage of the driving transistor with high accuracy by establishing a prescribed relationship between the gain of the driving transistor and the gain of the current detection transistor (by matching both gains) even if there is a difference between both gains. The output voltage of the operational amplifier may be amplified using a non-inverting amplifier circuit.

17 Claims, 30 Drawing Sheets

(52) U.S. Cl.
CPC ..... *G09G 2300/0842* (2013.01); *G09G 2300/0861* (2013.01); *G09G 2300/0876* (2013.01); *G09G 2310/0243* (2013.01); *G09G 2310/0275* (2013.01); *G09G 2310/0286* (2013.01); *G09G 2310/0291* (2013.01); *G09G 2310/08* (2013.01); *G09G 2320/043* (2013.01)

(58) Field of Classification Search
CPC ... G09G 2310/0243; G09G 2310/0275; G09G 2310/0286; G09G 2310/0291; G09G 2300/0819; G09G 2300/0852; G09G 2320/0295; G09G 3/3233; G09G 3/3291; G09G 2320/045; G09G 2310/0251; G09G 2310/08
See application file for complete search history.

(56) References Cited

U.S. PATENT DOCUMENTS

| | | | | |
|---|---|---|---|---|
| 7,834,825 | B2 | 11/2010 | Mizukoshi et al. | |
| 7,834,826 | B2 | 11/2010 | Kwon | |
| 7,982,695 | B2 | 7/2011 | Mizukoshi et al. | |
| 8,462,086 | B2 | 6/2013 | Takasugi et al. | |
| 2005/0017934 | A1 | 1/2005 | Chung et al. | |
| 2007/0268210 | A1 | 11/2007 | Uchino et al. | |
| 2008/0074362 | A1 | 3/2008 | Ogura | |
| 2008/0111628 | A1* | 5/2008 | Tsuchi | G09G 3/3688 330/282 |
| 2008/0231246 | A1* | 9/2008 | Sugie | G01R 19/0092 323/284 |
| 2008/0291224 | A1 | 11/2008 | Ishii et al. | |
| 2010/0045646 | A1* | 2/2010 | Kishi | G09G 3/3233 345/211 |
| 2011/0157134 | A1 | 6/2011 | Ogura | |
| 2012/0327065 | A1 | 12/2012 | Nam | |
| 2013/0256666 | A1* | 10/2013 | Chang | H01L 29/78693 257/57 |
| 2013/0256668 | A1* | 10/2013 | Oh | H01L 29/66757 257/59 |

FOREIGN PATENT DOCUMENTS

| | | | |
|---|---|---|---|
| JP | 2007-233326 | A | 9/2007 |
| JP | 2007-310311 | A | 11/2007 |
| JP | 2008-107772 | A | 5/2008 |
| JP | 2008-292649 | A | 12/2008 |
| JP | 2009-8799 | A | 1/2009 |
| JP | 2009-199057 | A | 9/2009 |
| JP | 2009-258302 | A | 11/2009 |
| JP | 2011-154348 | A | 8/2011 |
| JP | 2011-242767 | A | 12/2011 |
| WO | 2008/108024 | A1 | 9/2008 |
| WO | 2014/021201 | A1 | 2/2014 |

OTHER PUBLICATIONS

Mo et al., "Amorphous Oxide TFT Backplane for Large Size AMOLED TVs", Symposium Digest for 2010 Society for Information Display Symposium, pp. 1037-1040.

* cited by examiner

DISPLAY APPARATUS AND DRIVING METHOD THEREOF

TECHNICAL FIELD

The present disclosure relates to display apparatuses, and more particularly to a display apparatus including a pixel circuit having an electro-optical element, such as an organic EL (Electro Luminescence) element, and a driving method of the display apparatus.

BACKGROUND ART

Organic EL display apparatuses are known as a display apparatus characteristic of a thin structure, high image quality, and low power consumption. An active matrix organic EL display apparatus includes two-dimensionally arranged multiple pixel circuits, each pixel circuit including an organic EL element and a driving transistor. The organic EL element is a self-light-emitting electro-optical element, whose luminance varies in response to a driving current thereof. The driving transistor is connected in series with the organic EL element, and controls an amount of driving current flowing through the organic EL element in response to a voltage between a gate and a source thereof.

The driving transistor typically used in a pixel circuit is a thin film transistor (hereinafter referred to as TFT). More specifically, transistors as the driving transistor include an amorphous silicon TFT, a low-temperature poly-silicon TFT, an oxide TFT (also referred to as oxide semiconductor TFT), and the like. The oxide TFT includes a semiconductor layer of oxide semiconductor. The oxide TFT is manufactured of indium gallium zinc oxide (In—Ga—Zn—O).

The gain of a transistor is typically determined by a mobility, a channel width, a channel length, and a gate insulation film capacitance, and the like. An amount of current flowing through the transistor varies depending on a gate-source voltage, a gain, and a threshold voltage. If a TFT is used for the driving transistor, variations occur in the threshold voltage, the mobility, the channel width, the channel length, and the gate insulation film capacitance. If the characteristics of the driving transistor vary, variations occur in an amount of a driving current flowing through the organic EL element. For this reason, the luminance of the pixel also varies, degrading display quality.

Organic EL display apparatuses that compensate for variations in the characteristics of the driving transistor have been studied. Patent Literature 1 through 4 and Non-Patent Literature 1 disclose organic EL display apparatuses that compensate for variations in the threshold voltage only. Patent Literature 5 through 9 disclose organic EL display apparatuses that perform both the threshold voltage compensation and gain compensation (mobility compensation).

CITATION LIST

Patent Literature

PTL 1: Japanese Unexamined Patent Application Publication No. 2005-31630

PTL 2: International Publication No. 2008/108024

PTL 3: Japanese Unexamined Patent Application Publication No. 2011-242767

PTL 4: U.S. Pat. No. 7,619,597

PTL 5: Japanese Unexamined Patent Application Publication No. 2005-284172

PTL 6: Japanese Unexamined Patent Application Publication No. 2007-233326

PTL 7: Japanese Unexamined Patent Application Publication No. 2007-310311

PTL 8: Japanese Unexamined Patent Application Publication No. 2009-199057

PTL 9: Japanese Unexamined Patent Application Publication No. 2009-258302

Non Patent Literature

NPL 1: Yeon Gon Mo et al., "Amorphous Oxide TFT Backplane for Large Size AMOLED TVs" Symposium Digest for 2010 Society for Information Display Symposium, pp. 1037-1040, 2010

SUMMARY

Technical Problem

It may now be assumed that a current flowing through a driving transistor (hereinafter referred to as a driving current) with a detection voltage applied to a pixel circuit is detected by an external circuit to perform a threshold voltage compensation in an organic EL display apparatus. The driving current is detected using a current detecting transistor in an external circuit, for example. In such a case, a predetermined relationship needs to be established between the gain of the driving transistor and the gain of the current detecting transistor (for example, the two gains are equal to each other) in order to correctly perform the threshold voltage compensation. The driving transistor in the pixel circuit is manufactured through a thin-film process of TFT, and the current detecting transistor in the pixel circuit is manufactured through an LSI process (such as a monocrystalline silicon process). If the transistors are designed without any particular attention, the gain of the current detecting transistor is substantially higher than the gain of the driving transistor. For this reason, without increasing the size of the current detecting transistor (layout area), it is difficult to correctly make the threshold voltage compensation. Also, the problem with the organic EL display apparatus is a reduction in the effect of the threshold voltage compensation caused by a parasitic capacitance of a signal line.

The present disclosure is thus intended to provide a display apparatus that performs a threshold voltage compensation of the driving transistor at a higher precision level.

Solution to Problem

The embodiment of the invention in a first aspect relates to an active matrix display apparatus. The active matrix display apparatus includes a display unit including a plurality of scanning lines, a plurality of data lines, and a plurality of pixel circuits respectively disposed at intersections of the scanning lines and the data lines. The active matrix display apparatus further includes a scanning line driving circuit configured to drive the scanning lines, a data line driving circuit configured to drive the data lines, and a display control circuit. Each pixel circuit includes an electro-optical element, and a driving transistor connected in series with the electro-optical element. The data line driving circuit configures to apply a voltage responsive to a detection voltage between a control terminal and a first conducting terminal of the driving transistor, configures to convert a driving current having passed through the driving transistor and being output from the pixel circuit into a first voltage during current detection, and configures to apply a second voltage responsive to video data and a threshold voltage of the driving transistor between the control terminal and the first conducting terminal of the driving transistor during voltage writing. The second voltage is based on a voltage resulting from amplifying the first voltage, or is based on data resulting from amplifying the video data that is corrected using the threshold voltage of the driving transistor determined using the first voltage.

In accordance with a second aspect of the embodiment of the invention, in view of the first aspect, the data line driving circuit may include an amplifier configured to amplify the first voltage, and a compensation capacitance element configured to store a voltage responsive to an output voltage from the amplifier, and configures to apply the second voltage between the control terminal and the first conducting terminal of the driving transistor using the voltage stored in the compensation capacitance element.

In accordance with a third aspect of the embodiment of the invention, in view of the first aspect, the data line driving circuit may include a compensation capacitance element configured to store a voltage responsive to the first voltage, and an amplifier configured to amplify a voltage responsive to the voltage stored on the compensation capacitance element, and configures to apply the second voltage between the control terminal and the first conducting terminal of the driving transistor using the output voltage of the amplifier.

In accordance with a fourth aspect of the embodiment of the invention, in view of the second aspect, the amplifier may include an amplifier circuit including a plurality of resistance elements connected in series.

In accordance with a fifth aspect of the embodiment of the invention, in view of one of the second or the third aspect, the amplifier may include a non-inverting amplifier circuit.

In accordance with a sixth aspect of the embodiment of the invention, in view of the first aspect, the active matrix display apparatus may further include a memory that configures to save data responsive to the threshold voltage of the driving transistor on each pixel circuit. The display control circuit configures to update the data saved on the memory in response to the first voltage, configures to correct the video data using the data read from the memory, and configures to determine a level of an output voltage of the data line driving circuit by multiplying the corrected video data by a constant.

In accordance with a seventh aspect of the embodiment of the invention, in view of the sixth aspect, the display control circuit may perform a correction operation on the video data to perform compensation on the threshold voltage and a gain of the driving transistor.

In accordance with an eighth aspect of the embodiment of the invention, in view of the sixth aspect, the display control circuit may perform a correction operation on the video data to perform compensation on the threshold voltage of the driving transistor.

In accordance with a ninth aspect of the embodiment of the invention, in view of the first aspect, the data line driving circuit may apply the detection voltage to the data line and detect a driving current having flowed through from the pixel circuit to the data line during the current detection.

In accordance with a tenth aspect of the embodiment of the invention, in view of the ninth aspect, the pixel circuit may include a voltage application transistor connected between a wiring supplying a fixed voltage, and the control terminal of the driving transistor and including a control terminal connected to the scanning line, an input and output transistor connected between the data line and the first conducting terminal of the driving transistor, and including a control terminal connected to the scanning line, and a capacitance element connected between the control terminal and the first conducting terminal of the driving transistor.

In accordance with an eleventh aspect of the embodiment of the invention, in view of the first aspect, the display unit may further include a plurality of monitor lines. The data line driving circuit configures to apply the detection voltage to the data line, and configures to detect a driving current having flowed from the pixel circuit to the monitor line during the current detection.

In accordance with a twelfth aspect of the embodiment of the invention, in view of the eleventh aspect, the pixel circuit may further include an input transistor connected between the data line and the control terminal of the driving transistor and including a control terminal connected to the scanning line, an output transistor connected between the monitor line and the first conducting terminal of the driving transistor and including a control terminal connected to the scanning line, and a capacitance element connected between the control terminal and the first conducting terminal of the driving transistor.

In accordance with a thirteenth aspect of the embodiment of the invention, in view of the first aspect, the scanning lines may be divided into one or more blocks. The scanning line driving circuit configures to select part or all of the scanning lines in each block at a time during a first period and successively configures to select the scanning lines one by one in each block during a second period. In each block the data line driving circuit configures to convert a driving current output from the pixel circuit into the first voltage during the first period and configures to apply to the data line a voltage responsive to the video data and a voltage responsive to the first voltage during the second period.

In accordance with a fourteenth aspect of the embodiment of the invention, in view of the first aspect, the driving transistor may include a thin-film transistor manufactured of a semiconductor layer of oxide semiconductor.

In accordance with a fifteenth aspect of the embodiment of the invention, in view of the fourteenth aspect, the oxide semiconductor may include indium gallium zinc oxide.

In accordance with a sixteenth aspect of the embodiment of the invention, in view of the fifteenth aspect, the indium gallium zinc oxide may include crystalline.

The embodiment of the invention in a seventeenth aspect relates to a driving method of an active matrix display apparatus including a display unit including a plurality of scanning lines, a plurality of data lines, and a plurality of pixel circuits respectively disposed at intersections of the scanning lines and the data lines. The driving method includes, with the pixel circuit including an electro-optical element, and a driving transistor connected in series with the electro-optical element, a step of applying a voltage responsive to a detection voltage between a control terminal and a first conducting terminal of the driving transistor by driving the scanning line and the data line, a step of converting a driving current having passed through the driving transistor and being output from the pixel circuit into a first voltage, and a step of applying a second voltage responsive to video data and a threshold voltage of the driving transistor between the control terminal and the first conducting terminal of the driving transistor by driving the scanning line and the data line. The second voltage is based on a voltage resulting from amplifying the first voltage, or is based on data resulting from amplifying the video data that is corrected using the threshold voltage of the driving transistor determined using the first voltage.

Advantageous Effects of Invention

In accordance with the first or seventeenth aspect of the embodiment of the invention, the driving current output from the pixel circuit (a current having passed through the driving transistor) is converted into the first voltage, and during the voltage writing, the driving transistor is supplied with the second voltage based on the voltage into which the first voltage is amplified (or the data resulting from amplifying the video data that is corrected using the threshold voltage of the driving transistor that is determined using the first voltage). The threshold voltage compensation of the driving transistor is performed at a higher precision level even if there is a difference between the gain of the driving transistor and the gain of a current detecting circuit or even if the effect of the threshold voltage compensation is reduced by the parasitic capacitance of a signal line.

In accordance with the second aspect of the embodiment of the invention, the voltage needed to perform the threshold voltage compensation of the driving transistor is determined based on the voltage stored on the compensation capacitance element. Even if there is a difference between the gain of the driving transistor and the gain of the current detecting circuit, the threshold voltage compensation of the driving transistor is performed at a higher precision level by amplifying the first voltage responsive to the amount of driving current without increasing the size of the current detecting circuit.

In accordance with the third aspect of the embodiment of the invention, the voltage needed to perform the threshold voltage compensation of the driving transistor is determined based on the output voltage of the amplifier. Even if there is a difference between the gain of the driving transistor and the gain of the current detecting circuit, the threshold voltage compensation of the driving transistor is performed at a higher precision level by amplifying the first voltage responsive to the amount of driving current without increasing the size of the current detecting circuit.

In accordance with the fourth aspect of the embodiment of the invention, the amplifier includes the plurality of resistance elements connected in series.

In accordance with the fifth aspect of the embodiment of the invention, the amplifier includes the non-inverting amplifier circuit.

In accordance with the sixth aspect of the embodiment of the invention, the data responsive to the threshold voltage of the driving transistor is determined based on the detection results of the driving current. The video data is corrected using the determined data. The level of the output voltage of the data line driving circuit is determined by multiplying the corrected video data by the constant. Even if the effect of the threshold voltage compensation is reduced by the parasitic capacitance of the signal line, the threshold voltage compensation of the driving transistor is performed at a higher precision level by compensating for the reduction in the effect.

In accordance with the seventh aspect of the embodiment of the invention, the image quality of a displayed image is increased by performing compensation on the threshold voltage and the gain of the driving transistor in each pixel circuit.

In accordance with the eighth aspect of the embodiment of the invention, the image quality of a displayed image is increased by performing compensation on the threshold voltage and the gain of the driving transistor in each pixel circuit.

In accordance with the ninth aspect of the embodiment of the invention, the driving current flowing through the data line with the detection voltage applied to the data line is detected. The number of wirings may thus be reduced by detecting the driving current using the data line.

In accordance with the tenth aspect of the embodiment of the invention, the pixel circuit includes the capacitance element connected between the control terminal and the first conducting terminal of the driving transistor, and is used with the voltage of the data line applied to the first conducting terminal of the driving transistor. The threshold voltage compensation of the driving transistor is thus performed at a higher precision level.

In accordance with the eleventh aspect of the embodiment of the invention, the display apparatus further includes the monitor lines different from the data lines. When the detection voltage is applied to the data line, the driving current flowing through the monitor line is detected.

In accordance with the twelfth aspect of the embodiment of the invention, the pixel circuit includes a capacitance element between the control terminal and the first conducting terminal of the driving transistor, and is used with the voltage of the data line applied to the control terminal of the driving transistor. The threshold voltage compensation of the driving transistor is performed at a higher precision level.

In accordance with the thirteenth aspect of the embodiment of the invention, a current output from the pixel circuit is detected on a per block basis. Time to detect the current is thus shortened.

In accordance with the fourteenth through sixteenth aspects of the embodiment of the invention, the use of the oxide TFT as the driving transistor (such as TFT with a semiconductor layer manufactured of indium gallium zinc oxide) increases the driving current, shortens the writing time, and increases the luminance of the screen.

DESCRIPTION OF EMBODIMENTS

Organic EL display apparatuses of embodiments of the present invention are described with reference to the drawings. In the discussion that follows, m and n represent 2 or greater integer numbers, i represents an integer number equal to or above 1 but equal to or below m, and j represents an integer number equal to or above 1 but equal to or below n. A transistor included in the pixel circuit in each embodiment is a field-effect transistor, and is typically a thin-film transistor. For example, the transistor included in the pixel circuit is an oxide TFT, a low-temperature polysilicon TFT, or an amorphous silicon TFT. The oxide TFT is effective if used as an n-channel transistor. In the present invention, a p-channel oxide TFT may be used.

(First Embodiment)

Figure 1:
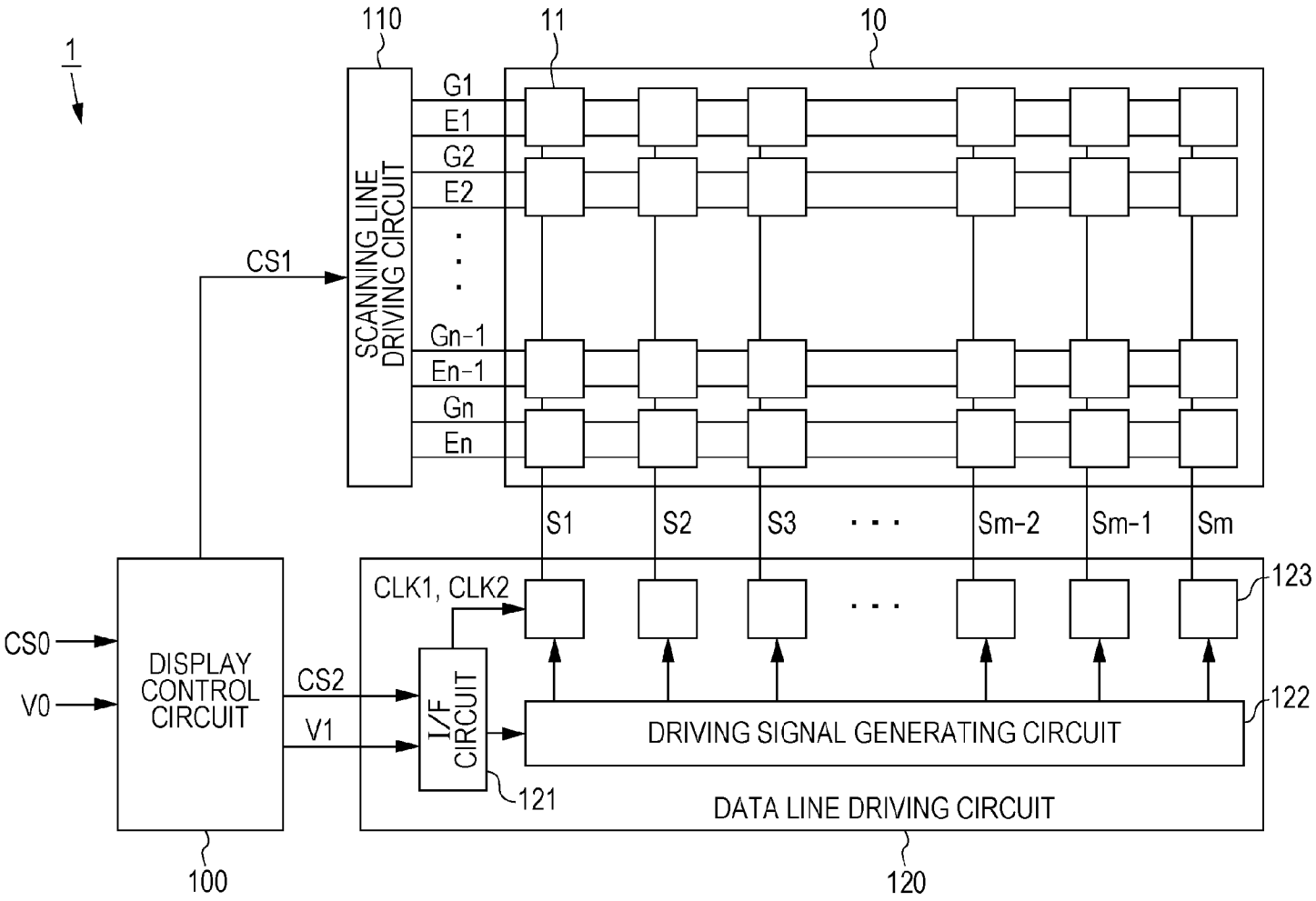
FIG. 1 is a block diagram illustrating a configuration of an organic EL display apparatus of a first embodiment of the present invention.

FIG. 1 is a block diagram illustrating a configuration of an organic EL display apparatus of a first embodiment of the present invention. The organic EL display apparatus 1 of FIG. 1 includes a display unit 10, a display control circuit 100, a scanning line driving circuit 110, and a data line driving circuit 120. The organic EL display apparatus 1 is an active matrix display apparatus.

The display unit 10 includes n scanning lines G1 through Gn, n light-emission control lines E1 through En, m data lines S1 through Sm, and (m×n) pixel circuits 11. The scanning lines G1 through Gn and the light-emission control lines E1 through En are respectively arranged to extend in parallel with each other. The data lines S1 through Sm intersect the scanning lines G1 through Gn. The scanning lines G1 through Gn intersect the data lines S1 through Sm respectively at (m×n) intersections. The (m×n) pixel circuits 11 are respectively arranged at the intersections of the scanning lines G1 through Gn and the data lines S1 through Sm. In the discussion that follows, the extension direction of the scanning lines G1 through Gn is referred to as a row direction, and the extension direction of the data lines S1 through Sm is referred to as a column direction. The pixel circuit 11 arranged at a j-th row and an i-th column is referred to as a pixel circuit PX(i,j).

The display unit 10 is supplied with a high-level power source voltage ELVDD and a low-low power source voltage ELVSS from a power source circuit (not illustrated). The display unit 10 includes a high-level power source line and a low-level power source line (none of these lines are illustrated) to supply the pixel circuits 11 with these voltages.

The display control circuit 100 controls the scanning line driving circuit 110 and the data line driving circuit 120, based on a control signal CS0 and video data V0 supplied from outside the organic EL display apparatus 1. More in detail, the display control circuit 100 outputs a control signal CS1 to the scanning line driving circuit 110 and a control signal CS2 and video data V1 to the data line driving circuit 120.

The scanning line driving circuit 110 drives the scanning lines G1 through Gn and the light-emission control lines E1 through En, and the data line driving circuit 120 drives the data lines S1 through Sm. More in detail, the scanning line driving circuit 110 successively selects the scanning lines G1 through Gn one by one in response to a control signal CS1, applies a selected voltage (high-level voltage) to the selected scanning line, and applies non-selective voltage (low-level voltage) to the other scanning lines. The scanning line driving circuit 110 also applies a low-level voltage to a light-emission control line Ej during the selection period of the scanning line Gj (refer to FIG. 5 as below). The data line driving circuit 120 includes an interface circuit 121, a driving signal generating circuit 122, and m detection/correction output circuits 123. In response to the control signal CS2, the data line driving circuit 120 applies a data voltage responsive to video data V1 to the data lines S1 through Sm. The video data V1 may be identical to the video data V0, or may be data resulting from performing a correction operation on the video data V0.

Figure 2:
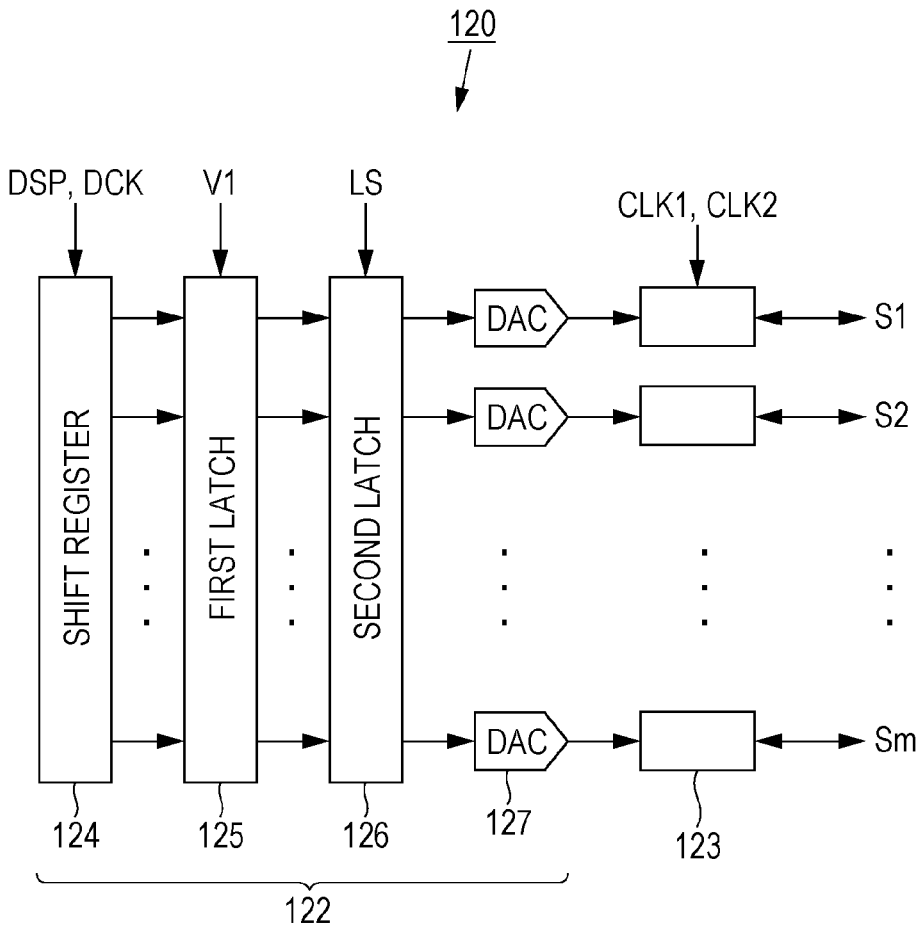
FIG. 2 is a block diagram illustrating in detail a data line driving circuit of FIG. 1.

FIG. 2 is a block diagram illustrating in detail the data line driving circuit 120. As described above, the data line driving circuit 120 includes the interface circuit 121 (not illustrated), the driving signal generating circuit 122, and the m detection/correction output circuits 123. The interface circuit 121 receives the video data V1 transmitted from the display control circuit 100. The driving signal generating circuit 122 includes a shift register 124, a first latch 125, a second latch 126, and m D/A converters 127. The shift register 124 is a m-stage shift register, and each of the first latch 125 and the second latch 126 includes m latch circuits (not illustrated).

The control signal CS2 supplied from the display control circuit 100 to the data line driving circuit 120 includes a data start pulse DSP, a data clock DCK, a latch strobe signal LS, and clocks CLK1 and CLK2. The shift register 124 successively shifts the data start pulse DSP in synchronization with the data clock DCK. The output of each state of the shift register 124 rises to a high level at a time during one horizontal period. The first latch 125 successively saves the video data V1 of one row (m pieces of video data) in synchronization with of the output signal from the shift register 124. The second latch 126 holds the m pieces of video data saved on the first latch 125 in synchronization with the latch strobe signal LS. Each D/A converter 127 corresponds to one of the m latch circuits included in the second latch 126. The D/A converter 127 outputs as data voltage Vdata a voltage responsive to the video data held by the corresponding latch circuit.

The detection/correction output circuit 123 operates in response to clocks CLK1 and CLK2. The detection/correction output circuit 123 converts a driving current flowing through the data line Si from the pixel circuit PX(i,j) (a current having passed through the driving transistor) into a voltage, and applies to the data line Si a voltage that is determined by a voltage responsive to the video data V1 and a voltage determined through the current to voltage conversion.

Figure 3:
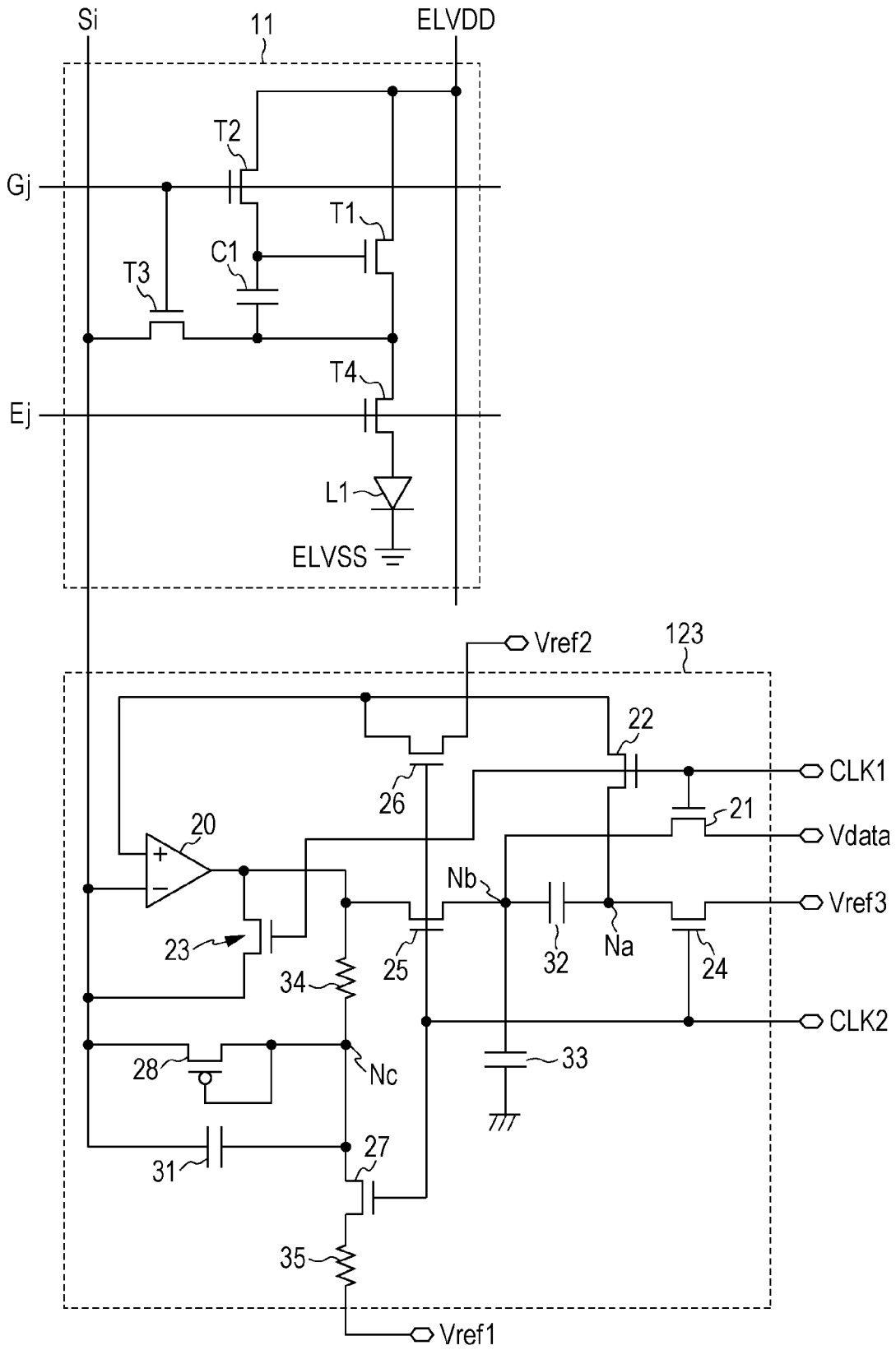
FIG. 3 is a circuit diagram of a pixel circuit and a detection/correction output circuit included in the organic EL display apparatus of FIG. 1.

FIG. 3 is a circuit diagram of the pixel circuit 11 and the detection/correction output circuit 123. FIG. 3 illustrates the pixel circuit PX(i,j) and the detection/correction output circuit 123 corresponding to the data line Si. The pixel circuit 11 includes an organic EL element L1, four transistors T1 through T4, and a capacitor C1. Each of the transistors T1 through T4 is of an n-channel type. The transistors T1 through T4 are TFTs having a semiconductor layer of oxide semiconductor, such as indium gallium zinc oxide. The transistors T1 through T4 respectively work as a driving transistor, a voltage application transistor, an input and output transistor, and a light-emission control transistor. The capacitor C1 works as a capacitance element.

The transistors T1 and T4 are connected in series with the organic EL element L1, and these elements are connected between a high-level power source line supplying the high-level power source voltage ELVDD and a low-level power source line supplying the low-level power source voltage ELVSS. The drain terminal of the transistor T1 is connected to the high-level power source line, and the source terminal of the transistor T1 is connected to the drain terminal of the transistor T4. The source terminal of the transistor T4 is connected to the anode terminal of the organic EL element L1, and the cathode terminal of the organic EL element L1 is connected to the low-level power source line. The transistor T2 is connected between the high-level power source line and the gate terminal of the transistor T1. The transistor T3 is connected between the data line Si and the source terminal of the transistor T1. The capacitor C1 is connected between the gate germinal and the source terminal of the transistor T1. The gate terminals of the transistors T2 and T3 are connected to the scanning line Gj, and the gate terminal of the transistor T4 is connected to the light-emission control line Ej.

The detection/correction output circuit 123 includes the operational amplifier 20, eight transistors 21 through 28, three capacitors 31 through 33, and two resistance elements 34 and 35. The transistors 21 through 27 are of an n-channel type, and the transistor 28 is of a p-channel type. But the transistors 21 through 28 may all be of a p-channel type or an n-channel type. Instead of the transistors 21 through 28, other switching elements may be used. As illustrated in FIG. 3, a node connected to the right lead of the capacitor 32 is labeled node Na, the node connected to the left lead of the capacitor 32 is designated node Nb, and the lower lead of the resistance element 34 is designated node Nc.

The inverting input terminal of the operational amplifier 20 is connected to the data line Si. The transistor 23 is connected between the inverting input terminal and the output terminal of the operational amplifier 20. One terminal of the resistance element 34 is connected to the output terminal of the operational amplifier 20. One conducting terminal of the transistor 28 is connected to the non-inverting input terminal of the operational amplifier 20, and the gate terminal and the other conducting terminal of the transistor 28 are connected to the node Nc. The transistor 28 works as a diode element. The capacitor 31 is connected in parallel with the transistor 28 between the non-inverting input terminal of the operational amplifier 20 and the node Nc. The capacitor 31 has a function of stabilizing a negative feedback operation of the operational amplifier 20. One conducting terminal of the transistor 27 is connected to the node Nc while the other conducting terminal of the transistor 27 is connected to one terminal of the resistance element 35. The other terminal of the resistance element 35 is supplied with a reference voltage Vref1.

One conducting terminal of the transistor 21 is connected to the node Nb and the other conducting terminal of the transistor 21 is supplied with a data voltage Vdata (output voltage of the D/A converter 127). One conducting terminal of the transistor 22 is connected to the node Na while the other conducting terminal of the transistor 22 is connected to the non-inverting input terminal of the operational amplifier 20. One conductive terminal of the transistor 24 is connected to the node Na and the other conductive terminal of the transistor 24 is supplied with a reference voltage Vref3. The transistor 25 is connected between the node Nb and the output terminal of the operational amplifier 20. One conducting terminal of the transistor 26 is connected to the non-inverting input terminal of the operational amplifier 20 while the other conducting terminal of the transistor 26 is supplied with a reference voltage Vref2. One conducting terminal of the capacitor 33 is connected to the node Nb while the other conducting terminal of the capacitor 33 is grounded.

The clock CLK1 is applied to the gate terminals of the transistors 21 through 23, and the clock CLK2 is applied to the gate terminals of the transistors 24 through 27. The transistor 23 works as a function selection switch, the transistor 28 works as a current detecting circuit (current detecting transistor), the capacitor 32 works as a compensation capacitance element, and the resistance elements 34 and 35 work as an amplifier circuit. The reference voltages Vref1 through Vref3 are supplied by a power source circuit (not illustrated).

Figure 4:
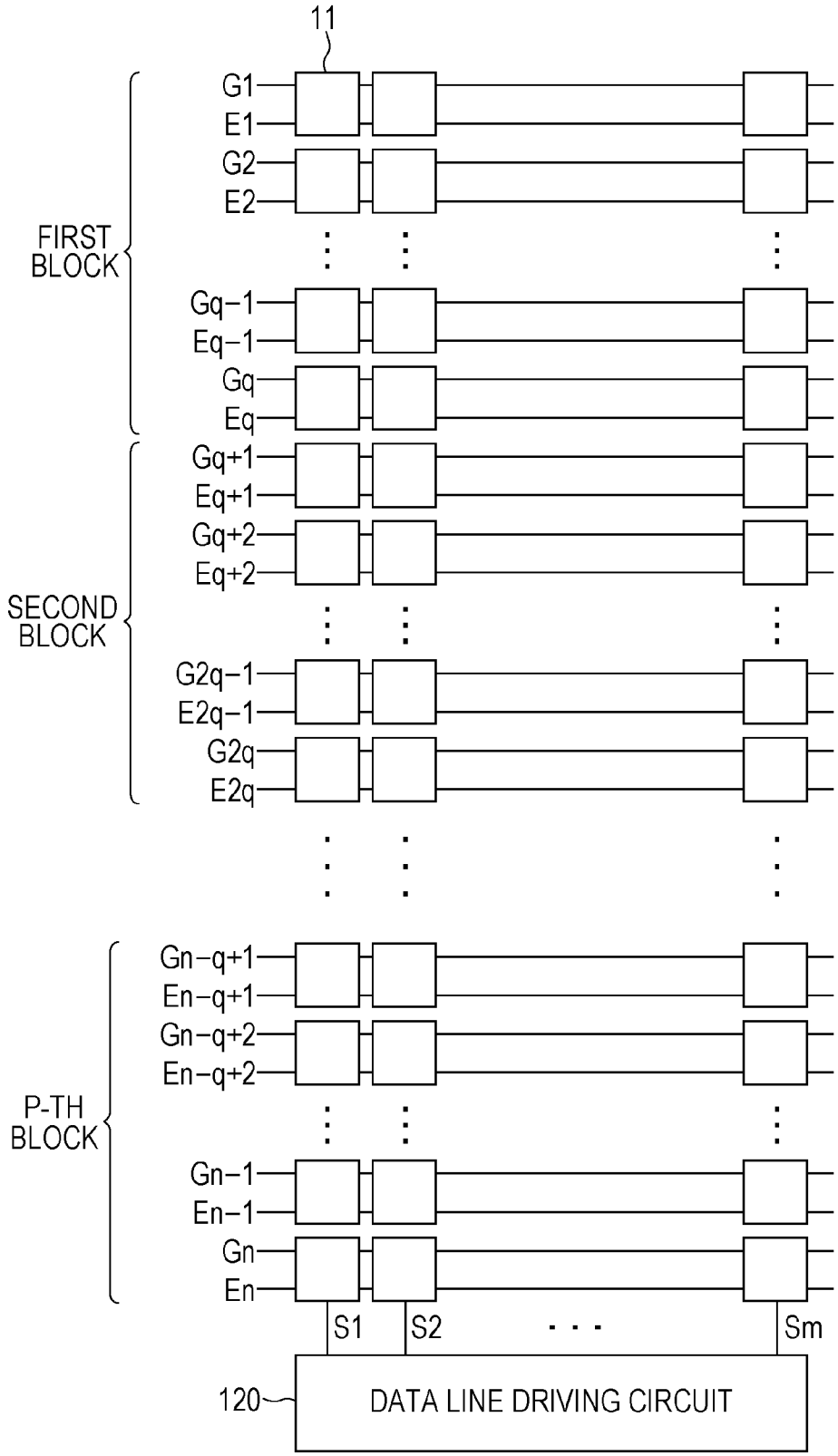
FIG. 4 illustrates a block segmentation of the organic EL display apparatus of FIG. 1.

In the organic EL display apparatus 1, the scanning lines G1 through Gn and the light-emission control lines E1 through En are segmented into one or more blocks, and the driving current in the pixel circuit 11 is detected on a per block basis. In the discussion that follows, p is an integer multiple of n excluding n itself, and q=n/p holds. FIG. 4 illustrates a block segmentation of the organic EL display apparatus 1. As illustrated in FIG. 4, the scanning lines G1 through Gn are segmented according to q lines into p blocks, and as the scanning lines G1 through Gn, the light-emission control lines E1 through En are also segmented into p blocks. A first block includes scanning lines G1 through Gq and light-emission control lines E1 through Eq. A second block includes scanning lines Gq+1 through G2*q* and light-emission control lines Eq+1 through E2*q*. A p-th block includes scanning lines Gn-q+1 through Gn and light-emission control lines En-q+1 through En. The number of blocks p may be 1, and the number of scanning lines may be different from block to block.

The organic EL display apparatus 1 sets p block selection periods during 1 frame period, and each block selection period includes a common selection period and a scanning period. The scanning line driving circuit 110 selects q scanning lines in the block at a time during the common selection period, and successively selects q scanning lines one by one in the block during the scanning period. The scanning line driving circuit 110 selects which block to choose from block selection period to block selection period. The data line driving circuit 120 converts into a voltage a current flowing through the data line Si during the common selection period, and applies to the data line Si a voltage based on the data voltage Vdata and a voltage determined during the common selection period during the scanning period.

Figure 5:
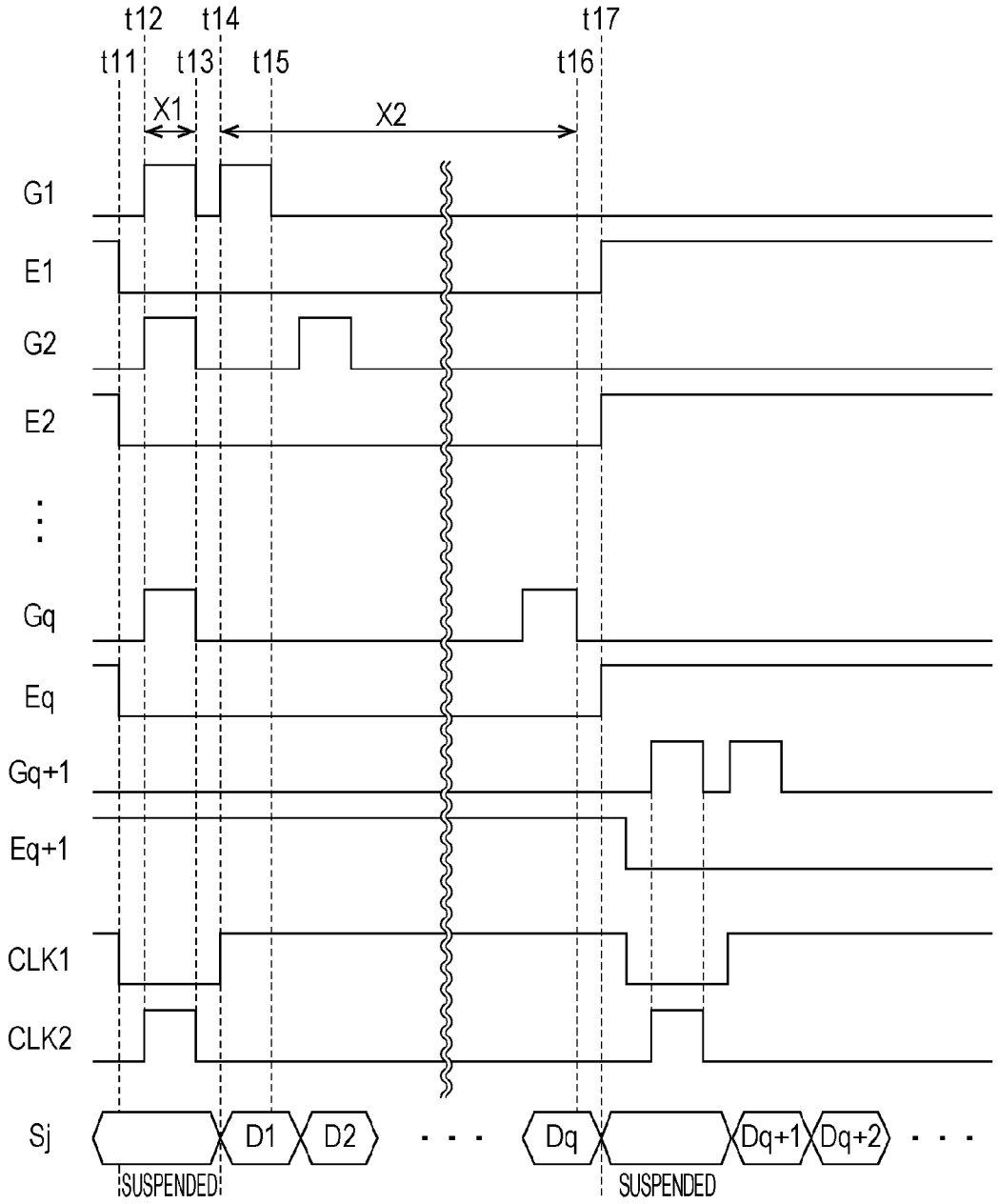
FIG. 5 is a timing diagram illustrating the shifting of signals in the organic EL display apparatus of FIG. 1.

FIG. 5 is a timing diagram illustrating the shifting of signals in the organic EL display apparatus 1. Referring to FIG. 5, a time duration from t12 to t16 is a selection period of the first block, a time duration from t12 to t13 is the common selection period X1 and a time duration from t14 to t16 is a scanning period X2. Referring to FIG. 5, Dj designates a corrected data voltage to be written onto the pixel circuit PX(i,j). In the discussion that follows, q pixel circuits 11 from the first row to the q-th row at the j-th column are collectively referred to as the pixel circuit PX(i,1:q). In the discussion that follows, a signal on the scanning line Gj is referred to as a scanning signal Gj, and a signal on a light-emission control line Ej is referred to as a light-emission control signal Ej.

Prior to time t11, the scanning signals G1 through Gq and the clock CLK2 are at a low level, and the light-emission control signals E1 through Eq and the clock CLK1 are at a high level. In the pixel circuit PX(i,1:q) then, the transistors T2 and T3 are turned off, and the transistor T4 is turned on. A driving current responsive to the voltage stored on the capacitor C1 flows through the transistor T1 and the organic EL element L1. The organic EL element L1 emits light at a luminance level responsive to the driving current. At time t11, the light-emission control signals E1 through Eq and the clock CLK1 shift to a low level. In response, the transistors 21 through 23 are turned off, and in the pixel circuit PX(i,1:q), the transistor T4 is turned off.

At time t12, the scanning signals G1 through Gq shift to a high level. In response, the transistors T2 and T3 are turned on in the pixel circuit PX(i,1:q). Also at time t12, the clock CLK2 shifts to a high level. In response, transistors 24 through 27 are turned on. The node Na is supplied with the reference voltage Vref3, the output terminal of the operational amplifier 20 is connected to the node Nb, the non-inverting input terminal of the operational amplifier 20 is supplied with the reference voltage Vref2, and the node Nc is connected to the one terminal of the resistance element 35. The data line Si connected to the non-inverting input terminal of the operational amplifier 20 is supplied with the reference voltage Vref2 through virtual short. For this reason, in the pixel circuit PX(i,1:q), one terminal (lower lead) of the capacitor C1 is supplied with the reference voltage Vref2 through the transistor T3, and the other end (upper lead) of the capacitor C1 is supplied with the high-level power source voltage ELVDD through the transistor T2. During the common selection period X1, the capacitor C1 in the pixel circuit PX(i,1:q) is charged with a voltage Vgsa expressed by the following formula (1):

$$Vgsa=ELVDD-V\mathrm{ref2} \tag{1}$$

Since the transistor 23 is then turned off, the operational amplifier 20 and the transistor 28 work as a transimpedance circuit. More specifically, during the common selection period X1, a driving current responsive to the voltage Vgsa expressed by formula (1) flows from q pixel circuits PX(i,1:q) to each data line Si. All driving currents flowing from q pixel circuits (i,1:q) into the data line Si flow into the transistor 28, and the transistor 28 converts the driving currents into a voltage.

Let R1 and R2 be resistances of the resistance elements 34 and 35 respectively, and let Vc be the voltage at the node Nc. Since the current flowing through the resistance element 35 is (Vc−Vref1)/R2, the output voltage Vout of the operational amplifier 20 is {Vc+(Vc−Vref1)×R1/R2}. If Vref1=0, Vout=Vc×(R1+R2)/R2. The amplifier circuit formed of the two resistance elements 34 and 35 connected in series amplifies the voltage Vc, determined by the transistor 28, by (R1+R2)/R1 times.

The threshold voltage of the driving transistor T1 may now be represented by Vtha, the gain of the transistor T1 may be represented by βa, the threshold voltage of the transistor 28 may be represented by Vthb, the gain of the transistor 28 may be represented by βb, and the gate-source voltage of the transistor 28 during the common selection period X1 may be represented by Vgsb. During the common selection period X1, a current Ia flowing through the transistor T1 is expressed by the following formula (2), and during the common selection period X1, and during the common selection period X1, a current Ib flowing through the transistor 28 is expressed by the following formula (3).

$$Ia=(\beta a/2)\times(Vgsa-Vtha)^2 \tag{2}$$

$$Ib=(\beta b/2)\times(Vgsb-Vthb)^2 \tag{3}$$

If it is assumed that the currents Ia are equal to each other in the pixel circuits PX(i,1:q), q×Ia=Ib holds, and the following formula (4) is derived from formulas (2) and (3).

$$c1(Vgsa-Vtha)=Vthb-Vgsb \tag{4}$$

Also, the following formula (5) holds between the voltage Vgsb and the voltage Vout.

$$V\mathrm{ref2}+Vgsb=V\mathrm{out}\times R2/(R1+R2) \tag{5}$$

The voltage Vout is expressed by the following formula (6) in view of formula (1). In formula (6), c1=√(q×βa/βb), and c2=(R1+R2)/R2.

$$Vout=(1+c1)c2\times Vref2-c1\times c2\times(ELVDD-Vtha)+c2\times Vthb \quad (6)$$

If c1×c2=1 holds in formula (6), the following formula (7) is derived.

$$Vout=(1+c2)Vref2-ELVDD+Vtha+c2\times Vthb \quad (7)$$

The resistances R1 and R2 are determined such that the coefficient of Vtha in formula (6) is 1 in view of the gains βa and βb of the transistors T1 and 28, and the number of scanning lines q in the block (in other words, c1×c2=1). It is also assumed that the threshold voltage Vthb is free from variations and aging. Since the terms other than Vtha in formula (7) are constants, the voltage Vout varies depending on only the threshold voltage Vtha of the transistor T1. The voltage Vout is applied to the node Nb, and the reference voltage Vref3 is applied to the node Na via the transistor 24. During the common selection period X1, the capacitor 32 is charged with a voltage Vd expressed by the following formula (8).

$$\begin{aligned} Vd &= Vout - Vref3 \quad (8) \\ &= (1+c2)Vref2 - Vref3 - ELVDD + Vtha + c2\times Vthb \end{aligned}$$

At time t13, the scanning signals G1 through Gq and the clock CLK2 shift to a low level. In response, the transistors T2 and T3 are turned off in the pixel circuit PX(i,1:q), and the capacitor C1 stores the voltage Vgsa expressed by formula (1). The transistors 24 through 27 are turned off in the detection/correction output circuit 123, and the capacitor 32 stores the voltage Vd expressed by formula (8).

At time t14, the clock CLK1 shifts to a high level. In response, the transistors 21 through 23 are turned on. At time t14 and thereafter, the operational amplifier 20 works as a buffer amplifier, and the data voltage Vdata is applied to the node Nb via the transistor 21. The operational amplifier 20 applies to the data line Si the corrected data voltage Vcd expressed by the following formula (9).

$$\begin{aligned} Vcd &= Vdata - Vd \quad (9) \\ &= Vdata - (1+c2)Vref2 + Vref3 + ELVDD - Vtha - c2\times Vthb \end{aligned}$$

At time t14, the scanning signal G1 shifts to a high level. In response, the transistors T2 and T3 are turned on in the pixel circuit PX(i,1). For this reason, one terminal (lower lead) of the capacitor C1 is supplied with the voltage Vcd expressed by formula (9) via the transistor T3, and the other terminal (upper lead) of the capacitor C1 is supplied with the high-level power source voltage ELVDD via the transistor T2. During a time duration from t14 to t15, the capacitor C1 is charged with a voltage Vgs expressed by the following formula (10).

$$\begin{aligned} Vgs &= ELVDD - Vcd \quad (10) \\ &= -Vdata + (1+c2)Vref2 - Vref3 + Vtha + c2\times Vthb \end{aligned}$$

At time t15, the scanning signal G1 shifts to a low level. In response, the transistors T2 and T3 are turned off in the pixel circuit PX(i,1). At time t15 and thereafter, the capacitor C1 stores the voltage Vgs expressed by formula (10) in the pixel circuit PX(i,1). During a time duration from time t15 to time t16, the scanning signals G2 through Gq successively shift to a high level. In this way, the corrected data voltage is successively written on the pixel circuits 11 arranged at second through q-th rows.

At time t17, the light-control signals E1 through Eq shift to a high level. In response, the transistor T4 is turned on in the pixel circuit PX(i,1:q). At time t17 and thereafter, a current IL1 expressed by the following formula (11) flows through the transistor T1 and the organic EL element L1 in the pixel circuit PX(i,1:q), and the organic EL element L1 emits light at a luminance level responsive to the current IL1.

$$\begin{aligned} IL1 &= (\beta a/2)\times(Vgs - Vtha)^2 \quad (11) \\ &= (\beta a/2)\times(-Vdata + (1+c2)Vref2 - Vref3 + c2\times Vthb)^2 \end{aligned}$$

Since the terms other than (−Vdata) are constants in formula (11), the current IL1 expressed by formula (11) is not dependent on the threshold voltage Vtha of the transistor T1. The organic EL display apparatus 1 may thus perform the threshold voltage compensation of the transistor T1.

The organic EL display apparatus 1 performs the threshold voltage compensation of the driving transistor T1. In the above discussion, the scanning line driving circuit 110 selects all the scanning lines in the block at a time during the common selection period. Alternatively, the scanning line driving circuit 110 may select part of the scanning lines in the block at a time during the common selection period.

The advantage of amplifying the voltage Vc determined by the transistor 28 using the amplifier circuit in the organic EL display apparatus 1 of the present embodiment is described below. Typically, the transistor T1 is manufactured through the TFT thin film process, and the transistor 28 is manufactured through the LSI process. If the transistors are designed without paying any particular attention, the gain βb of the transistor 28 becomes substantially higher than the gain βa of the transistor T1. In order to perform the threshold voltage compensation of the transistor T1 in the organic EL display apparatus having no amplifier circuit (in order to cause the current IL1 to be independent on the threshold voltage Vtha of the transistor T1), the W/L ratio of the transistor 28 needs to be decreased to decrease the gain βb of the transistor 28. However, according to the design rule constraints, the length L of the transistor 28 needs to be longer to decrease the W/L ratio of the transistor 28. For this reason, the size of the transistor 28 (layout area) needs to be increased to perform the threshold voltage compensation in the organic EL display apparatus having no amplifier circuit.

To solve this problem, the organic EL display apparatus 1 of the present embodiment includes the amplifier circuit formed of the two resistance elements 34 and 35 connected in series in the detection/correction output circuit 123 of the data line driving circuit 120. This amplifier circuit amplifies the voltage Vc, determined by the transistor 28, by (R1+R2)/R1 times. In order to cause the current IL1 not to be dependent on the threshold voltage Vtha of the transistor T1, the resistances R1 and R2 of the resistance elements 34 and 35 are determined such that the coefficient of Vtha in formula (6) is 1. In the organic EL display apparatus 1 of the present embodiment, the threshold voltage compensation of the transistor T1 is performed at a higher precision level without increasing the size of the transistor 28.

As described above, in the organic EL display apparatus 1 of the present embodiment, the pixel circuit 11 includes an electro-optical element (the organic EL element L1) and the driving transistor T1 connected in series with the electro-optical element. During current detection (the common selection period), the data line driving circuit 120 applies a voltage (the voltage Vgsa expressed by formula (1)) responsive to a detection voltage (the reference voltage Vref2) between the control terminal (gate terminal) and the first conducting terminal (source terminal) of the driving transistor T1, and converts the driving current output from the pixel circuit 11 via the driving transistor T1 into a first voltage Vc. During voltage writing (scanning period), the data line driving circuit 120 applies a second voltage (the voltage Vgs expressed by formula (10)) responsive to the video data V1 and the threshold voltage Vth of the driving transistor T1 between the control terminal of and the first conducting terminal of the driving transistor T1. The second voltage is based on the voltage Vc×(R1+R2)/R2 which results from amplifying the first voltage Vc.

The organic EL display apparatus 1 of the present embodiment converts the driving current output from the pixel circuit 11 into the first voltage, and applies to the driving transistor the second voltage responsive to the voltage resulting from amplifying the first voltage during the voltage writing. Even if there is a difference between the gain of the driving transistor T1 and the gain of the current detecting circuit (the transistor 28), the threshold voltage compensation of the driving transistor T1 is performed at a higher precision level by establishing a predetermined relationship between the two gains without increasing the size of the current detecting circuit.

The data line driving circuit 120 includes an amplifier to amplify the first voltage (the amplifier circuit formed of the resistance elements 34 and 35), and a compensation capacitance element (the capacitor 32) to store a voltage (the voltage Vd expressed by formula (8)) responsive to the output voltage of the amplifier. The data line driving circuit 120 applies the second voltage between the control terminal and the first conducting terminal of the driving transistor T1 using the voltage stored on the compensation capacitance element. The voltage needed to perform threshold voltage compensation of the driving transistor T1 is determined based on the voltage stored on the compensation capacitance element. Even if there is a difference between the gain of the driving transistor T1 and the gain of the current detecting circuit, the threshold voltage compensation of the driving transistor is performed at a higher precision level by amplifying the first voltage responsive to the amount of driving current without increasing the size of the current detecting circuit.

The data line driving circuit 120 applies the detection voltage (the reference voltage Vref2) to the data line Si during the current detection, thereby detecting the driving current flowing from the pixel circuit 11 to the data line Si. In this way, the driving current flowing through the data line Si with the detection voltage applied to the data line Si is detected. By detecting the driving current using the data line Si, the number of wirings is reduced.

The pixel circuit 11 includes the voltage application transistor T2 connected between a wiring (the high-level power source line) applying a fixed voltage (the high-level power source voltage ELVDD) and the control terminal of the driving transistor and having the control terminal (gate terminal) connected to the scanning line Gj, the input and output transistor T3 connected between the data line Si and the first conducting terminal of the driving transistor T1 and having the control terminal connected to the scanning line Gj, and the capacitance element (the capacitor C1) connected between the control terminal and the first conducting terminal of the driving transistor T1. The pixel circuit 11 thus includes the capacitance element between the control terminal and the first conducting terminal of the driving transistor T1 and is operated with the voltage of the data line Si applied to the first conducting terminal of the driving transistor T1. The threshold voltage compensation of the driving transistor T1 is performed at a higher precision level without increasing the size of the current detecting circuit.

The scanning lines G1 through Gn in the organic EL display apparatus 1 are segmented into one or more blocks. The scanning line driving circuit 110 selects part or all scanning lines in each block at a time during a first duration (common selection period) and successively selects the scanning lines one by one in each block during a second period (scanning period). In each block, the data line driving circuit 120 converts the driving current output from the pixel circuit 11 into a voltage during the first period, and applies to the data line Si a voltage (the voltage Vcd expressed by formula (9)) based on the voltage responsive to the video data and the voltage determined during the second period. Time needed to detect current is shortened by detecting a current output from the pixel circuit 11 on a per block basis. The use of the oxide TFT as the driving transistor T1 (such as a TFT with a semiconductor layer containing indium gallium zinc oxide) increases the driving current, shortens the writing time, and increases the luminance on the screen.

Figure 6:
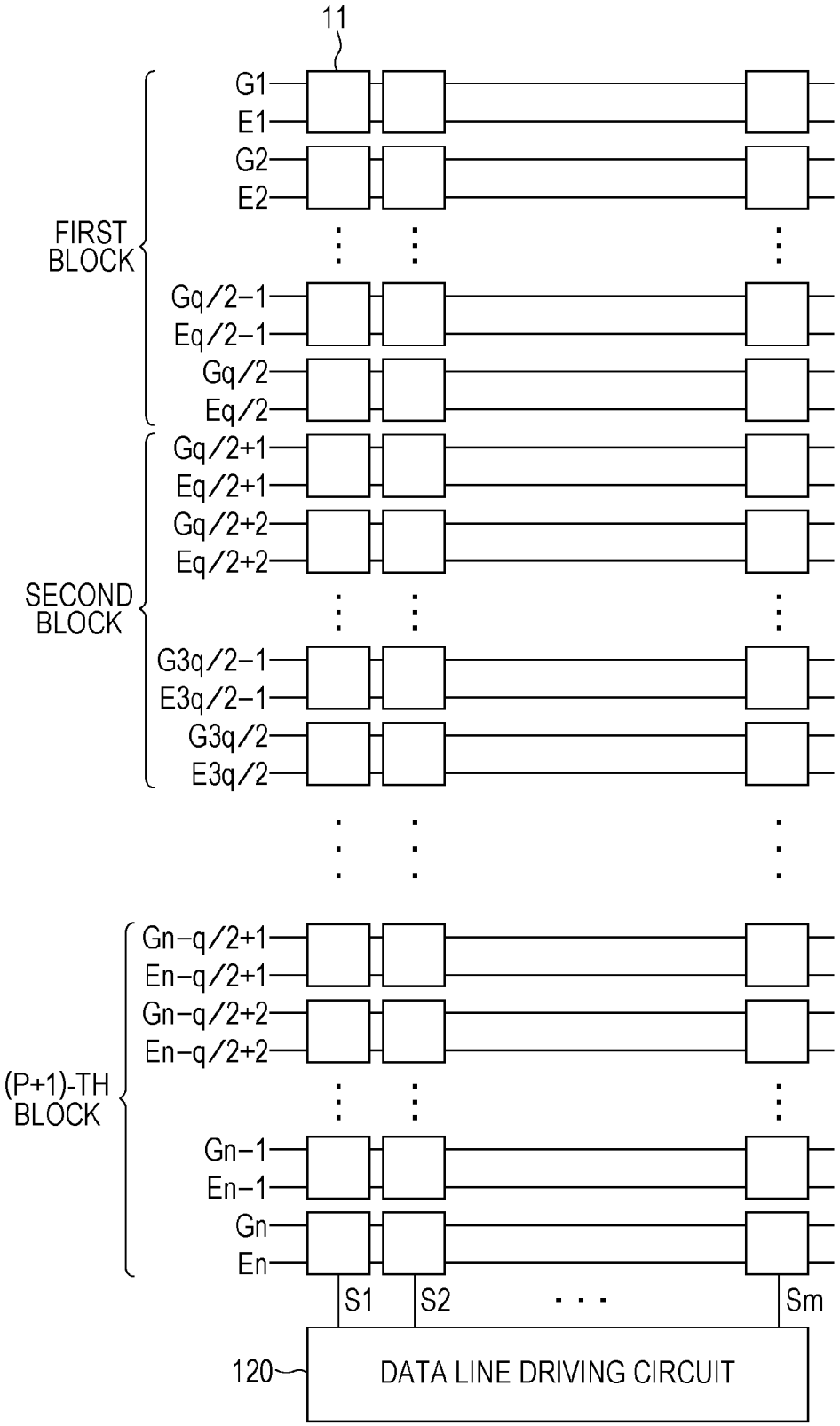
FIG. 6 illustrates a block segmentation in the organic EL display apparatus of a first modification of the first embodiment of the present invention.

Two modifications of the organic EL display apparatus 1 of the first embodiment are described below. The organic EL display apparatus of a first modification switches segmentation methods from frame period to frame period. The scanning lines G1 through Gn and the light-emission control lines E1 through En in the organic EL display apparatus of the first modification are segmented into p blocks during an N-th frame period in a method of FIG. 4, and are segmented into (p+1) blocks during an (N+1)-th frame period in a method of FIG. 6. In the segmentation method of FIG. 6, a first block includes scanning lines G1 through Gq/2 and light-emission control lines E1 through Eq/2. A second block includes scanning lines Gq/2+1 through G3q/2, and light-emission control lines Eq/2+1 through E3q/2. A (p+1)-th block includes scanning lines Gn-q/2+1 through Gn, and light-emission control lines En-q/2+1 through En. The organic EL display apparatus of the first modification alternates between the frame period of the block segmentation of FIG. 4 and the frame period of the block segmentation of FIG. 6.

If the same block segmentation is used with the mean values of the threshold voltages of the driving transistors T1 different from block to block, a luminance border caused by a difference between the mean values of the blocks may appear on a display screen. The organic EL display apparatus of the first modification switches the block segmentation methods from frame period to frame period, thereby making the display screen free from the luminance border.

The organic EL display apparatus of the first modification may switchably use three or more segmentation methods. The organic EL display apparatus of the first modification may switch segmentation methods every multiple frame periods. The organic EL display apparatus of the first modification may perform block segmentation methods other than the block segmentation methods of FIG. 4 and FIG. 6.

Figure 7:
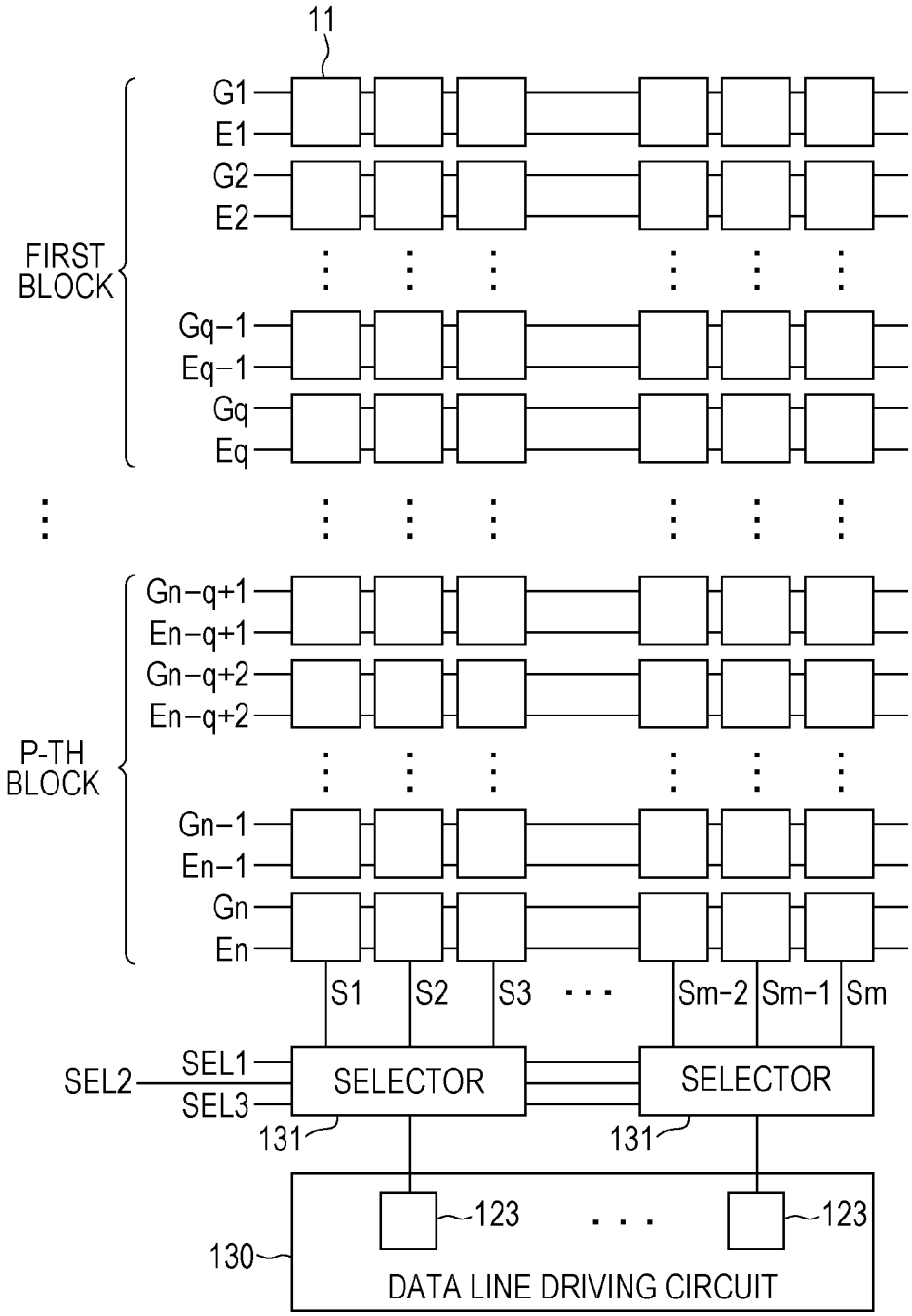
FIG. 7 illustrates a connection configuration between a data line driving circuit and data lines in the organic EL display apparatus of a second modification of the first embodiment of the present invention.

FIG. 7 illustrate a connection configuration between a data line driving circuit and data lines in the organic EL display apparatus of a second modification. The organic EL display apparatus of the second modification includes a data line driving circuit 130 of FIG. 7. The data line driving circuit 130 includes (m/x) detection/correction output circuit 123 corresponding to m data lines. The organic EL display apparatus of the second modification includes (m/x) selectors 131. Note that x is an integer equal to or higher than 2 but lower than m. In the discussion that follows, x=3.

The detection/correction output circuit 123 is connected to three data lines via the selectors 131. The selectors 131 operate in response to selection control signals SEL1 through SEL3 output from the display control circuit (not illustrated). When the selection control signal SEL1 is at a high level, the detection/correction output circuit 123 is electrically connected to a first data line. When the selection control signal SEL2 is at a high level, the detection/correction output circuit 123 is electrically connected to a second data line. When the selection control signal SEL3 is at a high level, the detection/correction output circuit 123 is electrically connected to a third data line.

Figure 8:
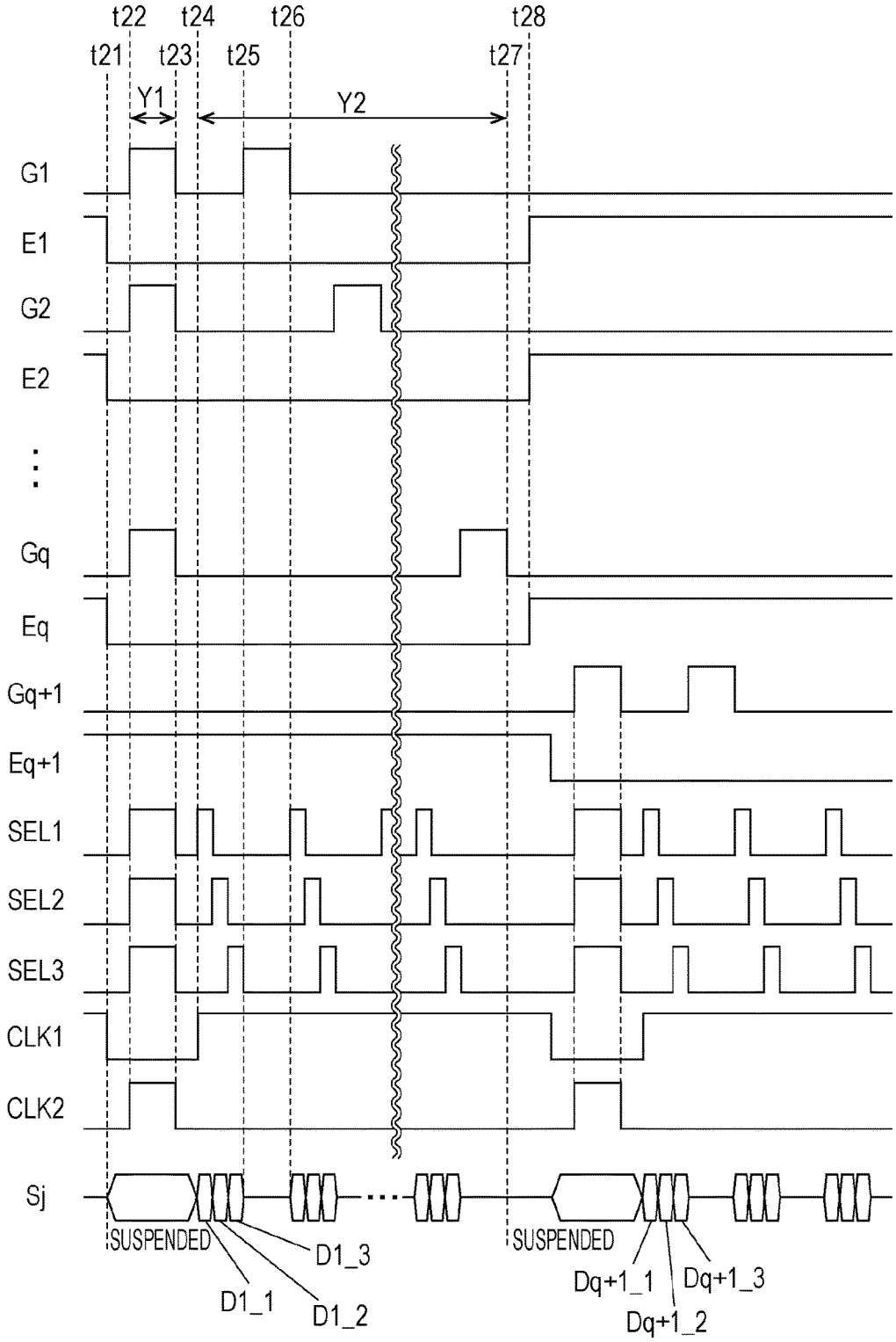
FIG. 8 is a timing diagram illustrating the shifting of signals in the organic EL display apparatus of the second modification of the first embodiment of the present invention.

FIG. 8 is a timing diagram illustrating the shifting of signals in the organic EL display apparatus of the second modification. Referring to FIG. 8, a time duration from time t22 to time t27 is a selection period of a first block, a time duration from time t22 to time t23 is a common selection period Y1, and a time duration from time t24 to time t27 is a scanning period Y2.

During the common selection period Y1, the selection control signals SEL1 through SEL3 stay at a high level. For this reason, during the common selection period Y1, the process the organic EL display apparatus 1 of the first embodiment during the common selection period X1 (the process to the q pixel circuits at one column) is performed on 3*q* pixel circuits 11 arranged at three columns. The capacitor 32 is thus charged with a voltage responsive to the threshold voltages of the driving transistors in the 3*q* pixel circuits 11.

During a time duration from time t24 through time t25, the selection control signals SEL1 through SEL3 are successively shifted to a high level. When the selection control signal SEL1 is at a high level, the detection/correction output circuit 123 is connected to the data line S1, and the data line S1 is charged with a corrected data voltage D1_1. When the selection control signal SEL2 is at a high level, the detection/correction output circuit 123 is connected to the data line S2, and the data line S2 is charged with a corrected data voltage D1_2. When the selection control signal SEL3 is at a high level, the detection/correction output circuit 123 is connected to the data line S3, and the data line S3 is charged with a corrected data voltage D1_3.

In the organic EL display apparatus of the second modification, the circuit scale of the data line driving circuit 130 is reduced by associating the detection/correction output circuit 123 with multiple data lines.

(Second Embodiment)

An organic EL display apparatus of a second embodiment is similar in configuration to the organic EL display apparatus of the first embodiment (FIG. 1). The second embodiment is different from the first embodiment in the configuration of the detection/correction output circuit in the data line driving circuit 120. In each of the embodiments to be described, elements identical to those described above with reference to the first embodiment are designated with the same reference numerals and the discussion thereof is omitted herein.

Figure 9:
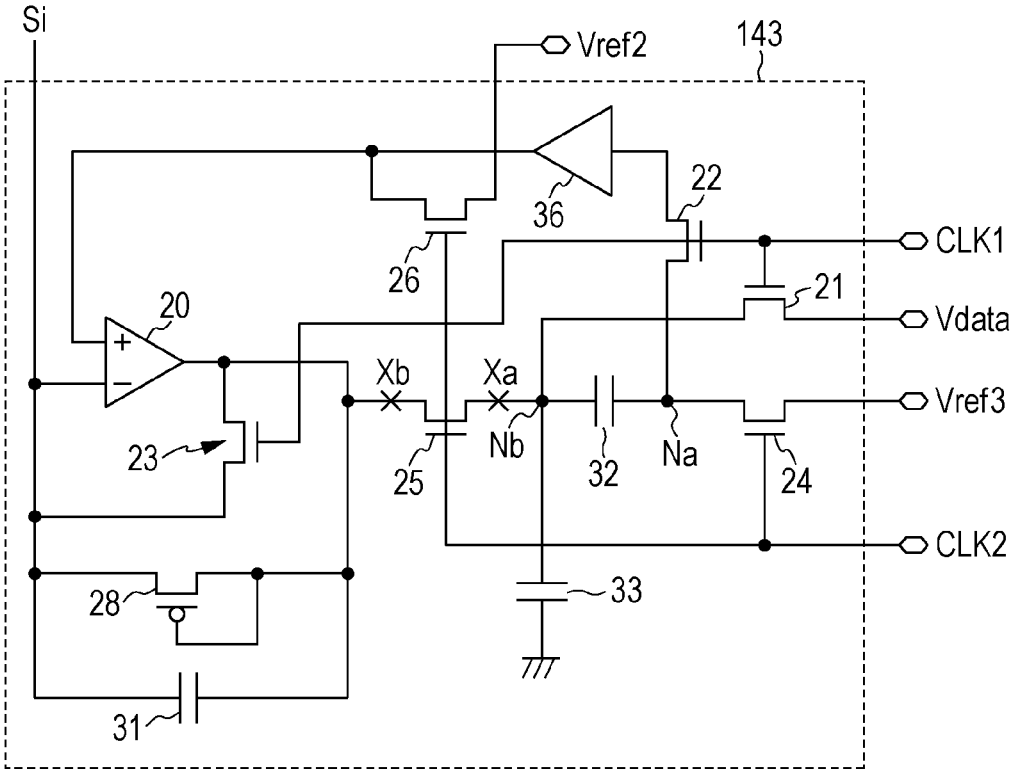
FIG. 9 is a circuit diagram of the detection/correction output circuit included in an organic EL display apparatus of a second embodiment of the present invention.

FIG. 9 is a circuit diagram of the detection/correction output circuit included in the data line driving circuit of the organic EL display apparatus of the present embodiment. FIG. 9 illustrates a detection/correction output circuit 143 corresponding to the data line Si. The detection/correction output circuit 143 includes an operational amplifier 20, seven transistors 21 through 26, and 28, and three capacitors 31 through 33, and a non-inverting amplifier circuit 36. The detection/correction output circuit 143 includes the non-inverting amplifier circuit 36 in place of the amplifier circuit formed of the resistance elements 34 and 35.

In the detection/correction output circuit 143, the gate terminal and the other conducting terminal of the transistor 28 are connected to the output terminal of the operational amplifier 20. The non-inverting amplifier circuit 36 is connected between the other conducting terminal of the transistor 22 and the non-inverting terminal of the operational amplifier 20. More specifically, the input terminal of the non-inverting amplifier circuit 36 is connected to the other conducting terminal of the transistor 22 and the output terminal of the non-inverting amplifier circuit 36 is connected to the non-inverting terminal of the operational amplifier 20. The non-inverting amplifier circuit 36 amplifies a voltage at the node Na. The gain $\alpha$ of the non-inverting amplifier circuit 36 is equal to the gain (R1+R2)/R1 of the amplifier circuit formed of the resistance elements 34 and 35. The amplified voltage is applied to the data line Si through the operation of the operational amplifier 20.

In the organic EL display apparatus 1 of the first embodiment, the amplifier circuit formed of the resistance elements 34 and 35 amplifies the voltage Vc obtained by the transistor 28, and the capacitor 32 stores a voltage responsive to the output voltage of the amplifier circuit. In the organic EL display apparatus of the present embodiment, the capacitor 32 stores a voltage responsive to the voltage Vc obtained by the transistor 28 and the non-inverting amplifier circuit 36 amplifies a voltage responsive to the voltage stored on the capacitor 32. Regardless of whether the voltage is stored after being amplified in the first embodiment or the voltage is amplified after being stored in the second embodiment, the coefficient of the threshold voltage Vtha stored in the capacitor C1 in the pixel circuit 11 remains unchanged. As in the organic EL display apparatus 1 of the first embodiment, in the organic EL display apparatus of the present embodiment, the threshold voltage compensation of the driving transistor T1 is performed at a higher precision level without increasing the size of the current detecting circuit (the transistor 28).

In the organic EL display apparatus of the present embodiment as described above, the data line driving circuit 120 includes the compensation capacitance element (the capacitor 32) storing a voltage responsive to the first voltage Vc (Vref3−Vc), and an amplifier (the non-inverting amplifier circuit 36) that amplifies a voltage responsive to the voltage stored in the compensation capacitance element. The data line driving circuit 120 applies a second voltage responsive to the data voltage Vdata and the threshold voltage Vth of the driving transistor T1 between the control terminal and the first conducting terminal of the driving transistor T1 using a voltage $\{\alpha\times(Vdata-Vc+Vref3)\}$ output from the amplifier. The second voltage is based on a voltage $\alpha\times Vc$ resulting from amplifying the first voltage Vc.

In the organic EL display apparatus of the present embodiment, the voltage needed to perform the threshold voltage compensation of the driving transistor T1 is determined based on the output voltage of the amplifier unit. Even if there is a difference between the gain of the driving transistor T1 and the gain of the current detecting circuit (the transistor 28), the threshold voltage compensation of the driving transistor is performed at a higher precision level by amplifying the first voltage responsive to the amount of driving current without increasing the size of the current detecting circuit.

The detection/correction output circuit 143 of FIG. 9 includes the non-inverting amplifier circuit 36 arranged at a back stage subsequent to the capacitor 32. Alternatively, the non-inverting amplifier circuit 36 may be arranged at a front stage in front of the capacitor 32. For example, the non-inverting amplifier circuit 36 may be connected between the node Nb and one conducting terminal of the transistor 25 (at a point designated Xa in FIG. 9), or may be connected between the other conducting terminal of the transistor 25 and the output terminal of the operational amplifier 20 (at a point designated Xb in FIG. 9). The organic EL display apparatuses of these modifications provide the same advantageous effect as that of the organic EL display apparatuses 1 and 2.

(Third Embodiment)

Figure 10:
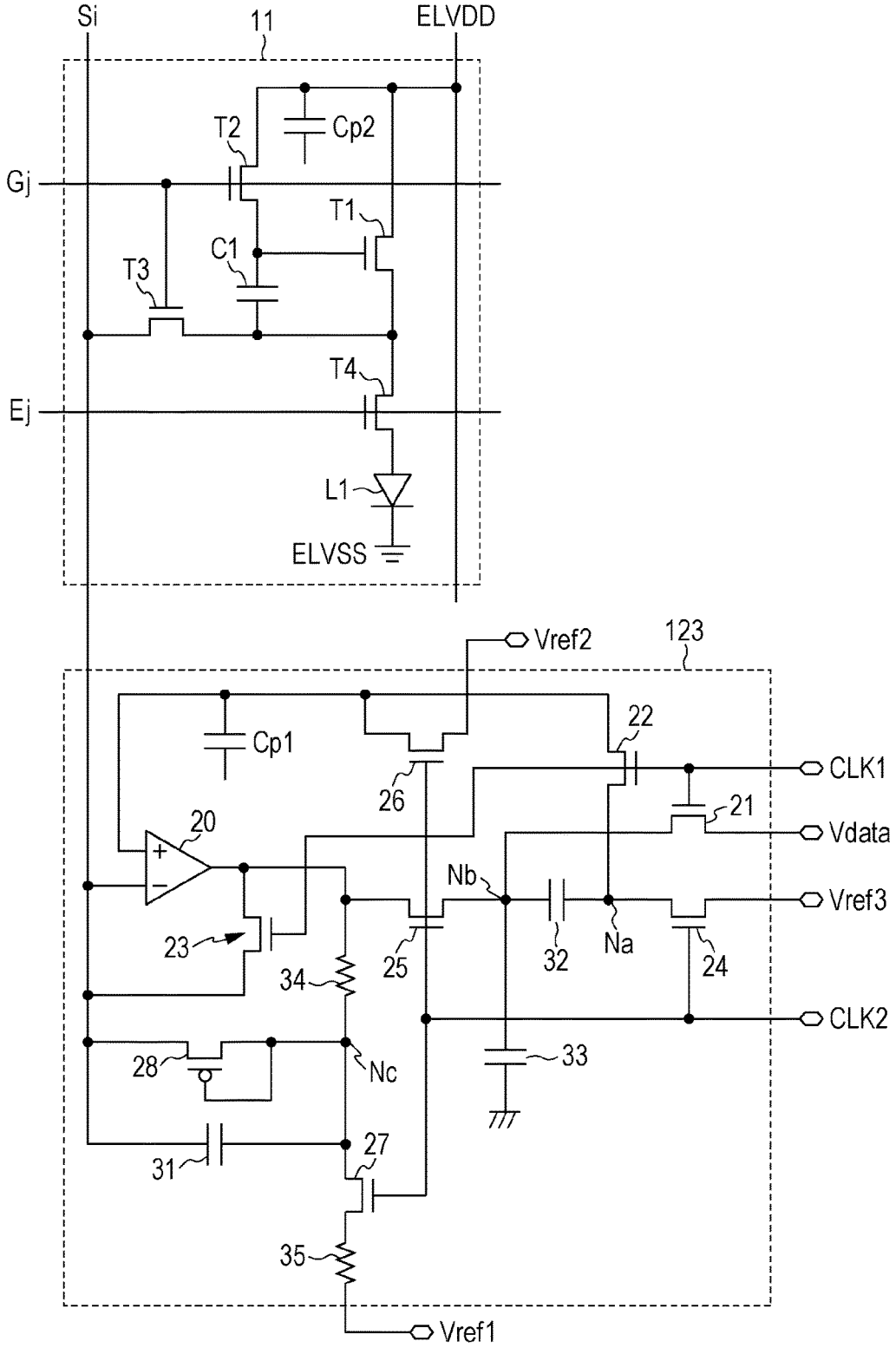
FIG. 10 illustrates an example of a parasitic capacitance created in the organic EL display apparatus.

A third embodiment is related to an organic EL display apparatus that includes an amplifier circuit with an increased gain in view of parasitic capacitance. In an actual organic EL display apparatus, a signal is attenuated by the parasitic capacitance of the signal line. FIG. 10 illustrates an example of the parasitic capacitances of the signal lines of the pixel circuit 11 and the detection/correction output circuit 123 of FIG. 3. FIG. 10 illustrates the parasitic capacitance Cp1 of the non-inverting input terminal of the operational amplifier 20, and the parasitic capacitance Cp2 created in the pixel circuit 11. The parasitic capacitance Cp1 attenuates the voltage stored on the capacitor 32, and the parasitic capacitance Cp2 attenuates the voltage stored on the capacitor C1. In the actual organic EL display apparatus, the parasitic capacitances Cp1 and Cp2 are created, reducing the effect of the threshold voltage compensation.

In the organic EL display apparatus of the third embodiment of the present invention, the gain of the amplifier circuit formed of the resistance elements 34 and 35 (or the non-inverting amplifier circuit 36) is set to be higher than a value that is determined without accounting for the parasitic capacitances. The amplifier circuit thus amplifies the voltage obtained by the transistor 28 more than when the parasitic capacitances are not accounted for. If the effect of the threshold voltage compensation is reduced by the parasitic capacitance, the organic EL display apparatus of the third embodiment compensates for a reduction in the effect, and performs the threshold voltage compensation of the driving transistor T1 at a higher precision level.

Figure 11:
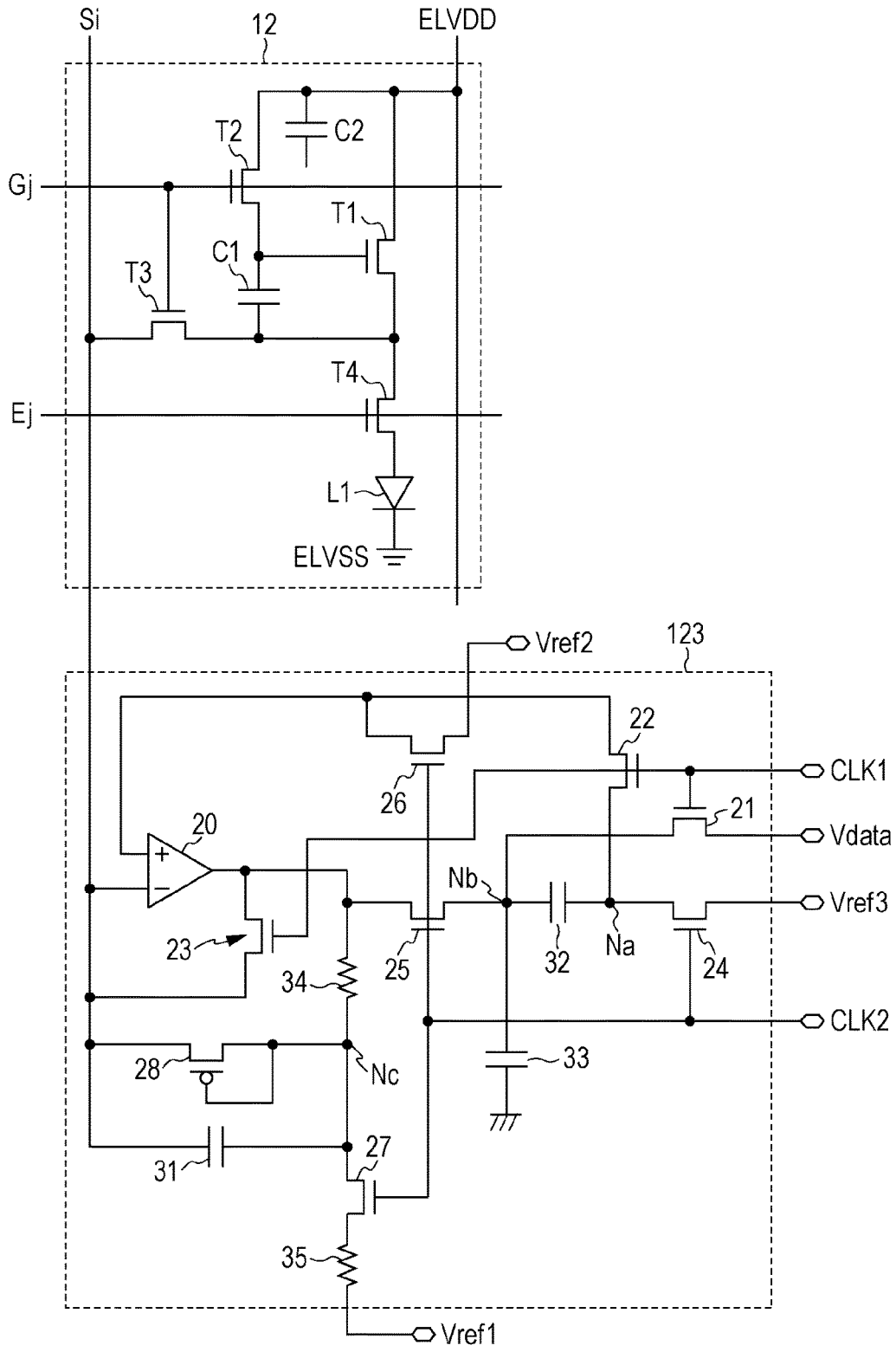
FIG. 11 is a circuit diagram of a pixel circuit and a detection/correction output circuit included in an organic EL display apparatus of a modification of a third embodiment of the present invention.

The organic EL display apparatus of the third embodiment may be modified as described below. FIG. 11 is a circuit diagram of a pixel circuit and a detection/correction output circuit included in the organic EL display apparatus of a modification of the third embodiment of the present invention. The pixel circuit 12 of FIG. 11 is the pixel circuit 11 of the first embodiment with a capacitor C2 added thereto.

Current driving (conductance) of the transistor T1 is determined by a manufacturing process and a W/L ratio. If current driving capacity is high, a small light-emission current needs to be controlled using a small voltage amplitude. In such a case, an innegligible offset occurs in the output of the data line driving circuit. The offset may be recognized as a stripe pattern on the screen.

To solve this problem, the pixel circuit 12 includes the capacitor C2. Let C1 and C2 respectively represent capacitances of the capacitors C1 and C2, and the use of the capacitor C2 attenuates a voltage applied to the transistor T1 by C1/(C1+C2). The organic EL display apparatus of the modification with the pixel circuit 12 including the capacitor C2 solves the display nonuniformity caused by variations in the output offset of the data line driving circuit.

(Fourth Embodiment)

Figure 12:
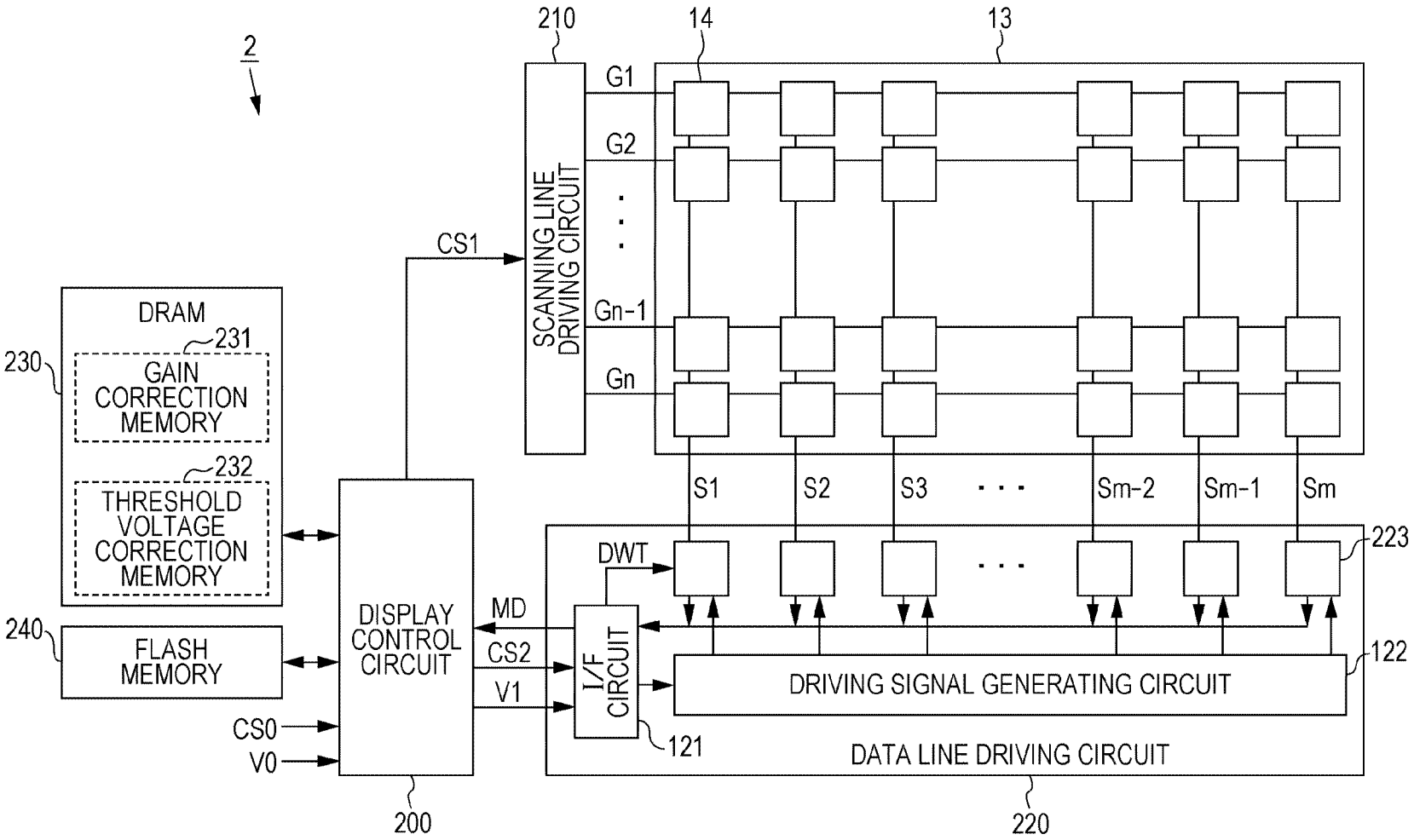
FIG. 12 is a block diagram illustrating a configuration of an organic EL display apparatus of a fourth embodiment of the present invention.

FIG. 12 is a block diagram illustrating a configuration of an organic EL display apparatus of a fourth embodiment of the present invention. The organic EL display apparatus 2 of FIG. 12 includes a display unit 13, a display control circuit 200, a scanning line driving circuit 210, a data line driving circuit 220, a DRAM 230, and a flash memory 240.

The display unit 13 includes n scanning lines G1 through Gn, m data lines S1 through Sm, and (m×n) pixel circuits 14. The display unit 13 receives a reference voltage Vref, in addition to the high-level power source voltage ELVDD and the low-level power source voltage ELVSS, from a power source circuit (not illustrated). The display unit 13 includes reference voltage lines (not illustrated) to supply the reference voltage Vref to the pixel circuits 14.

The display control circuit 200 controls the scanning line driving circuit 210 and the data line driving circuit 220 while receiving measurement data MD (described in detail below) from the data line driving circuit 220. The scanning line driving circuit 210 drives the scanning lines G1 through Gn and the data line driving circuit 220 drives the data lines S1 through Sm. The data line driving circuit 220 includes an interface circuit 121, a driving signal generating circuit 122, and m voltage output and current measurement circuits 223. In response to a control signal CS2, the data line driving circuit 220 applies to the data lines S1 through Sm a data voltage responsive to video data V1.

The organic EL display apparatus 2 determines the video data V1 by performing a correction operation on the video data V0. The DRAM 230 saves two types of correction data (gain correction data and threshold voltage correction data) configured to correct the video data V0 for each pixel circuit 14. The display control circuit 200 determines the video data V1 by correcting the video data V0 using the correction data saved on the DRAM 230. The display control circuit 200 also updates the correction data saved on the DRAM 230 in accordance with the measurement data MD received from the data line driving circuit 220. At a power-off time, the display control circuit 200 reads the correction data from the DRAM 230 and writes the read correction data onto the flash memory 240. At a power-on time, the display control circuit 200 reads the correction data saved on the flash memory 240 and then writes the read correction data onto the DRAM 230. Optionally, the DRAM 230 and the flash memory 240 may be included in the display control circuit 200.

Figure 13:
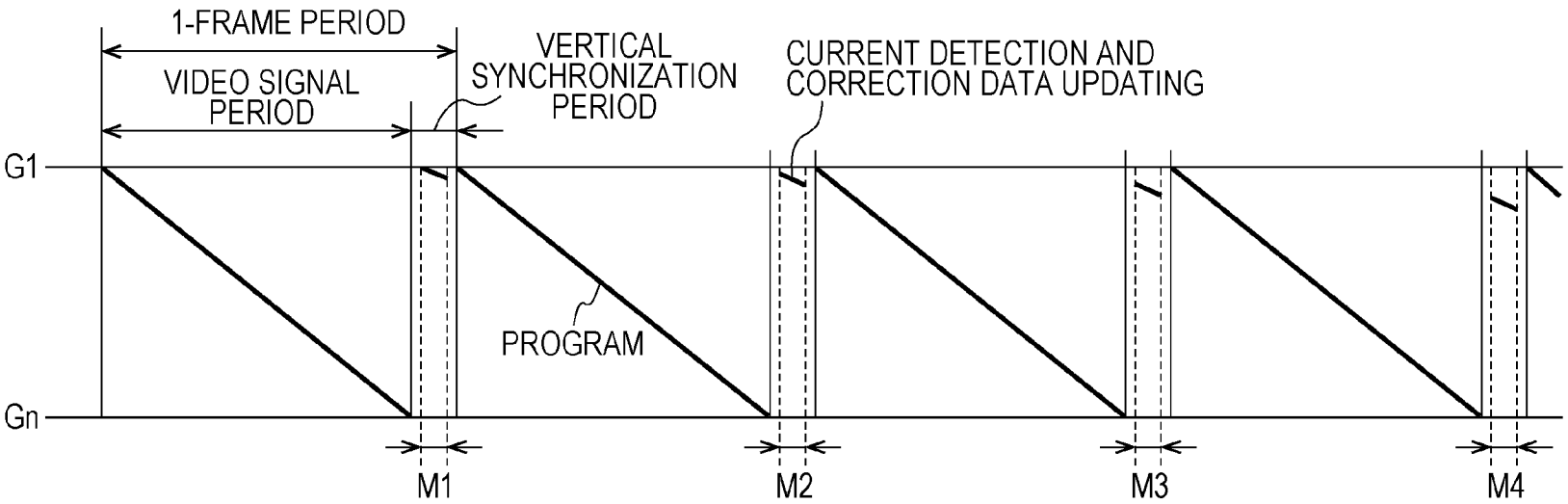
FIG. 13 is a timing diagram illustrating an operation of the organic EL display apparatus of FIG. 12.

FIG. 13 is a timing diagram illustrating an operation of the organic EL display apparatus 2. In the organic EL display apparatus 2, one frame period is segmented into a video signal period and a vertical synchronization period. During the video signal period, the scanning lines G1 through Gn are successively selected one by one during one horizontal period (1H period). During each horizontal period, m data voltages responsive to the video data V1 are respectively written on m pixel circuits 14 (this operation is labeled "program" in FIG. 13). During the vertical synchronization period, k scanning lines are successively selected from the scanning lines G1 through Gn (k is an integer equal to or above 1 but less than n). The driving currents having flowed from m pixel circuits 14 connected to the selected scanning lines and having passed through the driving transistors are respectively output to the data lines S1 through Sm. The data line driving circuit 220 has a function of detecting m driving currents output to the data lines S1 through Sm. The display control circuit 200 updates the correction data saved on the DRAM 230 based on the detection results of the data line driving circuit 220 (this operation is labeled "current detection and correction data updating" as illustrated in FIG. 13).

The k scanning lines selected during the vertical synchronization period are switched every frame period. For example, if scanning lines G1 through Gk are selected during the vertical synchronization period (M1 of FIG. 13) during an N-th frame period, scanning lines Gk+1 through G2*k* are selected during the vertical synchronization period (M2 of FIG. 13) during an (N+1)-th frame period, and scanning lines G2*k*+1 through G3*k* are selected during the vertical synchronization period (M3 of FIG. 13) during an (N+2)-th frame period. During each frame period, driving currents output from the (m×k) pixel circuits 14 connected to the k selected scanning lines are detected.

Figure 14:
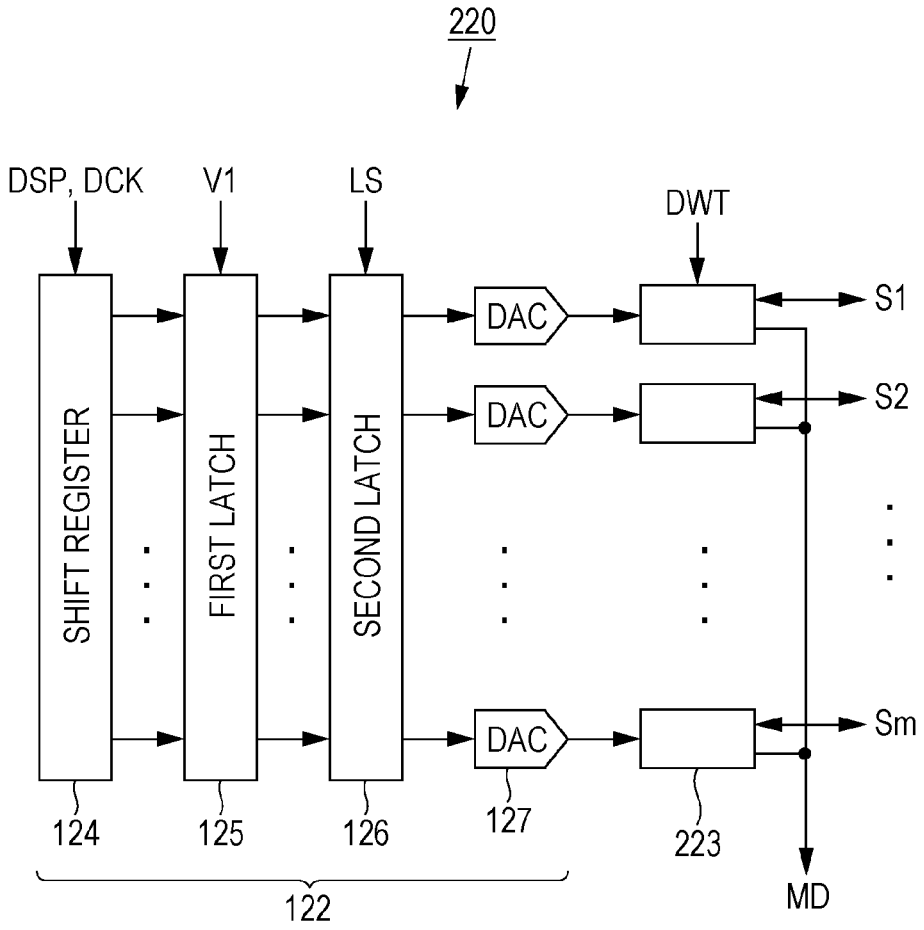
FIG. 14 is a block diagram illustrating in detail a data line driving circuit of FIG. 12.

FIG. 14 is a block diagram illustrating in detail the data line driving circuit 220. The data line driving circuit 220 includes an interface circuit 121 (not illustrated), a driving signal generating circuit 122, and m voltage output and current measurement circuits 223. The data line driving circuit 220 drives the data lines S1 through Sm while detecting driving currents having flowed from the pixel circuit 11 to the data lines S1 through Sm.

Figure 15:
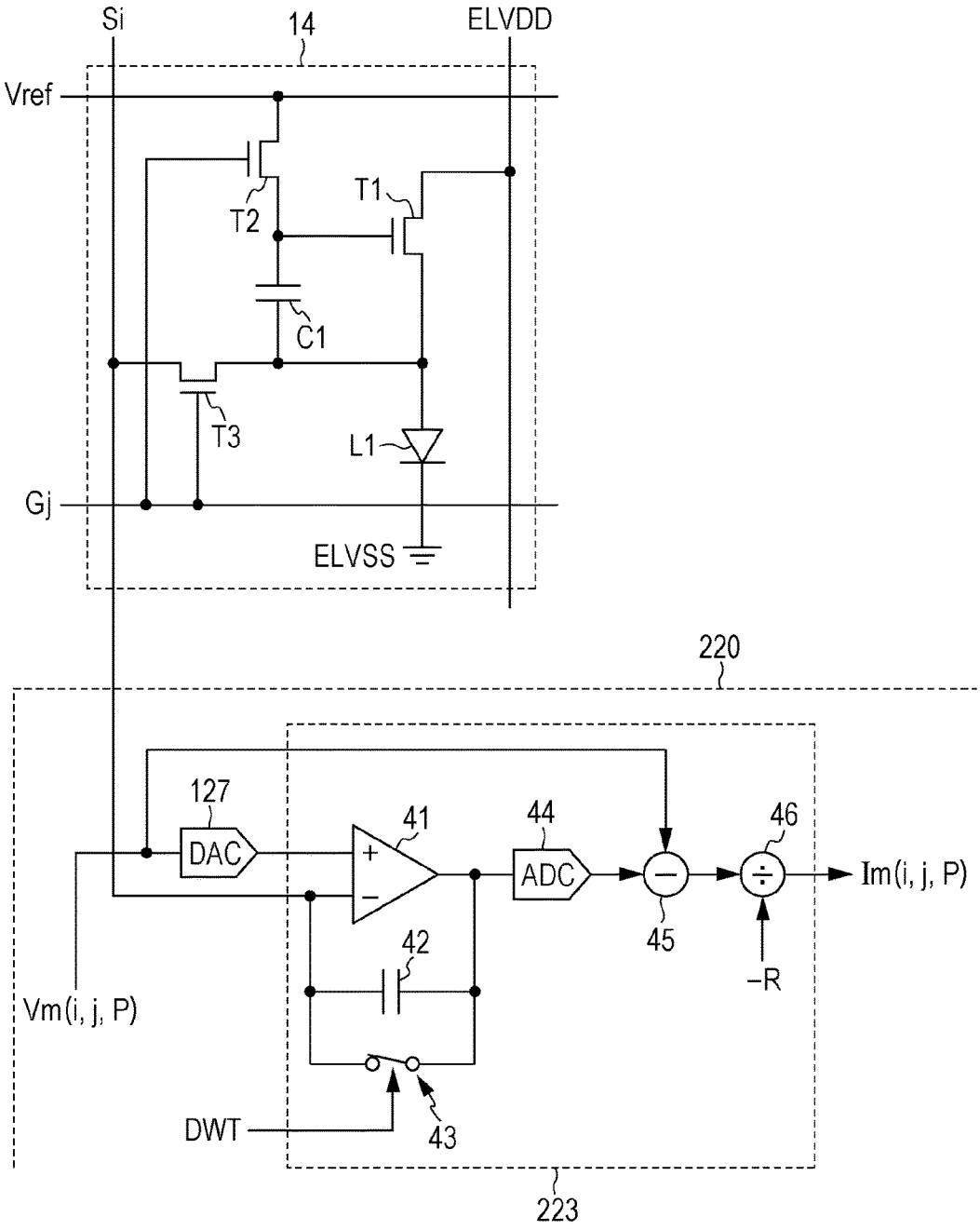
FIG. 15 is a circuit diagram of a pixel circuit and a voltage output and current measurement circuit included in the organic EL display apparatus of FIG. 12.

FIG. 15 is a circuit diagram of the pixel circuit 14 and the voltage output and current measurement circuit 223. FIG. 15 illustrates pixel circuits PX(i,j), a D/A converter 127 corresponding to the data line Si, and a voltage output and current measurement circuit 223 corresponding to the data line Si.

The pixel circuit 14 includes an organic EL element L1, three transistors T1 through T3, and a capacitor C1. The pixel circuit 14 is similar in configuration to the pixel circuit 11 of the first embodiment, but different in the following points. The pixel circuit 14 does not include the transistor T4. The source terminal of the transistor T1 is connected to the anode terminal of the organic EL element L1. The transistor T2 is connected between the high-level power source line supplying the high-level power source voltage ELVDD and the gate terminal of the transistor T1.

The voltage output and current measurement circuit 223 includes an operational amplifier 41, a capacitor 42, a switch 43, an A/D converter 44, a subtracter 45, and a divider 46. The inverting input terminal of the operational amplifier 41 is connected to the data line Si while the non-inverting input terminal of the operational amplifier 41 is connected to the output terminal of the D/A converter 127. A data voltage responsive to the video data V1 is applied to the non-inverting input terminal of the operational amplifier 41. The capacitor 42 is connected between the inverting input terminal and the output terminal of the operational amplifier 41. The switch 43 is connected in parallel with the capacitor 42 between the inverting input terminal and the output terminal of the operational amplifier 41. A transimpedance circuit formed of the operational amplifier 41 and the capacitor 42 works as a current detecting circuit, and the switch 43 works as a function selection switch.

When an input and output control signal DWT is at a high level, the switch 43 is turned on, causing the inverting input terminal to be shorted to the output terminal in the operational amplifier 41. The operational amplifier 41 then works as a buffer amplifier, thereby applying the data voltage output from the D/A converter 127 to the data line Si at a low output impedance. Control operation is desirably performed such that the data voltage is not input to the D/A converter 127 using the input and output control signal DWT.

When the input and output control signal DWT is at a low level, the switch 43 is turned off, and the inverting input terminal is connected to the output terminal in the operational amplifier 41 through the capacitor 42. The operational amplifier 41 and the capacitor 42 then work as an integrating amplifier. Let Vm(i,j,P) represent the data voltage applied to the non-inverting input terminal of the operational amplifier 41, and the voltage at the inverting input terminal of the operational amplifier 41 is also Vm(i,j,P) through virtual short. Let Im(i,j,P) represent the driving current flowing from the pixel circuit PX(i,j) to the data line Si, and the output voltage of the operational amplifier 41 is {Vm(i,j,P)−R×Im(i,j,P)}. If Tm represents the length of the period throughout which the input and output control signal DWT remains at a low level, and Cm represents the capacitance of the capacitor 42, R=Tm/Cm holds.

The A/D converter 44, the subtracter 45, and the divider 46 work as a current calculating unit that calculates an amount of current flowing through the data line Si based on the output voltage of the operational amplifier 41. The A/D converter 44 converts the output voltage of the operational amplifier 41 into a digital value. The subtracter 45 subtracts the video data (in digital value) input to the D/A converter 127 from the digital value output from the A/D converter 44. The divider 46 divides the output of the subtracter 45 by (−R). The output of the subtracter 45 is {−R×Im(i,j,P), and the output of the divider 46 is Im(i,j,P).

The voltage output and current measurement circuit 223 measures the driving current flowing through the data line Si, and outputs the measurement data MD representing the amount of driving current. The voltage output and current measurement circuit 223 may include a resistance element as a current detecting circuit. In this case, R is the resistance of the resistance element.

The video data V1 responsive to the data voltage Vm(i,j,P) may also be represented by Vm(i,j,P), and the measurement data MD representing the value of the driving current Im(i,j,P) may also be represented by Im(i,j,P).

Figure 16:
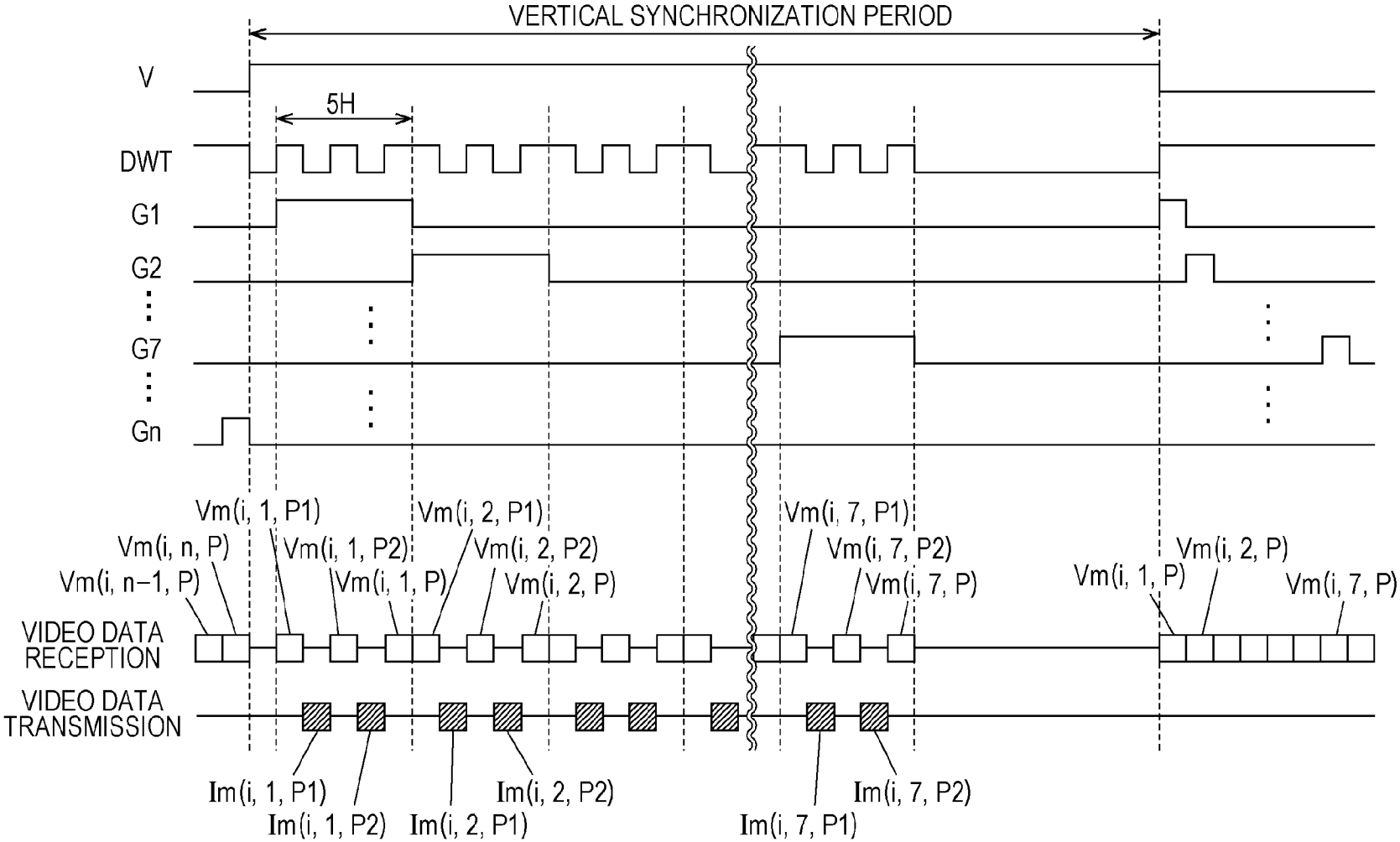
FIG. 16 is a timing diagram illustrating the shifting of signals in the organic EL display apparatus of FIG. 12 during one frame period.

FIG. 16 is a timing diagram illustrating the shifting of signals in the organic EL display apparatus 2 during one frame period. In the discussion that follows, it is assumed that k=7, in other words, seven scanning lines are selected during one vertical synchronization period. As illustrated in FIG. 16, a period type dependent signal V is at a low level during the video signal period, and at a high level during the vertical synchronization period.

Figure 17:
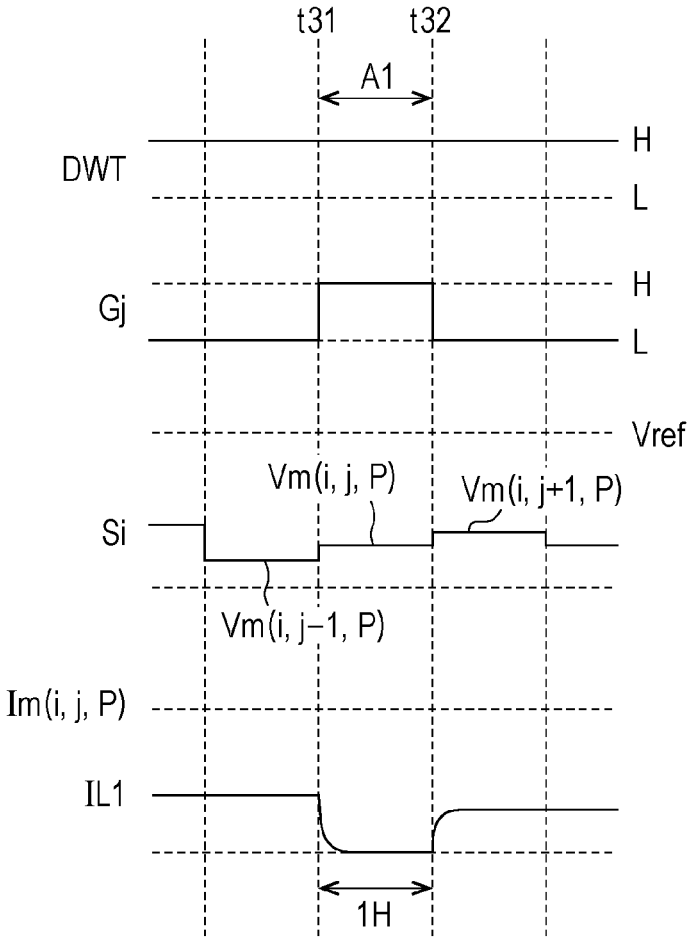
FIG. 17 is a timing diagram illustrating the shifting of signals in the organic EL display apparatus of FIG. 12 during a video signal period.

FIG. 17 is a timing diagram illustrating the shifting of signals in the organic EL display apparatus 2 during the video signal period. As illustrated in FIG. 17, the input and output control signal DWT continuously remains at a high level. During a time duration from time t31 to time t32 (hereinafter referred to as a program period A1), a writing operation is performed to write the data voltage Vm(i,j,P) on the pixel circuit PX(i,j). Note that the data voltage Vm(i,j,P) is obtained by performing the threshold voltage compensation and gain compensation of the driving transistor T1 in the pixel circuit PX(i,j) onto a voltage responsive to a gradation value P.

The scanning signal Gj is at a low level prior to time t31. The transistors T2 and T3 are then off, and a driving current responsive to the voltage stored on the capacitor C1 flows through the transistor T1 and the organic EL element L1. The organic EL element L1 emits light at a luminance level responsive to the driving current.

Figure 18:
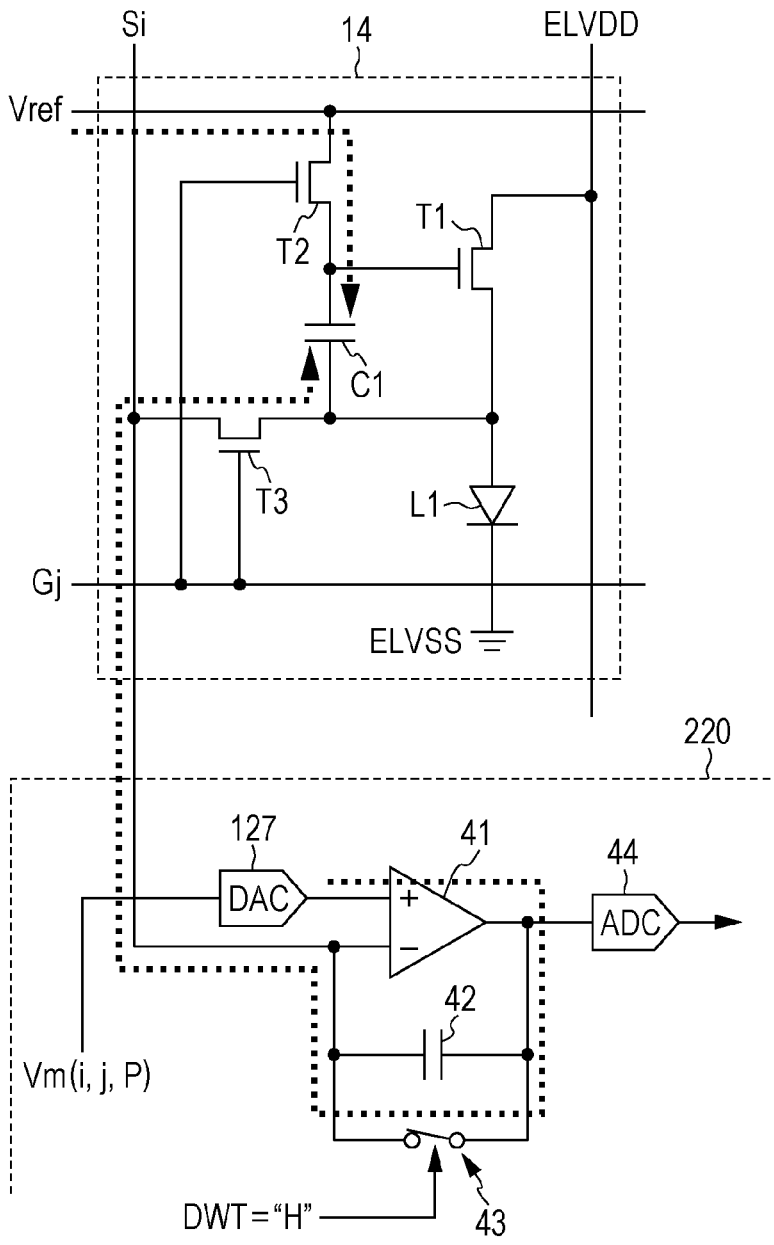
FIG. 18 illustrates a flow of currents in the organic EL display apparatus of FIG. 12 during a program period.

At time t31, the scanning signal Gj shifts to a high level. In response, the transistors T2 and T3 are turned on. During the program period A1, the data voltage Vm(i,j,P) is applied to the data line Si through the operation of the operational amplifier 41. Referring to FIG. 18, one lead (lower terminal) of the capacitor C1 is supplied with the data voltage Vm(i, j,P) via the data line Si and the transistor T3, and the other lead (upper terminal) of the capacitor C1 is supplied with the reference voltage Vref via the transistor T2. During the program period A1, the capacitor C1 is charged with the voltage Vgs expressed by the following formula (12).

$$Vgs=V\text{ref}-Vm(i,j,P) \tag{12}$$

Let Vth_L1 represent a light emission threshold voltage of the organic EL element L1, and the data voltage Vm(i,j,P) is determined to satisfy the following formula (13).

$$Vm(i,j,P)<ELVSS+Vth_L1 \tag{13}$$

The light emission of the organic EL element L1 during the program period A1 is suspended by applying the data voltage Vm(i,j,P) satisfying formula (13) to the anode terminal of the organic EL element L1.

Figure 19:
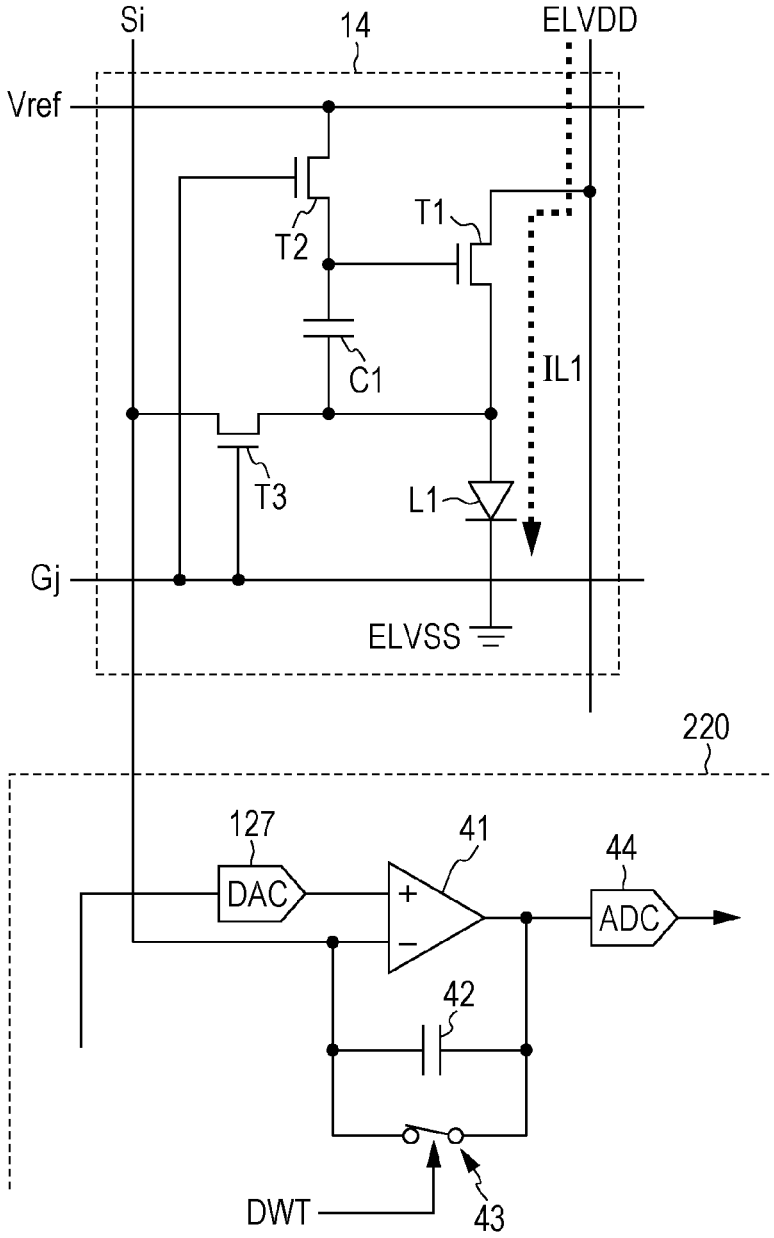
FIG. 19 illustrates a flow of currents in the organic EL display apparatus of FIG. 12 during a light emission period.

At time t32, the scanning signal Gj shifts to a low level. In response, the transistors T2 and T3 are turned off, and the capacitor C1 stores the voltage Vgs expressed by formula (12). At time t32 and thereafter, the source terminal of the transistor T1 is electrically disconnected from the data line Si. At time t32 and thereafter, the driving current IL1 having passed through the transistor T1 flows through the organic EL element L1, and the organic EL element L1 emits light at a luminance level responsive to the driving current IL1 (see FIG. 19). Since the transistor T1 operates in the saturation region thereof, the driving current IL1 is expressed by the following formula (14). The gain β of the transistor T1 included in formula (14) is expressed by the following formula (15).

$$\begin{aligned} IL1 &= (\beta/2)\times(Vgs-Vt)^2 \\ &= (\beta/2)\times\{Vref-Vm(i,j,P)-Vt\}^2 \end{aligned} \tag{14}$$

$$\beta=\mu\times(W/L)\times Cox \tag{15}$$

In formulas (14) and (15), Vt, μ, W, L, and Cox respectively represent the threshold voltage, mobility, gate width, gate length, and gate insulation film capacitance per unit area of the transistor T1.

Figure 20:
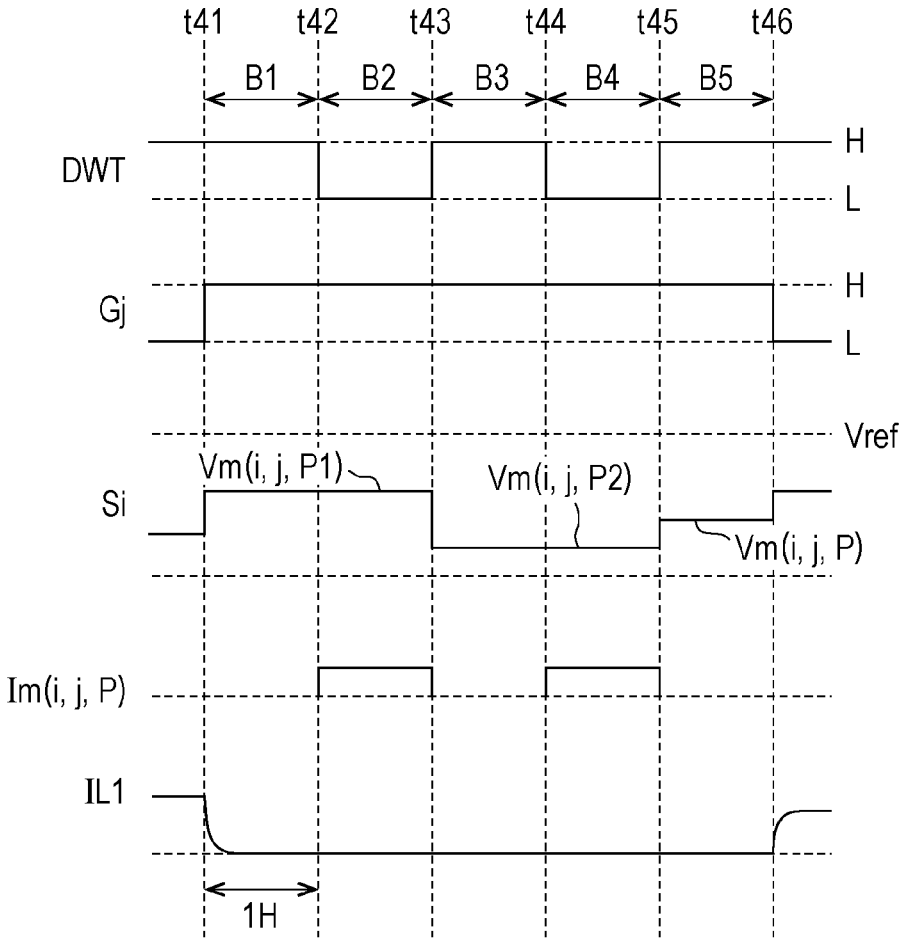
FIG. 20 is a timing diagram illustrating the shifting of signals in the organic EL display apparatus of FIG. 12 during a vertical synchronization period.

FIG. 20 is a timing diagram illustrating the shifting of signals in the organic EL display apparatus 2 during the vertical synchronization period. The operation of the pixel circuit PX(i,j) is described below. Referring to FIG. 20, the scanning signal Gj remains high during five consecutive horizontal periods, and the following operations are performed during each horizontal period. During the time duration from time t41 through time t42 (hereinafter referred to as a first program period B1), a writing operation is performed to write the data voltage responsive to a first gradation value P1. During the time duration from time t42 through time t43 (hereinafter referred to as a first measurement period B2), an operation is performed to measure the driving current. During the time duration from time t43 through time t44 (hereinafter referred to as a second program period B3), a writing operation is performed to write the data voltage responsive to a second gradation value P2. During the time duration from time t44 through time t45 (hereinafter referred to as a second measurement period B4), an operation is performed to measure the driving current. During the time duration from time t45 through time t46 (hereinafter referred to as a third program period B5), a writing operation is performed to write a data voltage Vm(i,j,P) responsive to a gradation value P.

The first gradation value P1 and the second gradation value P2 are determined to satisfy P1<P2 within a range of gradation values the video data V0 may take. For example, if the range of the gradation values the video data V0 may take is from 0 to 255, the first gradation value P1 may be determined to be 80, and the second gradation value P2 may be determined to be 160.

In the following discussion, the data voltage responsive to the first gradation value P1 is represented by a first measurement voltage Vm(i,j,P1), the driving current used to write the first measurement voltage Vm(i,j,P1) is represented by a first driving current Im(i,j,P1), the data voltage responsive to the second gradation value P2 is represented by a second measurement voltage Vm(i,j,P2), and the driving current used to write the second measurement voltage Vm(i,j,P2) is represented by a second driving current Im(i, j,P2). The measurement data responsive to the first driving current Im(i,j,P1) is referred to as first measurement data, and is represented by the same symbol, namely, Im(i,j,P1). The measurement data responsive to the second driving current Im(i,j,P2) is referred to as second measurement data, and is represented by the same symbol, namely, Im(i,j,P2).

As illustrated in FIG. 20, the scanning signal Gj remains high during the time duration from time t41 through time t46. The input and output control signal DWT remains high during each of the first through third program periods B1, B3, and B5, and remains low during each of the first and second measurement period B2 and B4. During the first through third program periods B1, B3, and B5, the switch 43 is turned on, and the operational amplifier 41 works as a buffer amplifier. During the first and second measurement periods B2 and B4, the switch 43 is turned off, and the operational amplifier 41 and the capacitor 42 work as an integrating amplifier.

Prior to time t41, the scanning signal Gj remains low. The operation of the pixel circuit PX(i,j) prior to time t41 is identical to the operation thereof prior to time t31 as illustrated in FIG. 17. At time t41, the scanning signal Gj shifts to a high level. In response, the transistors T2 and T3 are turned on. During the first program period B1, the first measurement voltage Vm(i,j,P1) is applied to the non-inverting input terminal of the operational amplifier 41. During the first program period B1, the switch 43 is turned on, and the operational amplifier 41 works as a buffer amplifier. For this reason, during the first program period B1, the first measurement voltage Vm(i,j,P1) is applied to the data line Si. During the first program period B1, the capacitor C1 is charged with the voltage Vgs expressed by the following formula (16).

$$Vgs=V\text{ref}-Vm(i,j,P1) \tag{16}$$

At time t42, the input and output control signal DWT shifts to a low level. In response, the switch 43 is turned off, and the operational amplifier 41 and the capacitor 42 work as an integrating amplifier. During the first measurement period B2, as well, the first measurement voltage Vm(i,j,P1) is applied to the non-inverting input terminal of the operational amplifier 41. For this reason, the voltage at the inverting input terminal of the operational amplifier 41 is Vm(i,j,P1) through virtual short.

Figure 21:
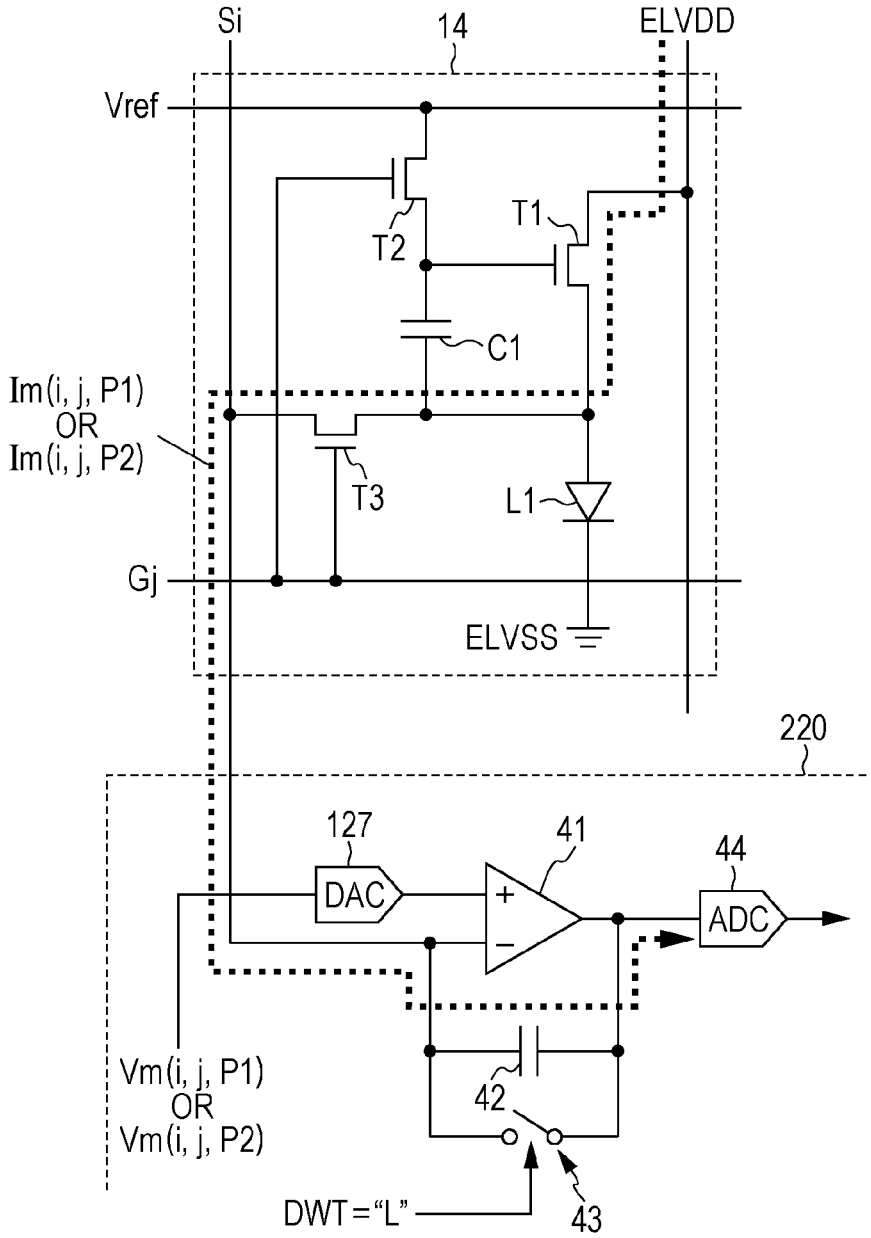
FIG. 21 illustrates a flow of currents in the organic EL display apparatus of FIG. 12 during a measurement period.

A current path through the transistor T3 that is on is formed during the first measurement period B2. Since formula (13) holds with respect to the first gradation value P1, no current flows through the organic EL element L1 during the first measurement period B2. The first driving current Im(i,j,P1) having passed through the transistor T1 flows through the data line Si (see FIG. 21). The voltage output and current measurement circuit 223 measures the first driving current Im(i,j,P1) having flowed from the pixel circuit PX(i,j) to the data line Si, and then outputs the value indicating the first driving current Im(i,j,P1).

The operation of the pixel circuit PX(i,j) and the data line driving circuit 220 during the second program period B3 is identical to that of the pixel circuit PX(i,j) and the data line driving circuit 220 during the first program period B1. The operation of the pixel circuit PX(i,j) and the data line driving circuit 220 during the second measurement period B4 is identical to that of the pixel circuit PX(i,j) and the data line driving circuit 220 during the first measurement period B2. However, note that the second measurement voltage Vm(i,j,P2) is written on the pixel circuit PX(i,j) during the second program period B3 and that the second driving current Im(i,j,P2) is measured and the value indicating the second driving current Im(i,j,P2) is output during the second measurement period B4.

The operation of the pixel circuit PX(i,j) and the data line driving circuit 220 during the third program period B5 is identical to that of the pixel circuit PX(i,j) and the data line driving circuit 220 during the program period A1 (FIG. 17). However, note that the correction data is updated using the first driving current Im(i,j,P1) determined during the first measurement period B2 and the second driving current Im(i,j,P2) determined during the second measurement period B4, and the data voltage Vm(i,j,P) to be written during the third program period B5 is obtained by performing the threshold voltage compensation and gain compensation on the updated correction data. At time t46, the scanning signal Gj shifts to a low level. The operation of the pixel circuit PX(i,j) subsequent to time t46 remains unchanged from the operation of the pixel circuit PX(i,j) subsequent to time t32 of FIG. 17.

During one vertical synchronization period, k scanning lines are successively selected, and the five operations described above (the operations during the periods B1 through B5) are successively performed on the selected scanning lines. In this way, the first driving current Im(i,j,P1) and the second driving current Im(i,j,P2) are determined in the (m×k) pixel circuits 14 connected to the k scanning lines. Therefore, during (n/k) frame periods, the first driving current Im(i,j,P1) and the second driving current Im(i,j,P2) are determined with respect to all pixel circuits 14 included in the display unit 13. If the display unit 13 includes an FHD (Full High Definition) display panel, the total number of scanning lines is 1125, and the number of effective scanning lines is 1080. With k=7, the first driving current Im(i,j,P1) and the second driving current Im(i,j,P2) are determined in all pixel circuits 14 included in the display unit 13 during 155 (=1080/7) frame periods.

Figure 22:
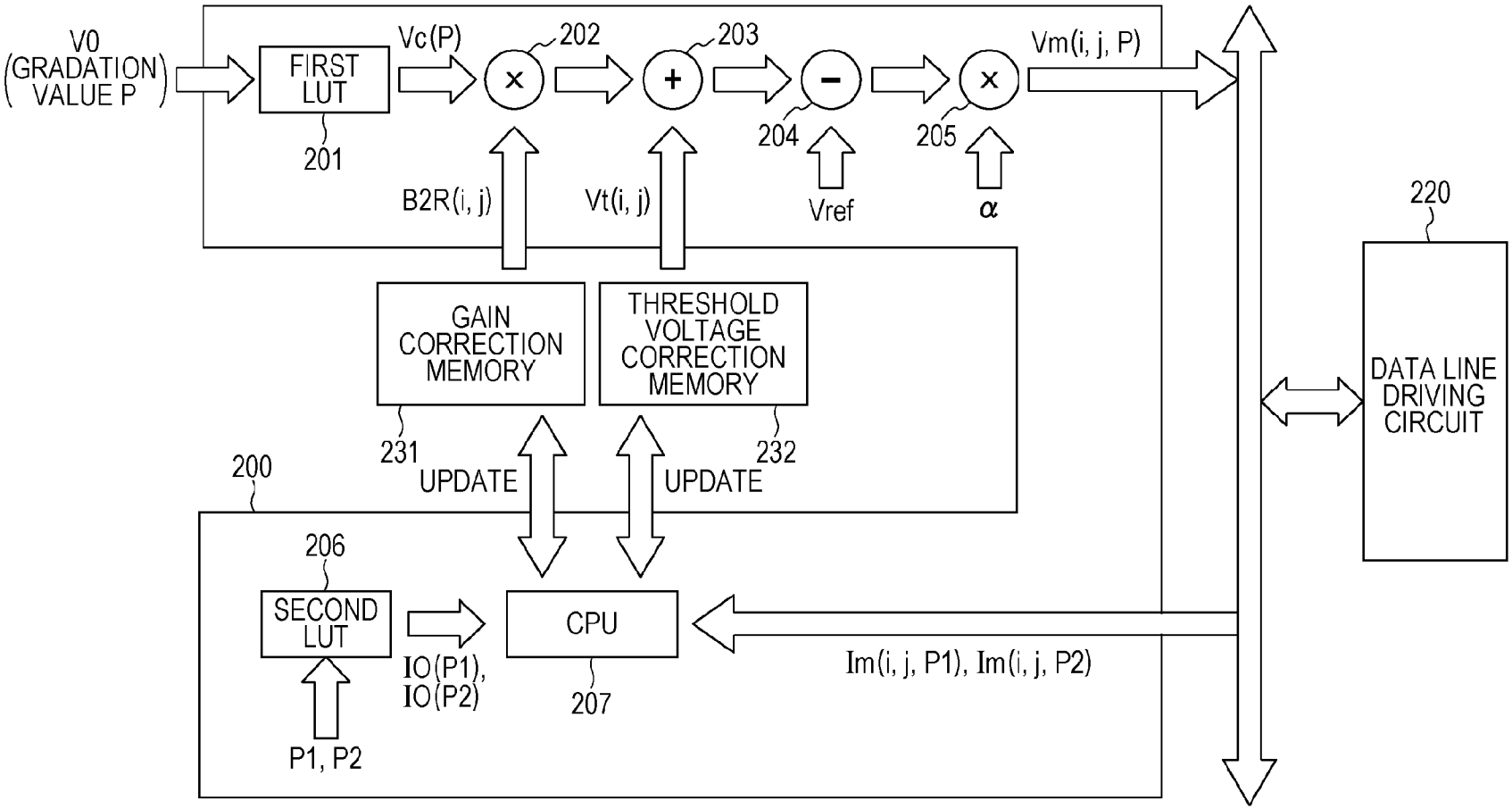
FIG. 22 is a block diagram illustrating a correction operation in the organic EL display apparatus of FIG. 12.

FIG. 22 is a block diagram illustrating the correction operation in the organic EL display apparatus 2. The display control circuit 200 uses a portion of the memory area of the DRAM 230 as a gain correction memory 231, and another portion of the memory of the DRAM 230 as a threshold voltage correction memory 232. The gain correction memory 231 saves data to perform the gain compensation (hereinafter referred to as gain correction data) for the driving transistor in the pixel circuit 14. The threshold voltage correction memory 232 saves data responsive to the threshold voltage (hereinafter referred to as threshold voltage correction data) of the driving transistor in the pixel circuit 14. More in detail, the threshold voltage correction memory 232 saves data indicating a value of the threshold voltage of the driving transistor. As described below, the threshold voltage correction data is determined using a voltage into which the driving current (the current having passed through the driving transistor) is converted. The threshold voltage correction memory 232 works as a memory to save data responsive to the threshold voltage of the driving transistor on each pixel circuit.

Along with the (m×n) pixel circuits 14, the gain correction memory 231 saves (m×n) pieces of gain correction data, and the threshold voltage correction memory 232 saves (m×n) pieces of threshold voltage correction data. Let B2R(i,j) represent the gain correction data corresponding to the pixel circuit PX(i,j) and Vt(i,j) represent the threshold voltage correction data corresponding to the pixel circuit PX(i,j). At the initial state, all pieces of the gain correction data B2R(i,j) are set to be 1, and all pieces of the threshold voltage correction data Vt(i,j) are set to be the same value.

The display control circuit 200 includes a first LUT (Look up Table) 201, multipliers 202 and 205, an adder 203, a subtracter 204, a second LUT 206, and a CPU 207. The CPU 207 may be replaced with a logic circuit.

The first LUT 201 saves the gradation value and the voltage value of the video data V0 in an associated state. When the gradation value of the video data V0 is P, the first LUT 201 outputs a voltage value Vc(P) responsive to the gradation value P. The multiplier 202 multiplies the voltage value Vc(P) output from the first LUT 201 by the gain correction data B2R(i,j) read from the gain correction memory 231. The adder 203 adds the output of the multiplier 202 to the threshold voltage correction data Vt(i,j) read from the threshold voltage correction memory 232. Data indicating the value of the reference voltage Vref is applied to one input terminal of the subtracter 204. The subtracter 204 subtracts the output of the adder 203 from the value of the reference voltage Vref. The multiplier 205 multiplies the output of the subtracter 204 by a constant α (α>1). The output of the multiplier 205 is expressed by the following formula (17).

$$Vm(i,j,P)=\alpha\{Vref-Vc(P)\times B2R(i,j)-Vt(i,j)\} \quad (17)$$

If formula (17) and formula (14) are combined, the following formula (18) results.

$$IL1=(\beta/2)\times\alpha^2\times\{Vc(P)\times B2R(i,j)+Vt(i,j)-Vt\}^2 \quad (18)$$

Both the threshold voltage compensation and the gain compensation are performed on each pixel circuit 14 by varying the gain correction data B2R(i,j) and the threshold voltage correction data Vt(i,j) in response to the state of the transistor T1. The video data Vm(i,j,P) is transmitted to the data line driving circuit 220.

The first LUT 201 performs the following conversion to the gradation value P. Let Iw represent a current flowing through the organic EL element with the organic EL element L1 emitting light at a maximum luminance level, and the gate-source voltage Vgs of the transistor T1 is expressed by the following formula (19).

$$Vgs=Vw+Vth \quad (19)$$

In this case, the first LUT 201 performs a conversion operation expressed by the following formula (20).

$$Vc(P)=Vw\times P^{1.1} \quad (20)$$

If the voltage value Vc(P) of formula (20) is used, the driving current IL1(P) responsive to the gradation value P is expressed by the following formula (21). It is assumed that B2R(i,j)=1, and Vt(i,j)=Vt.

$$IL1(P)=(\beta/2)\times Vw^2\times P^{2.2} \quad (21)$$

The driving current IL1 has characteristics of γ=2.2 with respect to the gradation value P. Since light luminance of the organic EL element L1 is proportional to the driving current IL1, the light luminance of the organic EL element L1 has also characteristics of γ=2.2 with respect to the gradation value P.

In an ideal case that the output current of the transistor T1 is square characteristic with respect to the input voltage, formula (21) holds. But in practice, the output current is outside the square characteristic in a low-current region thereof. Rather than using the conversion formula (20), the first LUT 201 preferably performs a conversion operation expressed by the following formula (22). Formula (22) accounts for a value Vn(P) that varies nonlinearly in response to the gradation value P. In this way, the conversion accuracy of the first LUT 201 is increased.

$$Vc(P)=Vw\times Vn(P) \quad (22)$$

The second LUT 206 converts the first gradation value P1 into first ideal characteristic data IO(P1) expressed by the following formula (23), and converts the second gradation value P2 into second ideal characteristic data IO(P2) expressed by the following formula (24).

$$IO(P1)=Iw\times P1^{2.2} \quad (23)$$

$$IO(P2)=Iw\times P2^{2.2} \quad (24)$$

The CPU 207 receives the first driving current Im(i,j,P1) and the second driving current Im(i,j,P2) from the data line driving circuit 220. Upon receiving the first driving current Im(i,j,P1), the CPU 207 reads the first ideal characteristic data IO(P1) responsive to the first gradation value P1 from the second LUT 206, compares the first ideal characteristic data IO(P1) with the first driving current Im(i,j,P1), and updates the threshold voltage correction data Vt(i,j) stored on the threshold voltage correction memory 232 in accordance with the comparison results. If the following formula (25) holds, the CPU 207 adds ΔV to the threshold voltage correction data Vt(i,j). If the following formula (26) holds, the CPU 207 subtracts ΔV from the threshold voltage correction data Vt(i,j). If the following formula (27) holds, the CPU 207 does not update the threshold voltage correction data Vt(i,j). Note that ΔV is a predetermined fixed value.

$$IO(P1)-Im(i,j,P1)>0 \quad (25)$$

$$IO(P1)-Im(i,j,P1)<0 \quad (26)$$

$$IO(P1)-Im(i,j,P1)=0 \quad (27)$$

Upon receiving the second driving current Im(i,j,P2), the CPU 207 reads the first ideal characteristic data IO(P2) responsive to the second gradation value P2 from the second LUT 206, compares the second ideal characteristic data IO(P2) with the second driving current Im(i,j,P2), and updates the gain correction data B2R(i,j) stored on the gain correction memory 231 in accordance with the comparison results. If the following formula (28) holds, the CPU 207 adds ΔB to the gain correction data B2R(i,j). If the following formula (29) holds, the CPU 207 subtracts ΔB from the gain correction data B2R(i,j). If the following formula (30) holds, the CPU 207 does not update the gain correction data B2R(i,j). Note that ΔB is a predetermined fixed value.

$$IO(P2)-Im(i,j,P2)>0 \quad (28)$$

$$IO(P2)-Im(i,j,P2)<0 \quad (29)$$

$$IO(P2)-Im(i,j,P2)=0 \quad (30)$$

When the first measurement voltage Vm(i,j,P1) is applied to the gate terminal of the transistor T1, the gate-source voltage Vgs of the transistor T1 is relatively low. For this reason, the first driving current Im(i,j,P1) varies greatly in response to a shift of the threshold voltage Vt. On the other hand, when the second measurement voltage Vm(i,j,P2) is applied to the gate terminal of the transistor T1, the gate-source voltage Vgs of the transistor T1 is relatively high. The second driving current Im(i,j,P2) varies less in response to a shift of the threshold voltage Vt while varying greatly in response to a shift of gain β. The organic EL display apparatus 2 thus uses the first driving current Im(i,j,P1) as a determination criterion to determine whether to update the threshold voltage correction data Vt(i,j) or not, and uses the second driving current Im(i,j,P2) as a determination criterion to determine whether to update the gain correction data B2R(i,j) or not.

Figure 23:
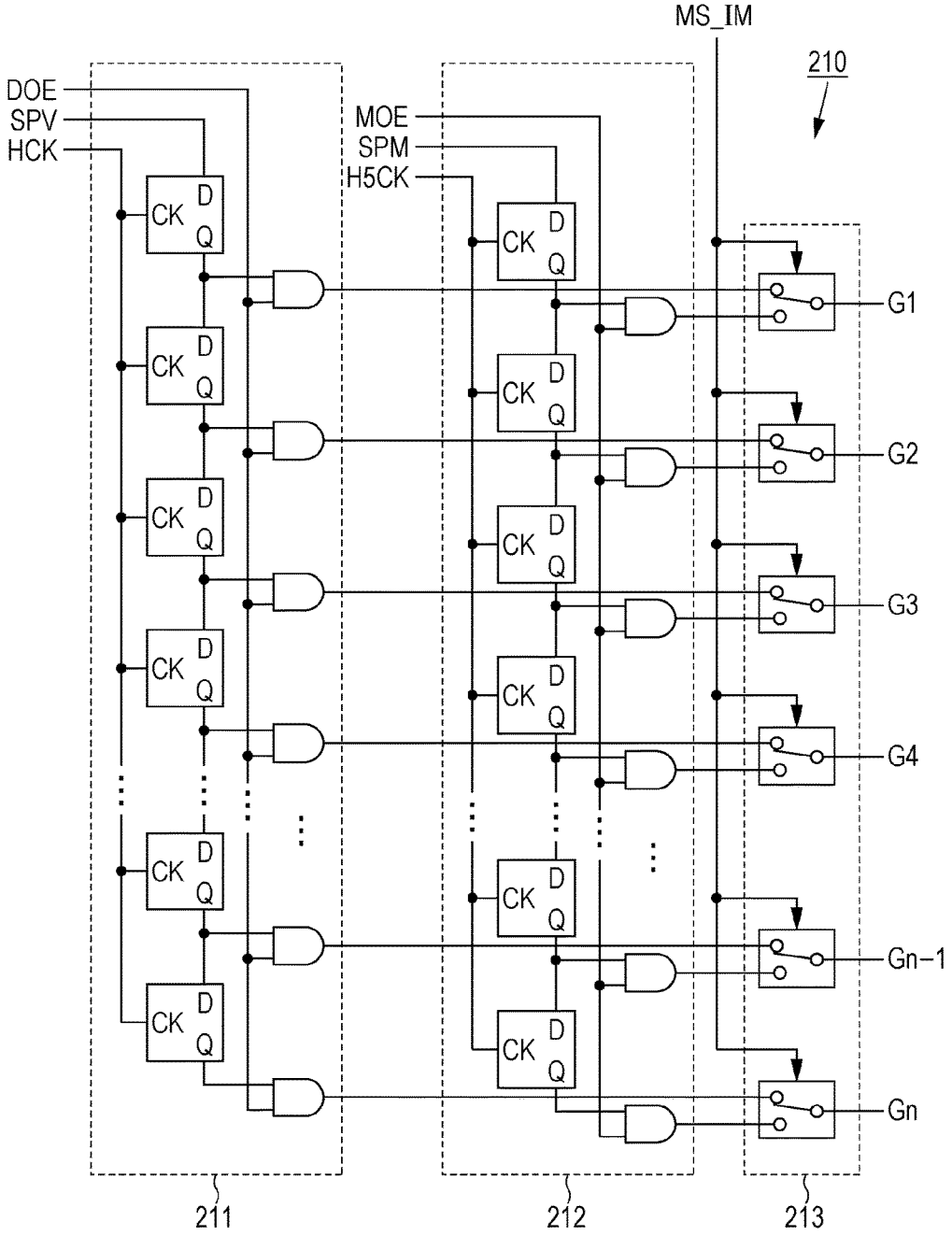
FIG. 23 is a circuit diagram of a scanning line driving circuit of FIG. 12.

FIG. 23 is a circuit diagram of the scanning line driving circuit 210. The scanning line driving circuit 210 includes two shift registers 211 and 212, and a selector module 213. The shift register 211 includes n D-type flipflops and n AND gate circuits. The n D-type flipflops are serially connected, and a first start pulse SPV is applied to the D terminal of the D-type flipflop at the first stage. The shift register 211 operates in accordance with a first clock HCK having one horizontal period as the period thereof. The AND gate circuit AND gates the output of each stage of the shift register 211 and a first enable signal DOE, and then outputs the AND gated signal. The shift register 211 generates a scanning signal during the video signal period.

The shift register 212 includes n D-type flipflops and n AND gate circuits. The n D-type flipflops are serially connected, and a second start pulse SPM is applied to the D terminal of the D-type flipflop at the first stage. The shift register 212 operates in accordance with a second clock H5CK having five horizontal periods as the period thereof. The AND gate circuit AND gates the output of each stage of the shift register 212 and a second enable signal MOE, and then outputs the AND gated signal. The shift register 212 generates a scanning signal during the vertical synchronization period.

The selector module 213 includes n selectors. The selector selects the output of the shift register 211 when a selector control signal MS_IM is at a low level, and selects the output of the shift register 212 when the selector control signal MS_IM is at a high level. The selector module 213 thus selects the outputs of the shift register 211 during the video signal period and selects the outputs of the shift register 212 during the vertical synchronization period. The outputs of the selector module 213 are applied to the scanning lines G1 through Gn.

Figure 24:
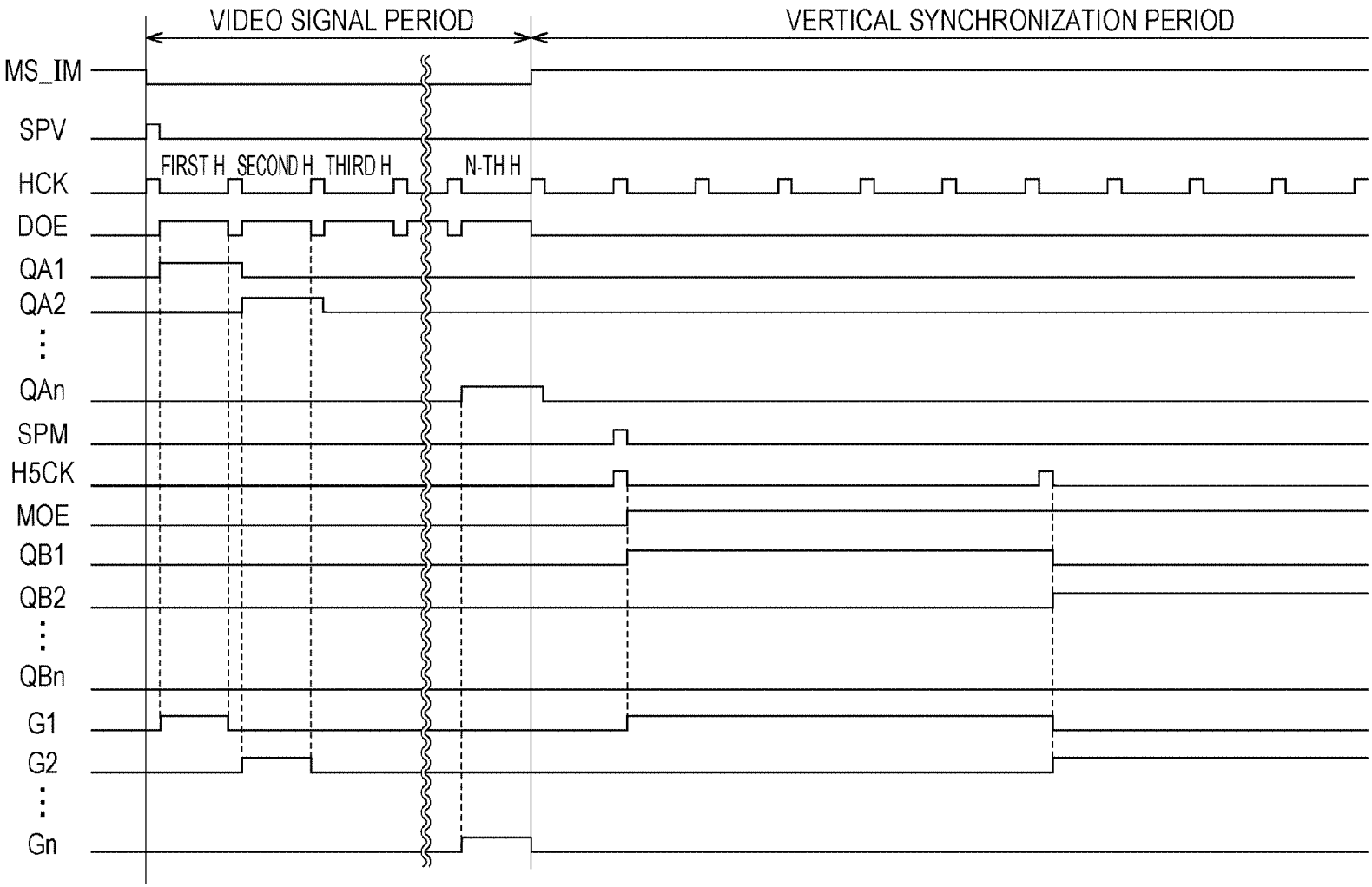
FIG. 24 is a timing diagram illustrating a scanning line driving circuit of FIG. 23.

FIG. 24 is a timing diagram illustrating of the scanning line driving circuit 210. Referring to FIG. 24, QA1 through QAn respectively represent the outputs of the n D-type flipflops included in the shift register 211, and QB1 through QBn respectively represent the outputs of the n D-type flipflops included in the shift register 212. The first clock HCK shifts to a high level once every horizontal period during the video signal period. The second clock H5CK shifts to a high level once every five horizontal periods, five times in total, during the vertical synchronization period. The first enable signal DOE is in an inverted shape of the first clock HCK during the video signal period, and continuously remains low during the vertical synchronization period. The second enable signal MOE continuously remains low during the video signal period. During the vertical synchronization period, the second enable signal MOE shifts to a high level at the falling edge of a first pulse of the second clock H5CK, and shifts to a low level after five horizontal periods from the falling edge of a k-th pulse of the second clock H5CK.

In this way, the organic EL display apparatus 2 performs both the threshold voltage compensation and gain compensation of the driving transistor on each pixel circuit 14.

In the organic EL display apparatus 2 of the present embodiment, the video data Vm(i,j,P) that is corrected using the threshold voltage correction data Vt(i,j) and is read from the threshold voltage correction memory 232 is amplified by the multiplier 205 by $\alpha$ times ($\alpha>1$). Even if the effect of the threshold voltage compensation is reduced by the parasitic capacitance, the organic EL display apparatus 2 of the present embodiment compensates for the reduction in the effect and performs the threshold voltage compensation of the driving transistor T1 at a higher precision level.

As described above, the organic EL display apparatus 2 of the present embodiment includes the memory (the threshold voltage correction memory 232) that saves the data responsive to the threshold voltage of the driving transistor T1 (the threshold voltage correction data Vt(i,j)) for each pixel circuit 14. During the current detection (the first and second measurement periods B2 and B4), the data line driving circuit 220 applies the voltage (such as the voltage Vgs expressed by formula (16)) responsive to the detection voltage (the first and second measurement voltages Vm(i,j,P1) and Vm(i,j,P2)) between the control terminal (gate terminal) and the first conducting terminal (source terminal) of the driving transistor T1. The data line driving circuit 220 converts the driving current output via the driving transistor T1 from the pixel circuit 11 into the first voltage (output voltage of the operational amplifier 41). During the voltage writing (program period), the data line driving circuit 220 applies the second voltage (the voltage Vgs expressed by formula (12)) responsive to the video data V0 and the threshold voltage Vt of the driving transistor T1 between the control terminal and the first conducting terminal of the driving transistor T1. The data voltage Vm(i,j,P) appearing on the right side of formula (12) is a voltage having undergone the threshold voltage compensation of the transistor T1. The second voltage is based on Vm(i,j,P) resulting from amplifying the video data that has been corrected using the threshold voltage of the transistor T1 determined using the first voltage. The display control circuit 200 updates the data saved on the memory in accordance with the first voltage, corrects the vide data using the data read from the memory, and multiplies the corrected video data by the constant $\alpha$. The display control circuit 200 thus determines the level of the output voltage of the data line driving circuit 220.

The organic EL display apparatus 2 of the present embodiment thus constructed converts the driving current output from the pixel circuit 14 into the first voltage. During the voltage writing, the driving transistor is provided with the second voltage that is based on the amplification results of the video data that is corrected using the threshold voltage of the driving current determined using the first voltage. Even if the effect of the threshold voltage compensation is reduced by the parasitic capacitance, the organic EL display apparatus 2 of the present embodiment compensates for the reduction in the effect and performs the threshold voltage compensation of the driving transistor T1 at a higher precision level.

The display control circuit 200 performs a correction operation (operation of FIG. 22) on the video data V0 to perform compensation in the threshold voltage and gain of the driving transistor using the amplified data. The image quality of a display image is improved by performing compensation in the threshold voltage and gain in the driving transistor T1 on each pixel circuit 14.

The organic EL display apparatus 2 of the fourth embodiment may be modified. The modification of the organic EL display apparatus 2 may include a threshold voltage correction memory configured to store the threshold voltage correction data, and may perform only the threshold voltage compensation of the driving transistor. The organic EL display apparatus of the modification may improve the image quality of a display image by the threshold voltage compensation of the driving transistor on each pixel circuit.

(Fifth Embodiment)

Figure 25:
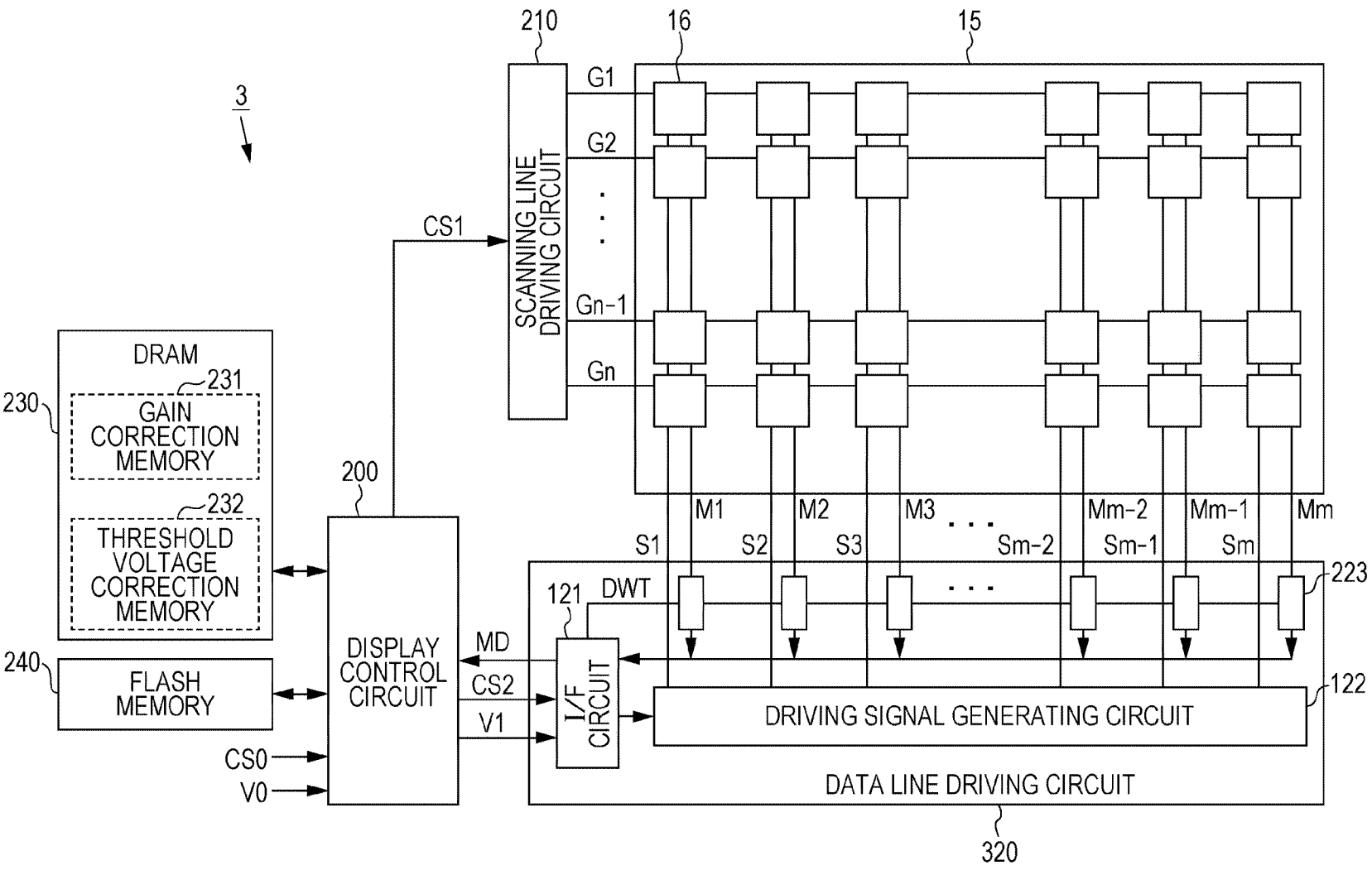
FIG. 25 is a block diagram illustrating a configuration of an organic EL display apparatus of a fifth embodiment of the present invention.

FIG. 25 is a block diagram illustrating a configuration of an organic EL display apparatus of a fifth embodiment of the present invention. The organic EL display apparatus 3 of FIG. 25 includes a display unit 15, a display control circuit 200, a scanning line driving circuit 210, a data line driving circuit 320, a DRAM 230, and a flash memory 240.

The display unit 15 includes n scanning lines G1 through Gn, m data lines S1 through Sm, m monitor lines M1 through Mm, and (m×n) pixel circuits 16. The data lines S1 through Sm, the scanning lines G1 through Gn, and (m×n) pixel circuits 16 are disposed in the same manner as in the display unit 10 of the first embodiment. The monitor lines M1 through Mm respectively extend in parallel with the data lines S1 through Sm. The display unit 15 includes a high-level power source line and a low-level power source line (both lines are not illustrated) in order to supply the high-level power source voltage ELVDD and the low-level power source voltage ELVSS to the pixel circuit 16.

Figure 26:
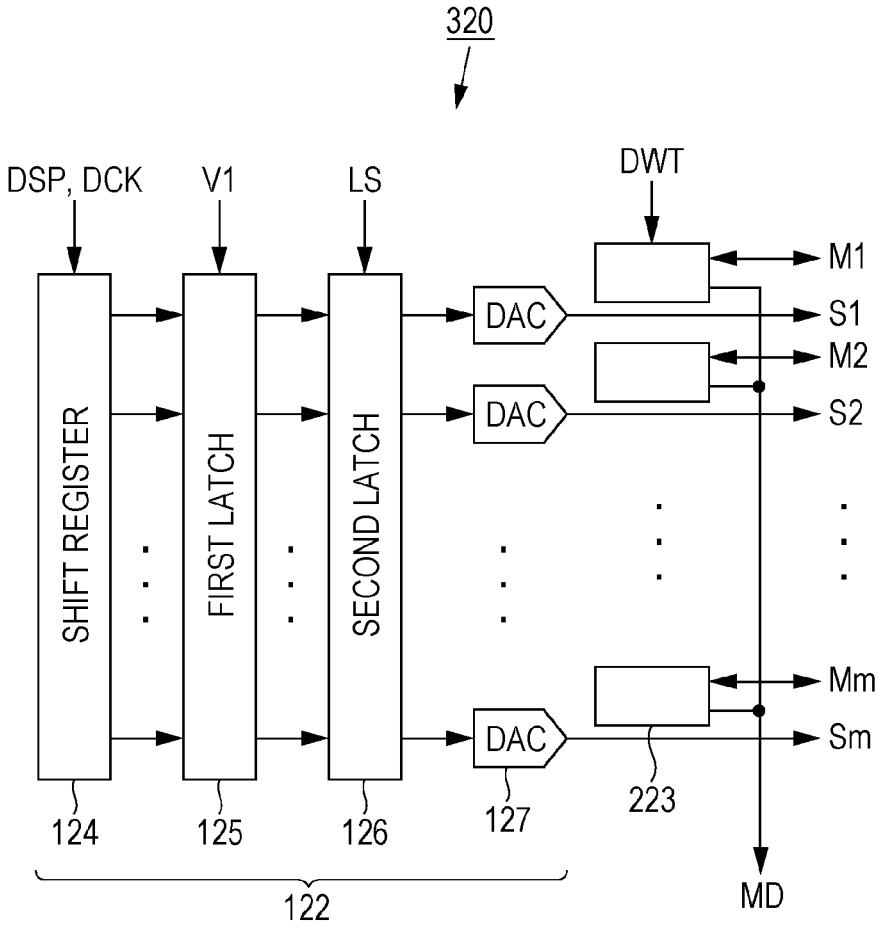
FIG. 26 is a block diagram illustrating in detail a data line driving circuit of FIG. 25.

FIG. 26 is a block diagram illustrating in detail the data line driving circuit 320. The data line driving circuit 320 includes an interface circuit 121 (not illustrated), a driving signal generating circuit 122, and m voltage output and current measurement circuits 223. The data line driving circuit 320 drives the data lines S1 through Sm while detecting driving currents having flowed from the pixel circuits 16 to the monitor lines M1 through Mm.

The voltage output and current measurement circuits 223 are respectively connected to the monitor lines M1 through Mm. When the input and output control signal DWT remains high, the voltage output and current measurement circuit 223 applies the reference voltage Vref supplied from a power source circuit (not illustrated) to the corresponding monitor line Mi. When the input and output control signal DWT remains low, the voltage output and current measurement circuit 223 measures the driving current having flowed from the pixel circuit PX(i,j) to the monitor line Mi, and outputs the measurement data MD indicating the measurement results.

Figure 27:
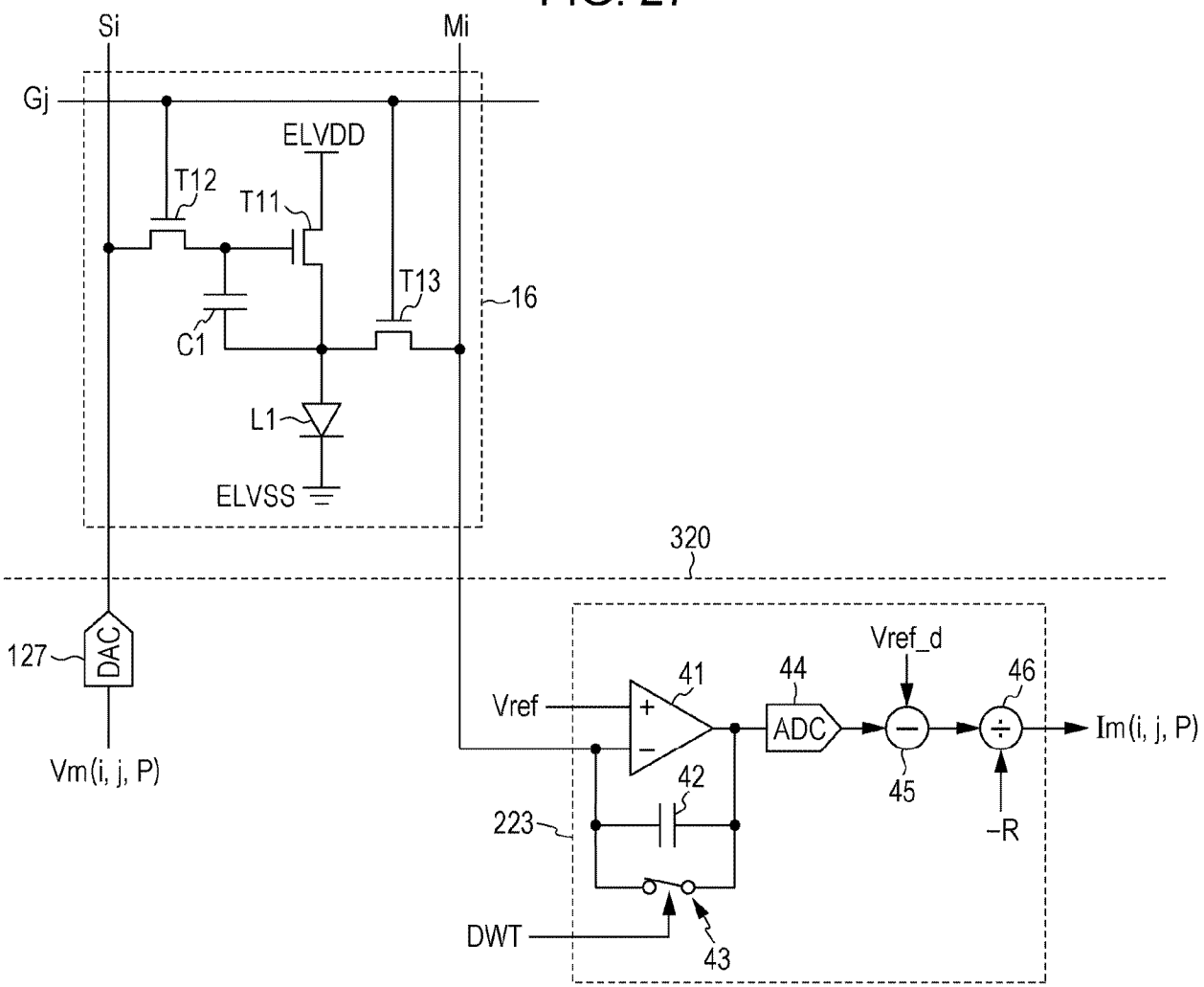
FIG. 27 is a circuit diagram illustrating a pixel circuit and a voltage output and current measurement circuit included in the organic EL display apparatus of FIG. 25.

FIG. 27 is a circuit diagram illustrating the pixel circuit 16 and the voltage output and current measurement circuit 223. FIG. 27 illustrates the pixel circuit PX(i,j), the D/A converter 127 for the data line Si, and the voltage output and current measurement circuit 223 corresponding to the monitor line Mi.

The pixel circuit 16 includes an organic EL element L1, three transistors T11 through T13, and a capacitor C1. The transistors T11 through T13 are of n-channel type. The transistors T11 through T13 are TFTs having a semiconductor layer of oxide semiconductor, such as indium gallium zinc oxide. The transistors T11 through T13 respectively work as a driving transistor, an input transistor, and an output transistor. The capacitor C1 works as a capacitance element.

The transistor T11 is connected in series with the organic EL element L1, and these elements are connected between a high-level power source line supplying the high-level power source voltage ELVDD and a low-level power source line supplying the low-level power source voltage ELVSS. The drain terminal of the transistor T11 is connected to the high-level power source line, and the source terminal of the transistor T11 is connected to the anode terminal of the organic EL element L1. The cathode terminal of the organic EL element L1 is connected to the low-level power source line. The transistor T12 is connected between the data line Si and the gate terminal of the transistor T11. The transistor T13 is connected between the monitor line Mi and the source terminal of the transistor T11. The gate terminals of the transistors T12 and T13 are connected to the scanning line Gj. The capacitor C1 is connected between the gate terminal and the source terminal of the transistor T1.

The voltage output and current measurement circuit 223 is connected in a configuration different from the fourth embodiment. In the present embodiment, the inverting input terminal of the operational amplifier 41 is connected to the monitor line Mi and the non-inverting terminal of the operational amplifier 41 is continuously supplied with the reference voltage Vref. The one terminal of the subtracter 45 is continuously supplied with a digital value Vref_d corresponding to the reference voltage Vref. The subtracter 45 subtracts the digital value Vref_d from the digital value output from the A/D converter 44. If the reference voltage Vref is zero, the subtracter 45 may be removed.

When the input and output control signal DWT is at a high level, the switch 43 is turned on. The operational amplifier 41 then works as a buffer amplifier, thereby applying the reference voltage Vref to the monitor line Mi at a low-output impedance. When the input and output control signal DWT is at a low level, the switch 43 is turned off. The operational amplifier 41 and the capacitor 42 work as an integrating amplifier. The output of the divider 46 is Im(i,j,P) indicating the value of a driving current that has flowed through the transistor T11 into the monitor line Mi.

The pixel circuit 16 and the voltage output and current measurement circuit 223 operate at timings identical to those of the fourth embodiment (see FIG. 16, FIG. 17, and FIG. 20). The input and output control signal DWT and the scanning signals G1 through Gn shift at timings of FIG. 16. Since the input and output control signal DWT remains high during the video signal period (FIG. 17), the voltage output and current measurement circuit 223 continuously applies the reference voltage Vref to the monitor line Mi. Since the scanning signal Gj remains high during the program period A1, the video data Vm(i,j,P) is applied to the data line Si. For this reason, during the program period A1, the scanning signal Gj shifts to a high level and the voltage Vm(i,j,P) is applied to the data line Si. During the program period A1, the transistors T12 and T13 are turned on, causing the capacitor C1 to be charged with a voltage {Vm(i,j,P)−Vref}. Subsequent to the end of the program period A1, the scanning signal Gj shifts to a low level, turning off the transistors T12 and T13, and causing the capacitor C1 to store the voltage {Vm(i,j,P)−Vref}. The organic EL element L1 thereafter emits light at a luminance level responsive to the voltage stored on the capacitor C1.

The scanning signal Gj remains high throughout five horizontal periods during the vertical synchronization period (FIG. 20), and the input and output control signal DWT remains high during each of the first through third program periods B1, B3, and B5, but remains low during each of the first and second measurement periods B2 and B4. The operational amplifier 41 works as a buffer amplifier during each of the first through third program periods B1, B3, and B5, and the operational amplifier 41 and the capacitor 42 work as an integrating amplifier during each of the first and second measurement periods B2 and B4. During the first program period B1, the data voltage Vm(i,j,P1) responsive to the first gradation value P1 is applied to the data line Si, and the capacitor C1 is charged with the voltage {Vm(i,j,P1)−Vref}. During the first measurement period B2, the driving current having passed through the transistor T11 flows to the monitor line Mi. The voltage output and current measurement circuit 223 measures the driving current having flowed from the pixel circuit PX(i,j) to the monitor line Mi, and outputs the first driving current Im(i,j,P1) indicating that measured value. During each of the second and third program periods B3 and B5, the same operation performed during the first program period B1 is performed. During the second measurement period B4, the same operation performed during the first measurement period B2 is performed. In the same way as in the fourth embodiment, the display control circuit 200 performs the correction operation of FIG. 22.

In the organic EL display apparatus 3 of the present embodiment, as described above, the pixel circuit 16 includes the electro-optical element (the organic EL element L1) and the driving transistor T11 connected in series with the electro-optical element. The data line driving circuit 320 operates in the same way as in the fourth embodiment. The display unit 15 includes multiple monitor lines M1 through Mm. During the current detection (during each of the first and second measurement periods B2 and B4), the data line driving circuit 320 applies the detection voltages (the first and second measurement voltages Vm(i,j,P1) and Vm(i,j,P2)) to the data line Si, and detects the driving current having flowed from the pixel circuit 16 to the monitor line Mi. The display apparatus having the monitor lines M1 through Mm, separate from the data lines S1 through Sm, detects the driving current flowing through the monitor line Mi with the detection voltage applied to the data line Si.

The pixel circuit 16 includes the input transistor T12 connected between the data line Si and the control terminal (gate terminal) of the driving transistor T11, and having the control terminal (gate terminal) connected to the scanning line Gi, the output transistor T13 connected between the monitor line Mi and the first conducting terminal (source terminal) of the driving transistor T1, and having the control terminal connected to the scanning line, and the capacitance element (the capacitor C1) connected between the control terminal and the first conducting terminal of the driving transistor T11. The pixel circuit 16 thus includes the capacitance element between the control terminal and the first conducting terminal of the driving transistor T11, and applies the voltage at the data line Si to the control terminal of the driving transistor T11. The pixel circuit 16 thus performs the threshold voltage compensation of the driving transistor T11 at a higher precision level.

Figure 28:
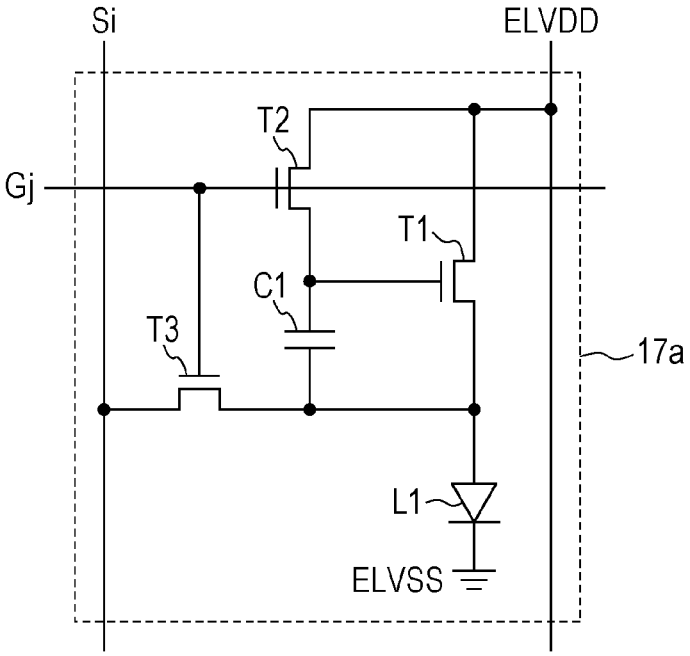
FIG. 28 is a circuit diagram of a pixel circuit included in an organic EL display apparatus as a modification to the embodiments of the present invention.

In the above discussion, the display unit 10 includes the pixel circuit 11 (FIG. 3), the display unit 13 includes the pixel circuit 14 (FIG. 15), and the display unit 15 includes the pixel circuit 16 (FIG. 27). The display unit of each organic EL display apparatus of the present invention may include another pixel circuit. For example, the display unit may not include the light-emission control line but may include (m×n) pixel circuits of FIG. 28. The pixel circuit 17*a* of FIG. 28 is the pixel circuit 11 without the transistor T4. In the pixel circuit 17*a*, the source terminal of the transistor T1 is connected to the anode terminal of the organic EL element L1.

Figure 29:
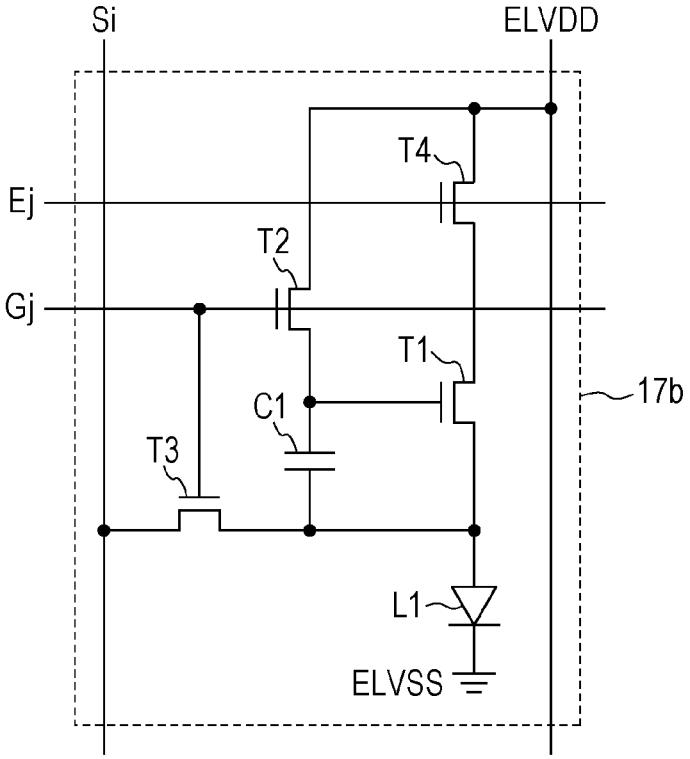
FIG. 29 is a circuit diagram of a pixel circuit included in an organic EL display apparatus as a modification to the embodiments of the present invention.

Alternatively, the display unit may include (m×n) pixel circuits illustrated in FIG. 29 through FIG. 33 together with n light-emission control lines E1 through En. A pixel circuit 17*b* illustrated in FIG. 29 is the pixel circuit 11 with the transistor T4 changed in location. In the pixel circuit 17*b*, the transistor T4 has the drain terminal thereof connected to the high-level power source line, the source terminal thereof connected to the drain terminal of the transistor T1, and the gate terminal thereof connected to the light-emission control line Ej.

Figure 30:
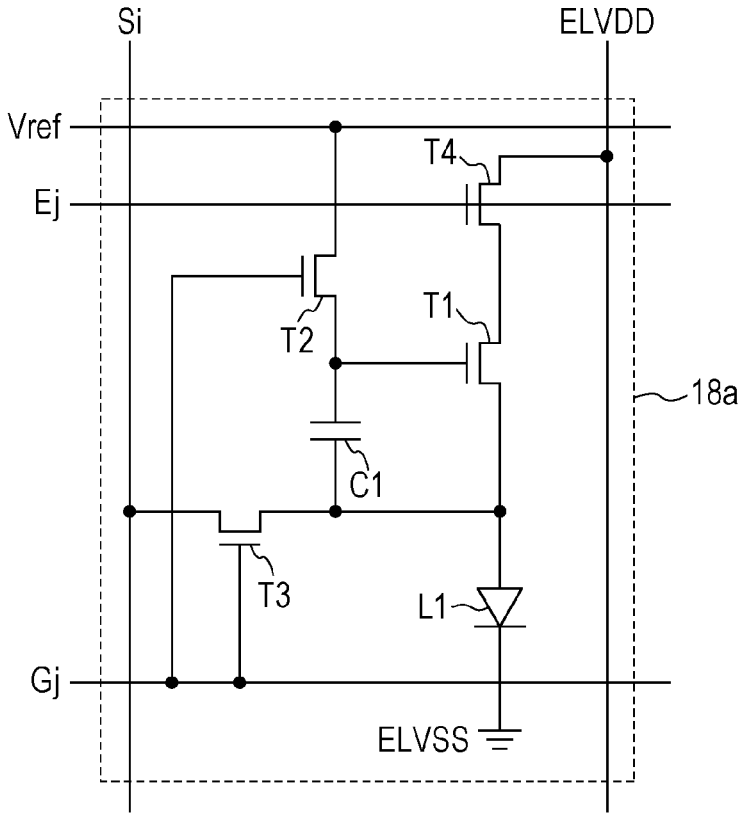
FIG. 30 is a circuit diagram of a pixel circuit included in an organic EL display apparatus as a modification to the embodiments of the present invention.
Figure 31:
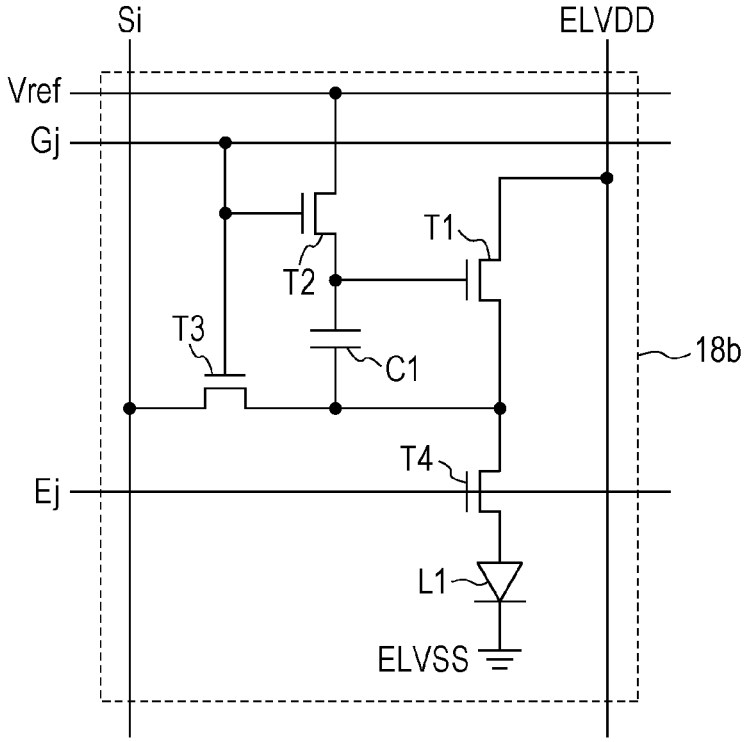
FIG. 31 is a circuit diagram of a pixel circuit included in an organic EL display apparatus as a modification to the embodiments of the present invention.

Pixel circuits 18*a* and 18*b* illustrated in FIG. 30 and FIG. 31 is the pixel circuit 14 with an n-channel transistor T4 added thereto. In the pixel circuit 18*a*, the transistor T4 has the drain terminal thereof connected to the high-level power source line, the source terminal thereof connected to the drain terminal of the transistor T1, and the gate terminal thereof connected to the light-emission control line Ej. In the pixel circuit 18*b*, the transistor T4 has the drain terminal thereof connected to the source terminal of the transistor T1, the source terminal thereof connected to the anode terminal of the organic EL element L1, and the gate terminal thereof connected to the light-emission control line Ej.

Figure 32:
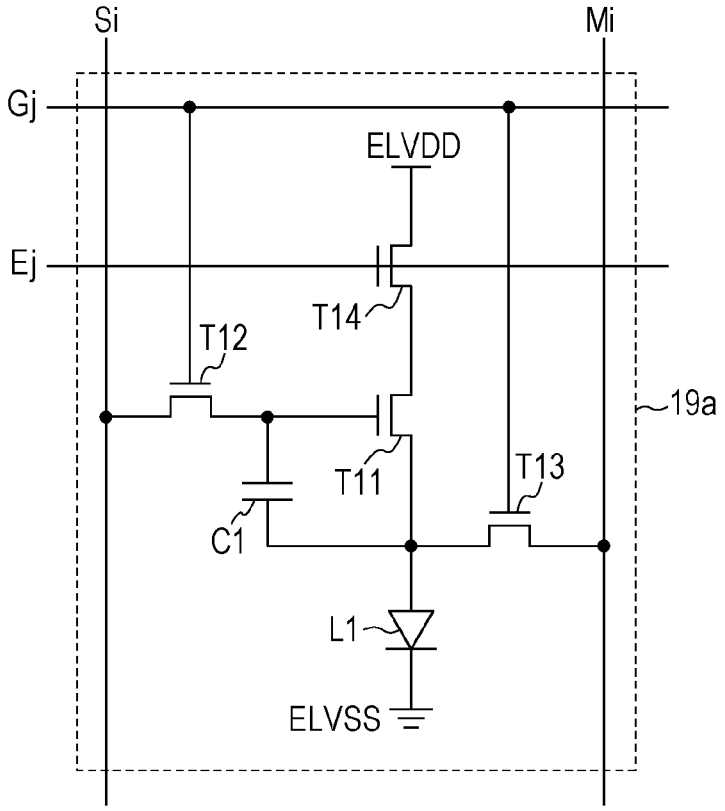
FIG. 32 is a circuit diagram of a pixel circuit included in an organic EL display apparatus as a modification to the embodiments of the present invention.
Figure 33:
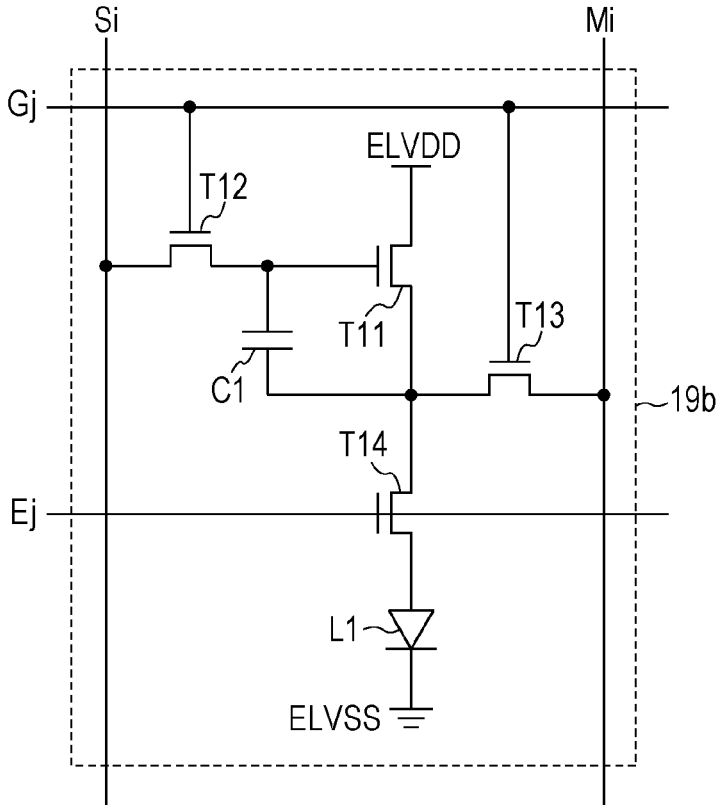
FIG. 33 is a circuit diagram of a pixel circuit included in an organic EL display apparatus as a modification to the embodiments of the present invention.

Pixel circuits 19*a* and 19*b* illustrated in FIG. 32 and FIG. 33 is the pixel circuit 16 with an n-channel transistor T14 added thereto. In the pixel circuit 19*a*, the transistor T14 has the drain terminal thereof connected to the high-level power source line, the source terminal thereof connected to the drain terminal of the transistor T11, and the gate terminal thereof connected to the light-emission control line Ej. In the pixel circuit 19*b*, the transistor T14 has the drain terminal thereof connected to the source terminal of the transistor T11, the source terminal thereof connected to the anode terminal of the organic EL element L1, and the gate terminal thereof connected to the light-emission control line Ej.

The signal on the light-emission control line Ej is controlled to be at a high level during the light emission period of the organic EL element L1, thereby turning on the transistor T4 and T14. The signal on the light-emission control line Ej is controlled to be at a low level during the non-light emission period of the organic EL element L1, thereby turning off the transistor T4 and T14. Each of the pixel circuits 17*b*, 18*a*, 18*b*, 19*a*, and 19*b* includes the light-emission control transistor T4 (or T14) that is connected in series with the electro-optical element (the organic EL element L1) and the driving transistor T1 (or T11) and has the control terminal (gate terminal) thereof connected to the light-emission control line Ej. The organic EL display apparatus including the pixel circuit having the light-emission control transistor controls an unwanted current to the electro-optical element by controlling the light-emission transistor. The driving current is detected as a higher precision level.

The features of the embodiments may be combined to form a variety of organic EL display apparatuses as long as the combination results adversely affect the quality of the embodiments. For example, each of the organic EL display apparatuses of the first and second embodiments may include a pixel circuit (such as the pixel circuit 12, 14, 16, 17*b*, 17*b*, 18*a*, 18*b*, 19*a*, or 19*b*) other than the pixel circuit 11. Each of the organic EL display apparatuses of the fourth and fifth embodiments may include a pixel circuit (such as the pixel circuit 11, 12, 17*b*, 17*b*, 18*a*, 18*b*, 19*a*, or 19*b*) other than the pixel circuits 14 and 16. The capacitor C2 may be included in the pixel circuit other than the pixel circuit 12.

An oxide semiconductor layer included in the oxide TFT is described below. The oxide semiconductor layer is an In—Ga—Zn—O based semiconductor layer. The oxide semiconductor layer may contain In—Ga—Zn—O based semiconductor. The In—Ga—Zn—O based semiconductor is ternary oxide of In (indium), Ga (gallium), and Zn (zinc). Percentage (composition ratio) of In, Ga, and Zn is not limited to any value. For example, the composition ratio may be In:Ga:Zn=2:2:1, In:Ga:Zn=1:1:1, or In:Ga:Zn=1:1:2.

With its high mobility (20 times higher than that of amorphous silicon TFT) and its low-leakage current (less than one-hundredth of that of amorphous silicon TFT), the TFT manufactured of In—Ga—Zn—O based semiconductor layer is appropriately used for a driving TFT and a switching TFT in the pixel circuit. The use of the TFT manufactured of In—Ga—Zn—O based semiconductor layer substantially reduces the power consumption of the display apparatus.

In—Ga—Zn—O based semiconductor may be amorphous, or crystalline with a crystalline region included. Crystalline In—Ga—Zn—O based semiconductor is preferably crystalline In—Ga—Zn—O based semiconductor with the c axis generally vertically aligned to the layer plane. Such a crystal structure of the In—Ga—Zn—O based semiconductor is disclosed in Japanese Unexamined Patent Application Publication No. 2012-134475.

The oxide semiconductor layer may include another oxide semiconductor instead of the In—Ga—Zn—O based semiconductor. For example, the oxide semiconductor layer may include Zn—O based semiconductor (ZnO), In—Zn—O based semiconductor (IZO (registered trademark)), Zn—Ti—O based semiconductor (ZTO), Cd—Ge—O based semiconductor, Cd—Pb—O based semiconductor, CdO semiconductor (cadmium oxide), Mg—Zn—O based semiconductor, In—Sn—Zn—O based semiconductor (such as $In_2O_3$—$SnO_2$—ZnO), or In—Ga—Sn—O based semiconductor.

As described above, each of the display apparatuses of the present invention converts the driving current flowing through the driving transistor into the first voltage, and applies, between the control terminal and the first conducting terminal of the driving transistor, the correction voltage based on the voltage resulting from amplifying the first voltage (or based on data responsive to the threshold voltage of the driving transistor determined using the first voltage). Even if there is a difference between the gain of the driving transistor and the gain of the current detecting circuit or even if the effect of the threshold voltage compensation is reduced by the parasitic capacitance of the signal line, the threshold voltage compensation of the driving transistor is performed at a higher precision level.

INDUSTRIAL APPLICABILITY

Since the display apparatus of the present invention has the advantage that the threshold voltage compensation of the driving transistor is performed at a higher precision level, the display apparatus of the present invention finds applications in a variety of active matrix display apparatuses, including the pixel circuit having the electro-optical element, such as an organic EL display apparatus.

REFERENCE SIGNS LIST

1 through 3 . . . Organic EL display apparatus
10, 13, and 15 . . . Display units
11, 12, 14, and 16 through 19 . . . Pixel circuits
100 and 200 . . . Display control circuits
110 and 210 . . . Scanning line driving circuits
120, 130, 220, and 320 . . . Data line driving circuits
123 and 143 . . . Detection/correction output circuits
205 . . . Multiplier
223 . . . Voltage output and current measurement circuit
232 . . . Threshold voltage correction memory
L1 . . . Organic EL element
T1 through T4, T11 through T14, and 21 through 28 . . . Transistors
C1 and C2, 31 through 33, and 42 . . . Capacitors
Cp1 and Cp2 . . . Parasitic capacitances
20 and 41 . . . Operational amplifiers
34 and 35 . . . Resistance elements
36 . . . Non-inverting amplifier circuit
43 . . . Switch

The invention claimed is:

1. An active matrix display apparatus comprising:

a display unit including a plurality of scanning lines, a plurality of data lines, a plurality of high-level power source lines, and a plurality of pixel circuits respectively disposed at intersections of the plurality of scanning lines and the plurality of data lines, a scanning line driving circuit that drives the plurality of scanning lines, a data line driving circuit that drives the plurality of data lines, a display control circuit, and an external circuit connected to each of the plurality of pixel circuits, wherein each of the plurality of pixel circuits includes an electro-optical element, a driving transistor connected in series with the electro-optical element, a voltage application transistor directly connected between each of the plurality of high-level power source lines and a control terminal of the driving transistor, an input-output transistor directly connected between each of the plurality of data lines and a first conducting terminal of the driving transistor, and a capacitor directly connected between the control terminal and the first conducting terminal of the driving transistor, a gate terminal of the voltage application transistor and a gate terminal of the input-output transistor being directly connected to each of the plurality of scanning lines, the data line driving circuit applies a voltage responsive to a detection voltage between the control terminal and the first conducting terminal of the driving transistor, and converts a driving current flowing from each of the plurality of high-level power source lines to each of the plurality of data lines via the driving transistor and the input-output transistor and being output from the pixel circuit into a first voltage during current detection, which is a first period, and applies a second voltage, responsive to video data and a threshold voltage of the driving transistor, between the control terminal and the first conducting terminal of the driving transistor during voltage writing, which is a second period, the second voltage is based on a voltage resulting from amplifying the first voltage, or is based on data resulting from amplifying the video data that is corrected using the threshold voltage of the driving transistor determined using the first voltage, the driving transistor is an n-channel type transistor, the plurality of scanning lines are divided into one or more blocks, the scanning line driving circuit selects all of the plurality of scanning lines in each block at a time during the first period and successively selects the plurality of scanning lines one by one in each block during the second period, in each block the data line driving circuit converts a driving current output from the pixel circuit into the first voltage during the first period and applies to one of the plurality of data lines a voltage responsive to the video data and a voltage responsive to the first voltage during the second period, during the first period, the voltage application transistor and the input-output transistor are on and the control terminal of the driving transistor is fixed to a voltage of each of the plurality of high-level power source lines, the external circuit includes at least a p-channel type transistor that operates as a current detecting transistor, and the current detecting transistor converts the driving current into the first voltage.

2. The display apparatus according to claim 1, wherein the data line driving circuit includes an amplifier that amplifies the first voltage, and a compensation capacitance element that stores a voltage responsive to an output voltage from the amplifier, and applies the second voltage between the control terminal and the first conducting terminal of the driving transistor using the voltage stored in the compensation capacitance element.

3. The display apparatus according to claim 2, wherein the amplifier includes an amplifier circuit including a plurality of resistance elements connected in series.

4. The display apparatus according to claim 3, wherein a second conducting terminal and a control terminal of the current detecting transistor is directly connected to a node between one of the plurality of resistance elements and another of the plurality of resistance elements.

5. The display apparatus according to claim 3, wherein the data line driving circuit includes an operational amplifier, an output terminal of the operational amplifier is directly connected to one of the plurality of resistance elements, and an inverting input terminal of the operational amplifier is directly connected to connected to each of the plurality of data lines.

6. The display apparatus according to claim 2, wherein the amplifier includes a non-inverting amplifier circuit.

7. The display apparatus according to claim 6, wherein the data line driving circuit includes an operational amplifier, an output terminal of the operational amplifier is directly connected to a control terminal of the current detecting transistor, an inverting input terminal of the operational amplifier is directly connected to connected to each of the plurality of data lines, and an non-inverting input terminal of the operational amplifier is directly connected to the non-inverting amplifier circuit.

8. The display apparatus according to claim 1, wherein the data line driving circuit includes a compensation capacitance element that stores a voltage responsive to the first voltage, and an amplifier amplifying a voltage responsive to the voltage stored on the compensation capacitance element, and applies the second voltage between the control terminal and the first conducting terminal of the driving transistor by using an output voltage of the amplifier.

9. The display apparatus according to claim 1, further comprising:

a memory that saves data responsive to the threshold voltage of the driving transistor on each pixel circuit, wherein the display control circuit updates the data saved on the memory in response to the first voltage, corrects the video data using the data read from the memory, and determines a level of an output voltage of the data line driving circuit by multiplying the corrected video data by a constant.

10. The display apparatus according to claim 9, wherein the display control circuit performs a correction operation on the video data to perform compensation on the threshold voltage and a gain of the driving transistor.

11. The display apparatus according to claim 9, wherein the display control circuit performs a correction operation on the video data to perform compensation on the threshold voltage of the driving transistor.

12. The display apparatus according to claim 1, wherein the data line driving circuit applies the detection voltage to the one of the plurality of data lines and detects a driving current having flowed from the pixel circuit to the one of the plurality of data lines during the current detection.

13. The display apparatus according to claim 1, wherein the driving transistor is a thin-film transistor manufactured of a semiconductor layer of oxide semiconductor.

14. The display apparatus according to claim 13, wherein the oxide semiconductor includes indium gallium zinc oxide.

15. The display apparatus according to claim 14, wherein the indium gallium zinc oxide is crystalline.

16. The display apparatus according to claim 1, wherein a first conducting terminal of the current detecting transistor is directly connected to each of the plurality of data lines and a second conducting terminal of the current detecting transistor is directly connected to a control terminal of the current detecting transistor.

17. A driving method of an active matrix display apparatus including a display unit including a plurality of scanning lines, a plurality of data lines, a plurality of pixel circuits respectively disposed at intersections of the plurality of scanning lines and the plurality of data lines, a plurality of high-level power source lines, and an external circuit connected to each of the plurality of pixel circuits, the method comprising:

with each of the plurality of pixel circuits including an electro-optical element, a driving transistor connected in series with the electro-optical element, a voltage application transistor directly connected between each of the plurality of high-level power source lines and a control terminal of the driving transistor, an input-output transistor directly connected between each of the plurality of data lines and a first conducting terminal of the driving transistor, and a capacitor directly connected between the control terminal and the first conducting terminal of the driving transistor, a gate terminal of the voltage application transistor and a gate terminal of the input-output transistor being directly connected to each of the plurality of scanning lines, a step of applying a voltage responsive to a detection voltage between the control terminal and the first conducting terminal of the driving transistor by driving one of the plurality of scanning lines and one of the plurality of data lines, a step of converting a driving current flowing from each of the plurality of high-level power source lines to each of the plurality of data lines via the driving transistor and the input-output transistor and being output from the pixel circuit into a first voltage, and a step of applying a second voltage, responsive to video data and a threshold voltage of the driving transistor, between the control terminal and the first conducting terminal of the driving transistor by driving the one of the plurality of scanning lines and the one of the plurality of data lines, wherein the second voltage is based on a voltage resulting from amplifying the first voltage, or is based on data resulting from amplifying the video data that is corrected using the threshold voltage of the driving transistor determined using the first voltage, the driving transistor is an n-channel type, the plurality of scanning lines are divided into one or more blocks, all of the plurality of scanning lines is selected in each block at a time during a first period, and the plurality of scanning lines is successively selected one by one in each block during a second period, in each block, a driving current output is converted from the pixel circuit into the first voltage during the first period, and a voltage responsive to the video data and a voltage responsive to the first voltage are applied to one of the plurality of data lines during the second period, during the first period, the voltage application transistor and the input-output transistor are on and the control terminal of the driving transistor is fixed to a voltage of each of the plurality of high-level power source lines, the external circuit includes at least a p-channel type transistor that operates as a current detecting transistor, and the current detecting transistor converts the driving current into the first voltage.

* * * * *